US007235352B2

(12) United States Patent
Oka et al.

(10) Patent No.: US 7,235,352 B2
(45) **Date of Patent: *Jun. 26, 2007**

(54) PHOTOTHERMOGRAPHIC MATERIAL

(75) Inventors: Yutaka Oka, Kanagawa (JP); Seiichi Yamamoto, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/602,622

(22) Filed: Jun. 25, 2003

(65) Prior Publication Data

US 2004/0005522 A1 Jan. 8, 2004

(30) Foreign Application Priority Data

Jun. 28, 2002 (JP) ..... 2002-189001
Aug. 9, 2002 (JP) ..... 2002-232959
Feb. 20, 2003 (JP) ..... 2003-042974

(51) Int. Cl.
*G03C 1/06* (2006.01)
*G03C 1/498* (2006.01)

(52) U.S. Cl. ..... 430/604; 430/567; 430/605; 430/619

(58) Field of Classification Search ..... 430/619, 430/620, 567, 568, 600, 611, 604, 605, 607
See application file for complete search history.

(56) References Cited

U.S. PATENT DOCUMENTS 4,332,889 A * 6/1982 Siga et al. ..... 430/583
5,492,803 A 2/1996 Landgrebe et al.
5,686,228 A 11/1997 Murray et al.
5,747,236 A 5/1998 Farid et al.
5,958,668 A * 9/1999 Matsumoto et al. ..... 430/619
5,998,126 A * 12/1999 Toya et al. ..... 430/619
6,060,231 A 5/2000 Zou
6,090,538 A 7/2000 Arai et al.
6,143,488 A 11/2000 Uytterhoeven et al.
6,156,491 A 12/2000 Goto
6,171,767 B1 * 1/2001 Kong et al. ..... 430/350
6,174,663 B1 1/2001 Kato
6,265,146 B1 7/2001 Kashiwagi
6,274,297 B1 8/2001 Uytterhoeven et al.
6,376,167 B1 * 4/2002 Ito ..... 430/619
6,413,712 B1 7/2002 Yoshioka et al.
6,482,583 B1 * 11/2002 Ikari ..... 430/619
6,645,714 B2 11/2003 Oya et al.
6,689,554 B2 2/2004 Yamada et al.
6,855,488 B2 2/2005 Yamada et al.
2001/0041313 A1 * 11/2001 Takiguchi ..... 430/603
2003/0224307 A1 12/2003 Yamamoto et al.

FOREIGN PATENT DOCUMENTS

EP 0922995 6/1999
JP A 8-297345 11/1996
JP A 2001-100356 4/2001

* cited by examiner

*Primary Examiner*—Thorl Chea
(74) *Attorney, Agent, or Firm*—Margaret A. Burke; Sheldon J. Moss

(57) ABSTRACT

The present invention provides a photothermographic material including a support having disposed on one surface thereof at least one image-forming layer containing a binder, an organic silver salt, a reducing agent for reducing silver ions, an organic polyhalogen compound and a photosensitive silver halide, wherein the photosensitive silver halide has a silver iodide content ranging from 10 mol % to 100 mol %. The silver halide further contains at least one metal selected from a first metal group and one metal selected from a second metal group, with a proviso that none of the at least one metal selected from the first metal group and the at least one metal selected from the second metal group are the same.

8 Claims, No Drawings

PHOTOTHERMOGRAPHIC MATERIAL

CROSS-REFERENCE TO RELATED APPLICATION

This application claims priority under 35 USC 119 from Japanese Patent Application Nos. 2002-189001, 2002-232959 and 2003-42974, the disclosure of which is incorporated by reference herein.

BACKGROUND OF THE INVENTION

1. Field of the Invention

The present invention relates to a photothermographic material having a high silver iodide content. More specifically, the invention relates to a photothermographic material that exhibits high sensitivity and low fog, and is excellent in lightfastness of images after processing.

2. Description of the Related Art

In recent years in the medical field, it has been strongly desired to reduce the volume of processing waste fluids from the standpoints of environmental protection and conservation of space. Thus, there has been a need for technologies relating to photothermographic materials which are applicable for medical diagnosis or photographic technologies and can efficiently be exposed by a laser image setter or a laser imager to form clear black images having high resolution and sharpness. These photothermographic materials are advantageous in providing customers with a thermally developing system that does not need liquid-type processing solutions, and which is simple and not harmful to the environment.

There is also a need for the similar technologies in the field of ordinary image forming materials. In particular in the field of medical diagnosis, which requires detail depiction, high quality images excellent in sharpness and graininess are needed and blue black image tone is desired in view of diagnosing readiness. Currently, various types of hard copy systems using pigments and dyes, for example, ink jet printers and electrophotographic systems are widely used as the ordinary imaging system. However, the materials are not yet satisfactory in view of image quality (sharpness, graininess, gradation and tone) for providing diagnostic ability necessary for medical images and recording speed (sensitivity), and they have not yet reached a level at which they can replace existent medical films containing silver sats, that are used in a conventional wet developing system.

On the other hand, photothermographic image forming systems using organic silver salts are described, for example, in U.S. Pat. Nos. 3,152,904 and 3,457,075, and in "Thermally Processed Silver Systems" written by D. H. Klosterboer, "Imaging Processes and Materials" written by Neblette, 8th Ed., edited by J. Sturge, V. Walworth & A. Shepp, Chap. 9, p. 279, 1989. Usually, photothermographic materials have a photosensitive layer produced by dispersing a catalytically active amount of a photocatalyst (e.g., silver halide), a reducing agent, a reducible silver salt (e.g., organic silver salt), and optionally a toning agent for adjusting silver color tone in a binder matrix. Photothermographic materials of this type are, after having been imagewise exposed, heated to an elevated temperature (e.g., at 80° C. or higher) to form black silver images through a redox reaction between a reducible silver salt (serving as an oxidizing agent) and a reducing agent. The redox reaction is accelerated by catalytic action of latent images which have been formed on silver halides exposed to light. Therefore, the black silver images are formed in the exposed area (see, for example, U.S. Pat. No. 2,910,377 and Japanese Patent Application Publication (JP-B) No.43-4924).

As a result, the Fuji Medical Dry Imager (FM-DP L) was marketed as a medical diasnostic image-forming system utilizing the photothermographic materials.

There are two methods for manufacturing the photothermographic material utilizing the organic silver salt. The first method involves applying a coating liquid containing the silver salt dissolved in a solvent and the second method involves applying an aqueous coating liquid containing polymer fine particles as a main binder followed by drying. The latter method is advantageous in that it only requires a simple manufacturing equipment since a step for recovering the solvent is unnecessary, making it well-suited for mass-production.

Since such an image forming system utilizing the organic silver salt does not employ a fixing step, it is problematic in that after development, image preservation is adversely affected, especially when the printed out image is exposed to light. In order to improve this printout problem, a method utilizing AgI formed by converting the organic silver salt is described in certain patent publications, e.g., U.S. Pat. No. 6,143,488 and European Patent (EP) No. 0922995. However, these methods of utilizing the conversion of the organic silver salt with iodine were incapable of obtaining sufficient sensitivity, and were thus unable to create practically applicable systems.

Other photosensitive materials utilizing AgI are described in patent publications (e.g., WO97/48014, WO97/48015, U.S. Pat. No. 6,165,705, Japanese Patent Application Laid-Open (JP-A) No. 8-297345, and Japanese Patent No. 2785129), however, these could not achieve sufficient sensitivity or fogging levels, and hence, these materials are unsuitable for actual use as photosensitive materials exposed with lasers.

In order to increase sensitivity of a photographic silver iodide emulsion, a means of sensitization by immersion in halogen receptors such as sodium nitrite, pyrogallol and hydroquinone has been known. Also, immersion in an aqueous silver nitrate solution, or sulfur sensitization at pAg 7.5 have been known. These have been described in publications such as the *Journal of Photographic Science*, Vol. 8, page 119 (1960), ibid. Vol. 28, page 163 (1980), or *Photographic Science and Engineering*, Vol. 5, page 216 (1961). However, as shown in the Examples herein, the sensitizing effects exhibited by these halogen receptors were poor in the photothermographic material as disclosed herein.

Doping a photosensitive silver halide with a heavy metal has been carried out on a variety of silver halides. For example, doping a transition metal belonging to Groups VI to X of the Periodic Table into the inside a silver halide grain is described in JP-A No. 2001-42471. It is preferable that a larger amount of the doping material is distributed on a surface of the grain or in the vicinity thereof rather than inside the grain, or is uniformly distributed within the grain so as to exhibit high sensitivity. As such silver halides, silver bromide, silver iodobromide and silver chloroiodobromide are used with a silver iodide content ranging from 0.01 mol % to 10 mol %, and preferably from 0.1 mol % to 5 mol %.

JP-A No. 2000-66325 discloses a method for doping a silver halide grain with an iridium-type dopant and a transition metal dopant other than iridium, localized in mutually different regions, to obtain high sensitivity. In particular, the effect of the method to enhance sensitivity at the time when irradiated with high intensity light is set forth. As the silver halides, similar to the above, silver bromide, silver iodobromide, silver chloroiodobromide and silver iodide are used with a silver iodide content ranging from 0.01 mol % to 10 mol %, and preferably from 0.1 mol % to 5 mol %. It is also described therein that such a doping method is applicable to a multi-color photosensitive material having two or more silver halide emulsion layers, however, there is no mention that this method is applicable to a photothermographic material.

As described above, for use in the silver halide emulsions having a silver iodide content of 10 mol % or less, preferable heavy metals and preferable methods for adding such metals are conventionally known, however, for use in the silver halide emulsions having a high silver iodide content of 40 mol % or more, no metals or methods are known whatsoever. The silver halide emulsion having such a high silver iodide content exhibits characteristics that differ completely from those of the silver halide emulsion having a silver iodide content of 10 mol % or less. When doping of a heavy metal ion is carried out, known technologies pertaining to the silver halide emulsion having a silver halide content of 10 mol % or less cannot be applied, and therefore, development of a new technology has become necessary.

Conventionally, silver halides having a high silver iodide content were not put into practical use, for the reasons detailed above. Accordingly, there has been no interest or motivation in doping of heavy metals, not to mention any interest in applying such doping to photothermographic materials.

SUMMARY OF THE INVENTION

The present invention was accomplished to solve the aforementioned conventional problems and to achieve the following objects.

A first object of the present invention is to provide a photothermographic material that exhibits high sensitivity, low Dmin and high Dmax, and is excellent in lightfastness of images after processing.

A second object of the invention is to provide a photothermographic material having a high silver iodide content that exhibits high sensitivity and low fog, and further is excellent in lightfastness of images after processing.

The above-described problems can be solved by the means described below.

A first aspect of the invention is a photothermographic material which comprises a support having disposed on one surface thereof at least one image-forming layer containing a binder, an organic silver salt, a reducing agent for reducing silver ions, an organic polyhalogen compound and a photosensitive silver halide, wherein the photosensitive silver halide has a silver iodide content ranging from 10 mol % to 100 mol %, and said material is irradiated with a laser beam and further comprises at least one compound represented by the following general formula (1):

General Formula (1)

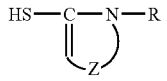

wherein Z represents a group of atoms to form a 5- or 6-membered heteroaromatic ring containing at least two nitrogen atoms; and R represents a hydrogen atom, an alkyl group, an aralkyl group, an alkoxy group or an aryl group.

A second aspect of the invention is a photothermographic material which comprises a support including on one surface thereof at least a photosensitive silver halide, a non-photosensitive organic silver salt, a reducing agent for reducing silver ions and a binder, wherein the photosensitive silver halide 1) has a silver iodide content ranging from 10 mol % to 100 mol % and 2) contains at least one metal selected from a first metal group consisting of iridium, ruthenium, iron, osmium and copper; and at least one metal selected from a second metal group consisting of ruthenium, iron, osmium, rhenium, gold, platinum, copper, indium, gallium, lead, thallium, chromium, palladium, nickel and zinc, with a proviso that none of the at least one metal selected from the first metal group and the at least one metal selected from the second metal group are the same.

DETAILED DESCRIPTION OF THE INVENTION

The present invention will now be described in more detail hereinafter.

1. Photothermographic Material

A photothermographic material according to the invention comprises a support having disposed on at least one surface thereof an image-forming layer containing a photosensitive silver halide, a non-photosensitive organic silver salt, a reducing agent and a binder. Further, the photothremographic material according to the invention may preferably have a surface protective layer on the image-forming layer, or a back layer or a back protective layer on an opposite surface thereof.

The layer construction and the components contained therein will be described in detail below.

1-1. Image-forming Layer

1-1-1. Photosensitive Silver Halide

1) Halogen Composition

It is essential in the invention that a photosensitive silver halide has a silver iodide content of from 10 mol % to 100 mol %. The remaining silver halides are not particularly limited and may be selected from the group consisting of: silver chloride, silver bromide, and organic silver salts such as silver thiocyanate and silver phosphate, with silver bromide or silver chloride being particularly preferable.

Further, the silver iodide content is preferably in the range of from 40 mol % to 100 mol %, more preferably in the range of from 80 mol % to 100 mol %, and particularly preferably in the range of from 85 mol % to 100 mol % or 90 mol % to 100 mol %. If the silver halide having such a high silver iodide content is used, a desirable photothermographic material may be devised in which lightfastness of images after subjected to a developing treatment is enhanced, in particular fogging due to irradiation with light is remarkably suppressed.

Regarding the halogen composition in individual grains, the halogen may be uniformly distributed throughout the grain, or may be stepwise distributed, or may be continuously distributed. Further, a silver halide grain having a core/shell structure may preferably be used. The structure has preferably 2 to 5 layers, and more preferably 2 to 4 layers. Still further, a silver iodide high-core structure in which a silver iodide content in a core portion is high, as well as a silver iodide high-shell structure in which a silver iodide content in a shell portion is high may preferably be used. Furthermore, a technique to localize silver chloride or silver bromide on the surface of the grains in an epitaxial manner may be preferably employed.

2) Grain Size

As far as the silver halide of high silver iodide content according to the invention is concerned, a grain size is particularly important. When a size of the silver halide is large, a coating amount of the silver halide to achieve a required maximum density is increased. The present inventors have found that, when a large amount of the silver halide having a high silver iodide content is coated, development is seriously suppressed to thereby decrease sensitivity and also density stability against a development period becomes deteriorated, as a result, a grain size larger than a certain magnitude cannot achieve a maximum density in a predetermined development period of time. On the other hand, the inventors have found that, if the addition amount is restricted, sufficient development can be obtained even using such a silver iodide.

Thus, if the silver halide having a high silver iodide content is used, it is necessary to specify the size of a silver halide grain to be substantially smaller as compared with that of the conventional silver bromide or silver iodobromide having a low iodide content, for the purpose of achieving a sufficient maximum optical density. A grain size of the silver halide is preferably in the range of from 5 nm to 100 nm, more preferably in the range of from 5 nm to 55 nm, and particularly preferably in the range of from 10 nm to 45 nm. The term "grain size" as used herein is intended to include an average diameter obtained by converting a projected area observed by an electron microscope into a circular image having a corresponding area.

3) Coating Amount

A coating amount of the silver halide grain to be applied is, per mol of silver in a non-photosensitive organic silver salt to be described below, in the range of from 0.5 mol % to 15 mol %, preferably in the range of from 0.5 mol % to 12 mol %, more preferably in the range below 10 mol %, even more preferably in the range of from 1 mol % to 9 mol %, and particularly preferably in the range of from 1 mol % to 7 mol %. The addition amount is important and should be suitably selected in order to sufficiently inhibit suppressed development caused by the silver halide having a high silver iodide content.

4) Grain-Forming Method

A method for forming a photosensitive silver halide is well known in the art; for example, methods as described in Research Disclosure No. 17029 (June, 1978) and U.S. Pat. No. 3,700,458 may be employed. Specifically, a method in which firstly a photosensitive silver halide is prepared by adding a silver-supplying compound and a halogen-supplying compound to gelatin or another polymer solution and thereafter the thus prepared photosensitive silver halide is combined with an organic silver salt is preferably employed. Further, a method as described in paragraphs [0217] to [0224] of JP-A No. 11-119374, a method as described in JP-A No. 11-352627, or a method as described in Japanese Patent Application No. 2000-42336 is preferably used.

5) Grain Shape

Silver halide grains may have various shapes including, for example, cubic grains, octahedral grains, tetradecahedral grains, dodecahedral grains, tabular grains, spherical grains, rod-like grains, and potato-like grains. Examples of preferred shapes include a conjugated grain as described in R. L. Jenkins et al., the Journal of Photographic Science, Vol. 28 (1980) P. 164—FIG. 1. Further, a grain in a tabular form as shown in FIG. 1, ibid., can preferably be used. Cubic silver halide grains are especially preferred for use in the present invention. Also preferred are roundish silver halide grains with their corners rounded. The surface index (Miller index) of the outer surface of the photosensitive silver halide grains for use in the present invention is not specifically limited, but it is preferred that the proportion of {100} plane, which ensures higher spectral sensitization when it has adsorbed a color-sensitizing dye, in the outer surface is large. Preferably, the proportion of {100} plane is at least 50%, more preferably at least 65%, and even more preferably at least 80%. The Miller index expressed by the proportion of {100} plane can be obtained according to the method described in *J. Imaging Sci.*, written by T. Tani, 29, 165 (1985), based on the adsorption dependency of {111} plane and {100} plane for sensitizing dyes.

6) Heavy Metal (6-1) Firstly, heavy metals to be used in the photothermographic material according to the first aspect of the invention will be described.

The photosensitive silver halide grains for use in the present invention may contain a metal or metal complex of Groups VIII to X of the Periodic Table (including Groups I to XVIII). As the metal or the central metal of metal complex of Groups VIII to X, preferably used is rhodium, ruthenium or iridium. In the present invention, one metal complex may be used alone, or two or more metal complexes of the same species or different species of metals may be used in combination. The metal or metal complex content of the grains preferably falls between $1\times10^{-9}$ mols and $1\times10^{-3}$ mols per mol of silver. Such heavy metals and metal complexes, and methods of adding them to silver halide grains are described in, for example, JP-A No. 7-225449, JP-A No. 11-65021, paragraphs [0018] to [0024], and JP-A No. 11-119374, paragraphs [0227] to [0240].

In the photothermographic material according to the first aspect of the invention, silver halide grains having a hexacyano-metal complex in their outermost surface are preferably used. The hexacyano-metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6{}^{3-}$, and $[Ru(CN)_6]^{3-}$. The hexacyano-Fe complexes are preferably used in the present invention.

As hexacyano-metal complexes exist in the form of ions in their aqueous solutions, their counter cations are of no importance. However, it is preferable to use as the counter cation any of alkali metal ions such as sodium ion, potassium ion, rubidium ion, cesium ion and lithium ion; ammonium ion, and alkylammonium ion (e.g., tetramethylammonium ion, tetraethylammonium ion, tetrapropylammonium ion and tetra(n-butyl)ammonium ion) due to good water miscibility and easy handling of silver halide emulsion sedimentation.

The hexacyano-metal complex may be added in the form of a solution thereof in water or in a mixed solvent of water and an organic solvent miscible with water (for example, alcohols, ethers, glycols, ketones, esters, amides), or in the form of a mixture with gelatin.

The amount of the hexacyano-metal complex to be added preferably falls between $1\times10^{-5}$ mols and $1\times10^{-2}$ mols, per mol of silver, and more preferably between $1\times10^{-4}$ mols and $1\times10^{-3}$ mols.

In order to make the hexacyano-metal complex exist in the outermost surface of silver halide grains, addition of the complex is conducted in the charging step, i.e., after an aqueous silver nitrate solution to form silver halide grains has been added to a reaction system but before the grains having formed are subjected to chemical sensitization such as chalcogen sensitization with sulfur, selenium or tellurium or noble metal sensitization with gold or the like, or alternatively the complex is directly added to the grains in the step of rinsing, dispersing or prior to conducting chemical sensitization. In order to prevent the silver halide grains from excessively growing, it is desirable to add the hexacyano-metal complex to the grains immediately after they are formed, and preferably before the charging step is completed.

Addition of the hexacyano-metal complex to silver halide grains may be started after 96% by mass of the total of silver nitrate for forming the grains has been added to a reaction system, but is preferably started after 98% by mass of silver nitride has been added thereto, more preferably after 99% by mass thereof has been added thereto.

The hexacyano-metal complex, when added to silver halide grains after an aqueous solution of silver nitrate has been added to the reaction system but just before the grains are completely formed, can be adsorbed by the grains formed to exist on the outermost surface thereof. Most of the complex thus added can form hardly-soluble salts with the silver ions present on the surface of the grains. Since the silver salt of hexacyano-iron(II) is more hardly soluble than AgI, fine grains are prevented from re-dissolving. Consequently, fine silver halide grains having a small grain size can be produced.

The metal atoms (e.g., $[Fe(CN)_6]^{4-}$) that may be included to the silver halide grains for use in the present invention, as well as the methods of desalting or chemical sensitization of the silver halide emulsions are described, for example, in JP-A No. 11-84574, paragraphs [0046] to [0050], JP-A No. 11-65021, paragraphs [0025] to [0031], and JP-A No. 11-119374, paragraphs [0242] to [0250].

(6-2) Next, a heavy metal to be used in the photothermographic material according to the second aspect of the invention will be described below.

The photosensitive silver halide grain to be used in the photothermographic material according to the invention comprises at least a first doping metal and a second doping metal.

In the photothermographic material according to the second aspect of the invention, when the first doping metal and the second doping metal are simultaneously used, higher sensitivity is produced by a synergistic effect than they are each singly used. It is preferable that these metals are localized in different regions from each other inside the silver halide grain. For example, it is preferable that a larger portion of the first metal is present in a core of the grain, while a larger portion of the second metal is present in a shell thereof. Alternatively, it is also preferable that the first metal is localized in the shell portion, while the second metal is localized in the core portion. Or it may be possible to localize the first metal in the shell portion, while uniformly distributing the second metal within the entire grain. By localizing the metals in mutually different regions inside the grain, sensitizing effects exerted by the respective metals may synergistically be exhibited.

In order to dope the silver halide grain with at least one of these metals, a method in which when the silver halide grain is formed, a complex of such a heavy metal is mixed with a water-soluble halogen ion solution or an aqueous solution of silver nitrate such that the heavy metal is incorporated into a crystal is ordinarily employed. A method for localizing the metal inside the crystal is controlled by choosing the suitable point of mixing the metal at a stage of crystal growth of the silver halide grain. For example, when a larger amount of the metal is localized in the core portion than in other portions, the metal to be doped is added at an earlier stage of grain formation. On the other hand, when a larger amount of the metal is localized in the shell portion than in other portions, the metal is mixed at a later stage, or alternatively, a method in which after the grain formation is completed, the metal to be doped is first doped in other fine grains and then the resultant fine grains are mixed in the silver halide grains whereby a metal ion is transferred from such fine grains to the silver halide grains may also be employed.

In the photothermographic material according to the second aspect of the invention, the first metal and the second metal may preferably be selected from the group consisting of the following combinations:

(Ir—Fe), (Ir—Cu), (Ru—Cu), (Ru—Fe), (Fe—Os), (Fe—Ru), (Fe—Cu), (Fe—Pt), (Os—Cu), (Os—Fe), (Cu—Fe) and (Cu—Ru).

Further, in the photothermographic material according to the second aspect of the invention, the first metal and the second metal may be selected from the group consisting of the following combinations:

(Ir—Fe), (Ru—Fe), (Fe—Cu), (Fe—Pt), (Ru—Cu), (Os—Fe), (Cu—Fe) and (Cu—Ru).

Still further, in the photothermographic material according to the second aspect of the invention, it is preferable that the first metal is distributed in the core portion and the second metal is distributed in the shell portion.

6-2-1) First Metal Group

The first metal is selected from the group consisting of: iridium, ruthenium, iron, osmium and copper, with iridium and iron being preferable, and iridium and copper being particularly preferable.

It is preferable that the metal is used in the form of a complex in which the metal serves as a central metal.

For example, metal complexes whose center metal is iridium are trivalent or tetravalent iridium complexes. Examples of such iridium complexes include a hexachloroiridium (III) complex salt, a hexachloroiridium (IV) complex salt, a hexabromoiridium (III) complex salt, a hexabromoiridium (IV) complex salt, a hexaiodoiridium (III) complex salt, a hexaiodoiridium (IV) complex salt, an aquapentachloroiridium (III) complex salt, an aquapentachloroiridium (IV) complex salt, an aquapentabromoiridium (III) complex salt, an aquapentabromoiridium (IV) complex salt, an aquapentaiodoiridium (III) complex salt, an aquapentaiodoiridium (IV) complex salt, a diaquatetrachloroiridium (III) complex salt, a diaquatetrachloroiridium (IV) complex salt, a diaquatetrabromoiridium (III) complex salt, a diaquatetrabromoiridium (IV) complex salt, a diaquatetraiodoiridium (III) complex salt, a diaquatetraiodoiridium (IV) complex salt, a triaquatrichloroiridium (III) complex salt, a triaquatrichloroiridium (IV) complex salt, a triaquatribromoiritrium (III) complex salt, a triaquatribromoiritrium (IV) complex salt, a triaquatriiodoiritrium (III) complex salt, a triaquatriiodoiritrium (IV) complex salt, a hexammineiridium (III) complex salt, a hexammineiridium (IV) complex salt, a hexachlororuthenium (II) complex salt, a hexabromoruthenium (II) complex salt, a hexaiodoruthenium (II) complex salt, an aquapentachlororuthenium (II) complex salt, a nitrosyl pentachlororuthenium (II) complex salt, an aquapentabromoruthenium (II) complex salt, a nitrosyl pentabromoruthenium (II) complex salt, an aquapentaiodoruthenium (II) complex salt, a nitroxyl pentaiodoruternium (II) complex salt, a diaquatetrachlororuthenium (II) complex salt, a diaquatetrabromoruthenium (II) complex salt, a diaquatetraiodoruthenium (II) complex salt, a triaquatribromoruthenium (II) complex salt, a triaquatrichlororuthenium (II) complex salt, a hexammineruthenium (II) complex salt, a hexacyanoruthenium (II) complex salt, a hexachloroiron (II) complex salt, a hexabromoiron (II) complex salt, a hexaiodoiron (II) complex salt, an aquapentachloroiron (II) complex salt, an aquapentabromoiron (II) complex salt, an aquapentaiodoiron (II) complex salt, a diaquatetrachloroiron (II) complex salt, a diaquatetrabromoiron (II) complex salt, a diaquatetraiodoiron (II) complex salt, a triaquatribromoiron (II) complex salt, a triaquatrichloroiron (II) complex salt, a hexammineiron (II) complex salt, a hexacyanoiron (II) complex salt, a hexachloroosmium (II) complex salt, a hexabromoosmium (II) complex salt, a hexaiodoosmium (II) complex salt, an aquapentachloroosmium (II) complex salt, an aquapentabromoosmium (II) complex salt, an aquapentaiodoosmium (II) complex salt, a diaquatetrachloroosmium (II) complex salt, a diaquatetrabromoosmium (II) complex salt, a diaquatetraiodoosmium (II) complex salt, a triaquatribromoosmium (II) complex salt, a triaquatrichloroosmium (II) complex salt, a hexammineosmium (II) complex salt, a hexacyanoosmium (II) complex salt, copper (I) acetate, copper (II) acetate, copper (I) nitrate, copper (II) nitrate, a tetrachlorocopper (I) complex salt, a tetrachlorocopper (II) complex salt, a tetrabromocopper (I) complex salt, a tetrabromocopper (II) complex salt, a tetraiodocopper (I) complex salt, a tetraiodocopper (II) complex salt, a tetramminecopper (I) complex salt, a tetramminecopper (II) complex salt, a tetracyanocopper (I) complex salt, and a tetracyanocopper (II) complex salt.

In the photothermographic material according to the second aspect of the invention, an amount of the first metal to be added is, per mol of silver halide, preferably in the range of from $1\times10^{-8}$ mol to $1\times10^{-1}$ mol, and more preferably in the range of from $1\times10^{-6}$ mol to $1\times10^{-12}$ mol.

In the photothermographic material according to the second aspect of the invention, the first metal may be distributed in any portion within the entire silver halide grain. It may uniformly be distributed within the grain or may locally be distributed in the core portion, the center shell portion, on the surface of the grain, the vicinity thereof (shell), or the like. However, when it is localized, it is preferably localized in the core portion.

6-2-2) Second Metal Group

The second metal is selected from the group consisting of: ruthenium, iron, osmium, rhenium, gold, platinum, copper, indium, gallium, lead, thallium, chromium, palladium, nickel and zinc. Among these, ruthenium, iron, rhenium, gold, platinum and copper are preferable, and ruthenium and iron are particularly preferable.

It is preferable that the second metal is included in the form of a metal complex salt thereof in the same manner as for the first metal.

The second metal may uniformly be distributed within the entire silver halide grain or may locally be present in the core portion, a center shell portion, on the surface of the grain, in the vicinity thereof, or the like. When the metal is localized, it is preferably localized on the surface of the grain or the vicinity thereof (shell).

An amount of the second metal to be doped is, per mol of silver halide, preferably in the range of from $1\times10^{-8}$ mol to $1\times10^{1}$ mol, more preferably in the range of from $1\times10^{-6}$ mol to $1\times10^{-2}$ mol, and still more preferably in the range of from $1\times10^{-5}$ mol to $5\times10^{-3}$ mol.

Examples of metal complexes to be used in the photothermographic material according to the second aspect of the invention are given below; however, these examples are illustrative and should not be interpreted as limiting the invention in any way.

$K_4[Fe(CN)_6]$
$K_3[Fe(CN)_6]$
$K_4[Ru(CN)_6]$
$K_4[Os(CN)_6]$
$K_3[Co(CN)_6]$
$K_3[Rh(CN)_6]$
$K_3[Cr(CN)_6]$
$K_3[Re(CN)_6]$
$K_2[Rh(H_2O)Cl_5]$
$K_3[RhCl_6]$
$K_3[RuCl_6]$
$K_3[ReCl_6]$
$K_3[RuBr_6]$
$K_3[OsC1_6]$
$K_3[CrCl_6]$
$K_3[RhBr_6]$
CuCl
$CuCl_2$
CuBr
$CuBr_2$
CuI
$CH_3CO_2Cu$
$(CH_3CO_2)_2Cu$
$(CH_3CO_2)_2Co$
$(CH_3CO_2)_2Fe$
$(CH_3CO_2)_2Rh$
$CoI_2$
$Co(OH)_2$
$K_2[Ru(H_2O)Cl_5]$
$K_2[Ru(NO)Cl_5]$
$K_2[Pd(CN)_4]$
$K_2[PdCl_4]$
$K_2[PdBr_4]$
$K_2[Pd(NO_2)_4]$
$K_2[Pd(SCN)_4]$
$K_2[Pt(CN)_4]$
$K_2[PtCl_4]$
$K_2[PtBr_4]$
$K_2[PtI_4]$
$K_2[Pt(NO_2)_4]$
$K_2[Pt(SCN)_4]$
$K_2[Pt(NO_2)_2(NH_3)_2]$
trans-$[PtCl_2(NH_3)_2]$
cis-$[PtCl_2(NH_3)_2]$
$K_2[Co(NCO)_4]$
$K_2[CoCl_4]$
$K_2[CoBr_4]$
$[CoCl_2(H_2O)_2]$
$K_2[Ni(CN)_4]$
$K_2[NiCl_4]$
$K_2[Ni(SCN)_4]$
$K[Au(CN)_4]$
$K[AuCl_4]$
$K[AuI_4]$
$K[Pt(CN)_3(py)]$: py represents pyridine.
$K[Pd(CN)_3(py)]$
$K[Pt(CN)_2(bpy)]$: bpy represents 2,2'-bipyridine.
$K[Pd(CN)_2(bpy)]$
$K[Pt(CN)_3(pyz)]$: pyz represents pyrazine.
$K[Pd(CN)_3(PYZ)]$
$[Pt(CN)(py)_3]Cl$
$[Pt(CN)(pyz)_3]Cl$
$[Pt(PYZ)_2Cl_2]$
$[Fe(py)_4Cl_2]$
$K_4[Pd(py)_2Cl_2]$
$[Co(PY)_2Cl_2]$
$[Ag(PY)_4Cl_2]$ $K[Pt(CN)_3(py)]$
$K[Zn(CN)_3(py)]$
$[Zn(CN)_2(bpy)]$
$[Zn(CN)_2Cl_2]$
$K[Zn(CN)_3(pyz)]$
$K_2[Zn(CN)_4]$
$K_2[ZnCl_4]$
$K_2[ZnI_4]$
$K_2[Cu(CN)_3(py)]$
$K[Cu(CN)_2(bpy)]$
$K_3[Cu(CN)_2Cl_2]$
$K_2[Cu(CN)_3(pyz)]$
$K_3[Cu(CN)_4]$
$K_3[CuCl_4]$
$K_3[CuI_4]$
$K[Au(CN)_2(bpy)]$
$K_3[Au(CN)_2Cl_2]$
$K_2[Au(CN)_3(pyz)]$
$K[PtCl_2(Im)_2]$: Im represents imidazole.
$[ZnCl_2(Im)_2]$
$K[PdCl(Im)_3]$
$K[PdCl_2(Im)_2]$
$K[CuCl_2(Im)_2]$
$K[AuCl_2(Im)_2]$
$K[CoCl_3(Im)]$
$[CoCl_2(Im)_2]$
$[CoCl(Im)_3]Cl$
$[Co(Im)_4]Cl_2$
$K[Co(CN)_3(Im)]$
$[Co(CN)_2(Im)_2]$
$[Co(CN)(Im)_3]Cl$
$[CoCl_2(bim)_2]$: bim represents benzimidazole.
$[CoCl(bim)_3]Cl$
$[Co(bim)_4]Cl_2$
$K[Pt(CN)_2(phen)]$: phen represents 1,10-phenanthroline.
$[Zn(CN)_2(phen)]$
$K[Cu(CN)_2(phen)]$
$K[Au(CN)_2(phen)]$
$K[Co(CN)_2(phen)]$ 6-3) Additional Metals In the photothermographic material according to the second aspect of the invention, the photosensitive silver halide grain may contain, as a third metal different from the above-listed metals, a metal salt or a metal complex as described in JP-A No. 7-225449, paragraphs [0018] to [0024] of JP-A No. 11-65021, and paragraphs [0227] to [0240] of JP-A No. 11-119374.

6-4) Quantitative Determination of Doped Metal and Analysis of Distribution thereof within Grain Quantitative determination of a doped metal and the distribution thereof within the photosensitive silver halide grain produced by the grain-forming method according to the invention may be confirmed through a method described in JP-A No. 2001-42471 and the like. Firstly, gelatin is separated by adding an aqueous actinase solution followed by centrifugal separation. Thereafter, a surface portion of the silver halide grain is gradually dissolved using an agent dissolving a silver halide such as an aqueous ammonia solution or an aqueous potassium cyanide solution, and then the concentration of the metal ion contained in the resultant supernatant is determined through a high frequency inductively coupled plasma mass spectrometry (ICP-MS), a high frequency inductively coupled plasma emission spectrometry (ICP-AES), or atomic absorption spectrometry.

7) Gelatin

Various types of gelatin may be used as gelatin to be contained in the photosensitive silver halide emulsion according to the invention. In order to maintain an excellent dispersion state of the photosensitive silver halide emulsion in a coating solution containing an organic silver salt, it is preferable to use a low molecular weight gelatin having a molecular weight in the range of from 500 to 60,000. These types of gelatin may be used at the time of forming grains or at the time of dispersing operation after a desalting treatment is performed; however, they are preferably used at the time of dispersing operation after the desalting treatment is performed.

8) Chemical Sensitization

The photosensitive silver halide to be used in the invention may not be subjected to chemical sensitization; however, the photosensitive silver halide to be used in the invention is preferably chemically sensitized by at least one method selected from the group consisting of: chalcogen sensitization, gold sensitization and reduction sensitization. Examples of chalcogen sensitization include sulfur sensitization, selenium sensitization and tellurium sensitization.

In the sulfur sensitization, an unstable sulfur compound is used and examples of the unstable sulfur compound include those as described, for example, in *Chimie et Physique Photographique,* 5th Ed., written by P. Grafkides, published by Paul Momtel (1987), and Research Disclosure, Vol. 307, No. 307105.

Specifically, at least one of conventionally known sulfur compounds such as thiosulfates (e.g., hypo), thioureas (e.g., diphenyl thiourea, triethyl thiourea, N-ethyl-N'-(4-methyl-2-thiazolyl) thiourea, and carboxymethyl trimethyl thiourea), thioamides (e.g., thioacetamide), rhodanines (e.g., diethyl rhodanine, 5-benzylidene-N-ethyl rhodanine), phosphine sulfides (e.g., trimethyl phosphine sulfides), thiohydantoins, 4-oxo-oxazolidine-2-thiones, disulfides or polysulfides (e.g., dimorpholine disulfide, cystine, and lenthionine), polythionates, elemental sulfur and the like, active gelatin and the like may be used. In particual, thiosulfates, thioureas and rhodanines are preferable.

In the selenium sensitization, an unstable selenium compound is used. Examples of the usable selenium compound include those as described, for example, in JP-B Nos. 43-13489, and 44-15748, JP-A Nos. 4-25832,4-109340, 4-271341, 5-40324, and 5-11385, Japanese Patent Application Nos. 4-202415, 4-330495, 4-333030, 5-4203, 5-4204, 5-106977, 5-236538, 5-241642, and 5-286916.

Specifically, any one member selected from the group consisting of: colloidal metal selenium, selenoureas (e.g., N,N-dimethyl selenourea, trifluoromethylcarbonyl-trimethyl selenourea, and acetyl-trimethyl selenourea), selenamides (e.g., selenamide, and N,N-diethylphenyl selenamide), phosphine selenides (e.g., triphenyl phosphine selenide, and pentafluorophenyl-triphenyl phosphine selenide), selenophosphates (e.g., tri-p-tolylselenophosphate, and tri-n-butylselenophosphate), selenoketones (e.g., selenobenzophenone), isoselenocyanates, selenocarboxylates, selenoesters, diacyl selenides and the like may be used. Further, at least one of non-unstable selenium compounds (e.g., selenious acid, selenocyanates, selenazoles and selenides) as described in JP-B No. 46-4553, 52-34492 and the like may be used, with phosphine selenides, selenoureas and selenocyanates being preferable.

In the tellurium sensitization, an unstable tellurium compound is used. Examples of usable selenium compounds include those as described, for example, in JP-A Nos. 4-224595, 4-271341, 4-333043, 5-303157, 6-27573, 6-175258, 6-180478, 6-208186, 6-208184, 6-317867, 7-140579, 7-301879, and 7-301880.

Specifically, any one member selected from the group consisting of: phosphine tellurides (e.g., butyl-diisopropyl phosphine telluride, tributyl phosphine telluride, tributoxy phosphine telluride, and ethoxy-diphenyl phosphine telluride), diacyl(di)tellurides (e.g., bis(diphenylcarbamoyl) ditelluride, bis(N-phenyl-N-methyl carbamoyl) ditelluride, bis(N-phenyl-N-methylcarbamoyl)telluride, bis(N-phenyl-N-benzylcarbamoyl)telluride, and bis(ethoxycarbonyl) telluride, telluroureas (e.g., N,N'-dimethylethylene tellurourea, and N,N'-diphenylethylene tellurourea), telluroamides, telluroeaters, and the like may be used. In particular, diacyl (di)tellurides and phosphine tellurides are preferable, and further, compounds as described in paragraph [0030] of JP-A No. 11-65021 and compounds represented by the general formulas (II), (III), and (IV) of JP-A No. 5-313284 are more preferable.

Particularly, in the chalcogen sensitization employed in the invention, the selenium sensitization and the tellurium sensitization are preferable, with tellurium sensitization being particularly preferable.

In the gold sensitization, at least one of gold sensitizers as described in *Chimie et Physique Photographique* written by P. Grafkides 5th Ed., published by Paul Momtel (1987), and Research Disclosure, Vol. 307, No. 307105 may be used. Specific examples of the gold sensitizer include chloroauric acid, potassium chloroaurate, potassium aurithiocyanate, gold sulfide and gold selenide, and gold compounds as described, for example, in U.S. Pat. Nos. 2,642,361, 5,049,484, 5,049,485, 5,169,751, and 5,252,455, and Belgian Patent No. 691857. Further, at least one of the salts of other noble metals than gold such as platinum, palladium and iridium as described in *Chimie et Physique Photographique* written by P. Grafkides 5th Ed., published by Paul Momtel (1987), and Research Disclosure, Vol. 307, No. 307105 may also be used.

The gold sensitization may be used either alone or in combination with the chalcogen sensitization. Specific examples thereof include gold-sulfur sensitization, gold-selenium sensitization, gold-tellurium sensitization, gold-sulfur-selenium sensitization, gold-sulfur-tellurium sensitization, gold-selenium-tellurium sensitization, and gold-sulfur-selenium-tellurium sensitization.

According to the invention, the chemical sensitization may be performed at any time insofar as it is performed in any time from after the grain is formed to before the coating is performed, that is, the point of performing the chemical sensitization may be any time after desalting, at least one of (1) before the spectral sensitization, (2) simultaneously with the spectral sensitization, (3) after the spectral sensitization, (4) immediately before the coating, and the like.

A use amount of the chalcogen sensitizer according to the invention is, varying depending on the silver halide grain to be used, chemical ripening conditions and the like, in the range of from $10^{-8}$ mol to $10^{-1}$ mol, and preferably in the range of approximately from $10^{-7}$ mol to $10^{-2}$ mol per mol of silver halide.

In the same manner as in the chalcogen sensitizer, a use amount of the gold sensitizer according to the invention is, varying depending on various types of conditions, approximately in the range of from $10^{-7}$ mol to $10^{-2}$ mol, and preferably in the range of from $10^{-6}$ mol to $5\times10^{-3}$ mol per mol of silver halide. As to the atmosphere in which the emulsion is chemically sensitized, any condition may be selected; however, pAg is 8 or less, preferably 7.0 or less, more preferably 6.5 or less, and particularly preferably 6.0 or less; pAg is 1.5 or more, preferably 2.0 or more, and particularly preferably 2.5 or more; pH is in the range of from 3 to 10, and preferably in the range of from 4 to 9; and the temperature is in the range of from 20° C. to 95° C., and preferably in the range of approximately from 25° C. to 80° C.

According to the present invention, reduction sensitization may be employed simultaneously with the chalcogen sensitization or the chemical sensitization. It is preferable that the reduction sensitization is employed simultaneously with the chalcogen sensitization.

Preferable examples of the compound usable in the reduction sensitization include ascorbic acid, thiourea dioxide, and dimethylamine borane, as well as stannous chloride, aminoiminomethane sulfmic acid, hydrazine derivatives, borane compounds, silane compounds, and polyamine compounds. Further, addition of a reduction sensitizer may be performed at any step in a manufacturing process of the photosensitive emulsion, that is, in a preparation process of from crystal growth to immediately before the coating. Still further, the reduction sensitization is preferably performed by ripening the emulsion while maintaining the pH thereof at 8 or more, or the pAg thereof at 4 or less. Furthermore, the reduction sensitization is preferably performed by introducing a single addition portion of a silver ion during the grain formation.

A preferable amount of the reduction sensitizer to be added is, varying depending on various types of conditions in the same manner as in the chalcogen sensitizer or gold sensitizer, approximately in the range of from $10^{-7}$ mol to $10^{-1}$ mol, more preferably in the range of from $10^{-6}$ mol to $5\times10^{-2}$ mol per mol of silver halide.

In the silver halide emulsion according to the invention, a thiosulfonic acid compound may be included through a method as described in EP-A No. 293,917.

It is preferable, from the standpoint of designing a high sensitive photothermographic material, that the silver halide grain according to the invention is chemically sensitized by at least one of the gold sensitization and the chalcogen sensitization.

9) Sensitizing Dye

As the sensitizing dye applicable to the invention, a sensitizing dye capable of spectrally sensitizing the silver halide grain in a desired wavelength region when adsorbed and having spectral sensitivity appropriate to spectral characteristics of an exposure light source may advantageously be selected for use. It is preferable that the photothermographic material according to the invention is spectrally sensitized such that it has a spectral sensitive peak, particularly in the range of from 600 nm to 900 nm, or in the range of from 300 nm to 500 nm. The sensitizing dyes and addition methods thereof are described in paragraphs [0103] to [0109] of JP-A No. 11-65021, as compounds represented by the general formula (II) in JP-A No. 10-186572, as dyes represented by the general formula (I) in JP-A No. 11-119374, in paragraph[0106] of JP-A No. 11-119374, U.S. Pat. No. 5,510,236, as dyes mentioned in Example 5 of U.S. Pat. No. 3,871,887, in JP-A No. 2-96131, as dyes disclosed in JP-A No. 59-48753, in pp. 19 (line 38) to 20 (line 35) of EP-A No. 0803764, Japanese Patent Application Nos. 2000-86865, 2000-102560, and 2000-205399, and the like. The sensitizing dye may be used alone or in combination of two or more species thereof.

An amount of the sensitizing dye according to the invention to be added is, desirably varying depending on sensitivity or fogging performance, preferably in the range of from $1\times10^{-6}$ mol to 1 mol, and more preferably in the range of from $1\times10^{-4}$ mol to $1\times10^{-1}$ mol, per mol of silver halide in a photosensitive layer.

According to the invention, in order to enhance spectral sensitizing efficiency, a super-sensitizer may be used. As to the super-sensitizers for use in the invention, mentioned are compounds described in, for example, EP-A No. 587,338, U.S. Pat. Nos. 3,877,943 and 4,873,184, JP-A Nos. 5-341432, 11-109547 and 10-111543.

The silver halide emulsion according to the invention may comprise an FED sensitizer (Fragmentable electron donating sensitizer) as the compound to generate two electrons by one photon. As the FED sensitizer, compounds as described in U.S. Pat. Nos. 5,747,235, 5,747,236, 6,054,260, and 5,994,051, and Japanese Patent Application No. 2001-86161 may preferably be used. As to the step in which the FED sensitizer is added, any step in a manufacturing process of the photosensitive emulsion, that is, in a preparation process from crystal growth to immediately before the coating may be employed. An amount thereof to be added is, varying depending on various types of conditions, preferably from $1\times10^{-7}$ mol to $1\times10^{-1}$ mol, and more preferably from $1\times10^{-7}$ mol to $1\times10^{-1}$ mol, per mol of silver halide.

10) Simultaneous Use of Silver Halides

In the photothermographic material according to the invention, a single type of photosensitive silver halide emulsion may be used, or two or more types of silver halide emulsions (e.g., those having different average grain sizes, different halogen compositions, different crystal habits or different chemically sensitizing conditions from one another) may simultaneously be used. Use of plural types of photosensitive silver halides having different levels of sensitivity from one another makes it possible to control gradation. Relevant technologies are described, for example, in JP-A Nos. 57-119341, 53-106125, 47-3929, 48-55730, 46-5187, 50-73627 and 57-150841. Sensitivity difference among individual emulsions is preferably specified to be 0.2logE or more.

11) Mixing of Silver Halide and Organic Silver Salt

It is preferable that the photosensitive silver halide grain according to the invention is formed at a position where a non-photosensitive organic silver salt is not present and then chemically sensitized. Such a procedure is employed because the method in which the silver halide is formed by adding a halogenating agent to the organic silver salt cannot attain sufficient sensitivity in some cases.

In order to mix the silver halide with the organic silver salt, employable are a method in which the photosensitive silver halide and the organic silver salt which have separately been prepared are mixed using a device selected from the group consisting of: a high-speed stirrer, a ball mill, a sand mill, a colloid mill, a vibration mill and a homogenizer, a method in which the photosensitive silver halide which has already been prepared is added at any desired point while the organic silver salt is being prepared to form a final organic silver salt, and the like. The advantageous effects of the invention may be suitably exerted by any of the above-described methods.

12) Mixing of Silver Halide to Coating Solution

A preferable point at which the silver halide according to the invention is added to a coating solution for an image-forming layer may be any time during a period of from 180 minutes before the coating is performed till immediately before the coating is performed, and preferably during a period of from 60 minutes before the coating is performed till 10 seconds before the coating is performed; however, adding methods and conditions are not particularly limited, insofar as the advantageous effects of the invention can sufficiently be exerted. Specific mixing methods include, for example, a method of mixing ingredients in a tank such that an average dwelling time, as calculated from an adding flow rate and a supplying flow rate to a coater, is specified within a predetermined duration, and a method of using a static mixer or the like as described, for example, in N. Harnby, M. F. Edwards & A. W. Nienow, (translated by Koji Takahashi), "*Liquid Mixing Technology*" Chap. 8, published by the Nikkan Kogyo Shimbun, Ltd. (1989).

1-1-2. Organic Silver Salt

The organic silver salt which may be used in the invention is relatively stable to light, however, when heated to 80° C. or more in the presence of an exposed photosensitive silver halide and a reducing agent, it functions as a silver-ion supplying material to form silver images. The organic silver salt may be any type of organic substances which may be reduced by a reducing agent to thereby supply silver ions. Such non-photosensitive organic silver salts are described, for example, in paragraphs [0048] and [0049] of JP-A No. 10-62899, pp. 18 (line 24) to 19 (line 37) of EP-A No. 0803764, EP-A No. 0962812, JP-A Nos. 11-349591, 2000-7683, and 2000-72711. Silver salts of organic acids, particularly, long-chain aliphatic carboxylic acids (each having from 10 to 30 carbon atoms, preferably from 15 to 28 carbon atoms) are preferable. Preferable examples of such silver salts of aliphatic acids include silver lignocerate, silver behenate, silver arachidate, silver stearate, silver oleate, silver laurate, silver caproate, silver myristate, silver palmitate, silver erucate and the mixture thereof.

According to the invention, it is preferable to use an aliphatic acid silver salt, among which preferred is the aliphatic acid silver salt whose silver behenate content is 50 mol % or more, preferably 85 mol %, and more preferably 95 mol % or more.

The shape of particles of an organic silver salt usable in the present invention is not particularly limited, and may be a needle, rod, plate or flake shape.

Preferably, a flaky organic silver salt is used in the present invention. Herein, flaky organic silver salts are defined as follows. If the salt is examined through an electron microscope and the shape of the particles is considered to be approximately a rectangular parallelepiped, its sides are named "a", "b" and "c" in an order beginning with the shortest dimension ("c" may be equal to "b"), and the values of the two shortest sides "a" and "b" are used to calculate "x" by the following equation:

$$x=b/a$$

The value "x" is calculated for about 200 particles and if their mean value, x (mean)≧1.5, the particles are defined as flaky. Preferably, 30≧x (mean)≧1.5, and more preferably 20≧x (mean)≧2.0. Incidentally, the particles are needle-shaped if 1≦x (mean)<1.5.

Side "a" of a flaky particle can be regarded as the thickness of a plate-shaped particle having a principal face defined by sides "b" and "c". The mean value of "a" is preferably from 0.01 to 0.23 μm, and more preferably from 0.1 to 0.20 μm. The mean value of c/b is preferably from 1 to 6, more preferably from 1.05 to 4, still more preferably from 1.1 to 3, and particularly preferably from 1.1 to 2.

The particle sizes of the organic silver salt preferably have a monodispersed size distribution. In the monodispersed distribution, the standard deviation of the length of the minor axis or major axis of the particles divided by a length value of the minor axis or major axis, respectively, is preferably not more than 100%, more preferably not more than 80%, and still more preferably not more than 50%. The shape of particles of the salt can be determined from an observed image of a dispersion thereof through a transmission electron microscope. The particle size distribution of the salt can alternatively be determined by employing the standard deviation of the volume weighted mean diameter of the particles, and is monodispersed if a percentage obtained by dividing the standard deviation of the volume weighted mean diameter by the volume weighted mean diameter (coefficient of variation) is not more than 100%, more preferably not more than 80%, and still more preferably not more than 50%. The particle size (volume weighted mean diameter) can be determined, for example, by applying laser light to the organic silver salt dispersed in a liquid and determining an autocorrelation function of the variation of fluctuation of scattered light with time.

Known methods can be employed to prepare and disperse an organic silver salt usable in the present invention. Reference may be made to, for example, Japanese Patent Application Laid-Open No. 10-62899, European Patent Laid-Open No. 0803763A1 and European Patent Laid-Open No.962812A1, JP-A Nos. 11-349591, 2000-7683, and 2000-72711, Japanese Patent Application Nos. 11-348228 to 11-348230, 11-203413, 2000-90093, 2000-195621, 2000-191226, 2000-213813, 2000-214155, and 2000-191226.

If the organic silver salt is dispersed, it is preferable that substantially no photosensitive silver salt is present, since fogging increases and sensitivity is greatly lowered when dispersing operation is conducted. According to the present invention, an aqueous dispersion contains not more than 0.1 mol % of a photosensitive silver salt per mol % of the organic silver salt, and more preferably photosensitive silver salt should not be added thereto.

According to the present invention, the photosensitive material can be prepared by mixing an aqueous dispersion of an organic silver salt with an aqueous dispersion of a photosensitive silver salt in a ratio depending on the purpose for which it will be used, preferably employing 1 to 30 mol %, more preferably 2 to 20 mol %, and still more preferably 3 to 15 mol % of the photosensitive silver salt relative to the organic silver salt. It is preferable, for obtaining the material having controlled photographic properties, to mix two or more kinds of aqueous dispersions of organic silver salts with two or more kinds of aqueous dispersions of photosensitive silver salts.

According to the present invention, the organic silver salt may be used in any amount as desired, but preferably in an amount containing 0.1 to 5 g/m$^2$, and more preferably 0.1 to 3.0 g/m$^2$ in terms of silver, and still more preferably in the range of from 0.5 g/m$^2$ to 2.0 g/m$^2$. Particularly, in order to enhance the image storability, the entire coating amount of silver is preferably 1.8 g/m$^2$ or less, and more preferably 1.6 g/m$^2$. When a preferable reducing agent according to the invention is used, a sufficient image density can be obtained in such a low level of silver amount.

1-1-3. Compound Represented by General Formula (1)

The photothermographic material according to the first aspect of the invention comprises a compound represented by the following general formula (1):

General Formula (1)

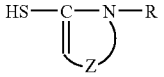

In the general formula (1), Z represents an atomic group to form a 5- or 6-membered heteroaromatic ring containing at least two nitrogen atoms. Z is preferably the atomic group to form the 5- or 6-membered heteroaromatic ring containing at least two nitrogen atoms and further at least one atom selected from the group consisting of: carbon, oxygen, sulfur, selenium and tellurium. Moreover, Z may have substituents. The substituents may be connected to each other to form a cyclic structure which, in turn, may form a condensed ring with a cyclic structure which Z forms. Examples of the heteroaromatic ring include imidazole, pyrazole, triazole, tetrazole, thiadiazole, thiadiazine, pyridazine, pyrimidine, pyrazine and triazine.

In the general formula (1), R represents at least one member selected from the group consisting of: a hydrogen atom; an alkyl group (e.g., a methyl group, an ethyl group, a propyl group, or a cyclohexyl group); an aralkyl group (e.g., a benzyl group); an alkoxy group (e.g., a methoxy group, or an ethoxy group); an aryl group (e.g., a phenyl group, or a naphthyl group); an alkyl group which is substituted by a substituent (such as an amino group, an amide group, a sulfonamide group (e.g., a methyl sulfonamide group), an ureido group, an urethane group (e.g., a methyl urethane group, or an ethyl urethane group), an aryloxy group (e.g., a phenoxy group, or a naphthoxy group), a sufamoyl group, a carbamoyl group (e.g., an ethyl carbamoyl group, or a phenyl carbamoyl group), an aryl group (e.g., a phenyl group, or a naphthyl group), an alkylthio group (e.g., a methylthio group, or a hexylthio group), an arylthio group (e.g., a phenylthio group), a hydroxyl group, a halogen atom (e.g., fluorine, chlorine, bromine, or iodine), a sulfonic acid group, a carboxylic acid group, a cyano group, a carboxyl group or the salt thereof, and a phosphoric acid amide group); and an aryl group which is substituted by a substituent (such as an amino group, an amide group, a sulfonamide group, an ureido group, an urethane group, an aryloxy group, a sufamoyl group, a carbamoyl group, an aryl group, an alkylthio group, an arylthio group, a hydroxyl group, a halogen atom, a sulfonic acid group, a carboxylic acid group, a cyano group, a carboxyl group or the salt thereof, and a phosphoric acid amide group). These groups may further have a substitutent; examples of such substituents include substituents as described above for R. R preferably has a total number of carbons of from 0 to 20.

Specific examples of the compound represented by the general formula (1) are given below to illustrate the invention, but should not be interpreted as limiting it in any way.

2-1

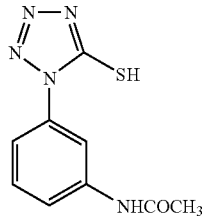

2-2

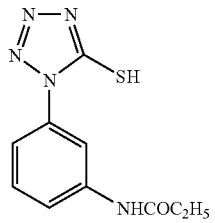

-continued
2-3
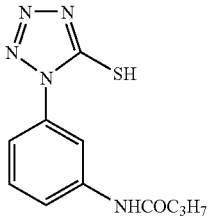
2-4
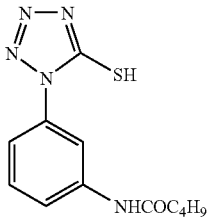
2-5
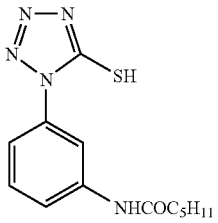
2-6
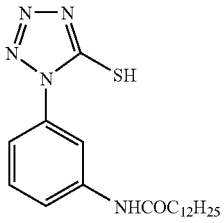
2-7
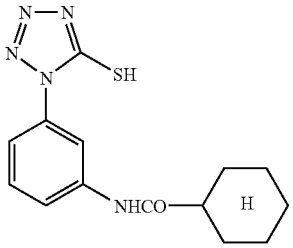
2-8
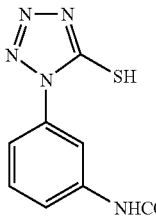
-continued
2-9
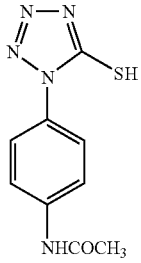
2-10
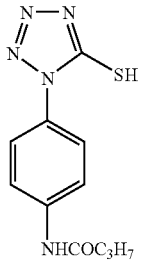
2-11
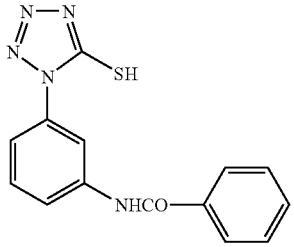
2-12
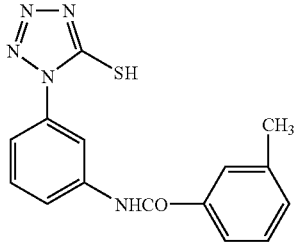
2-13
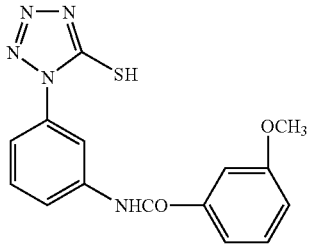
2-14
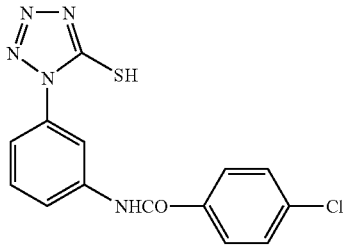

-continued
2-15
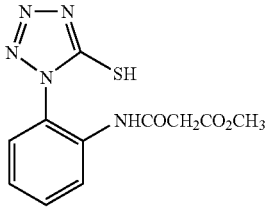
2-16
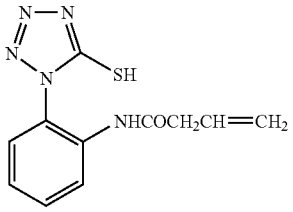
2-17
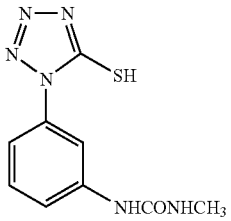
2-18
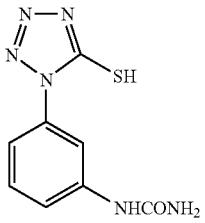
2-19
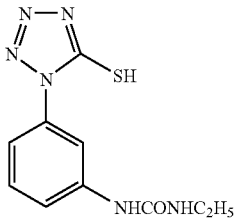
2-20
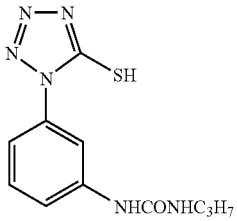
2-21
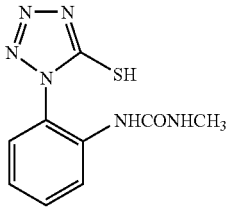
-continued
2-22
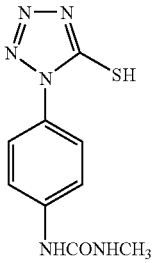
2-23
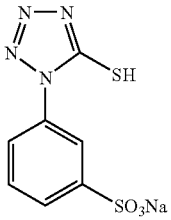
2-24
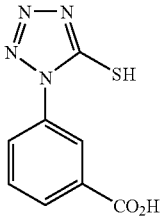
2-25
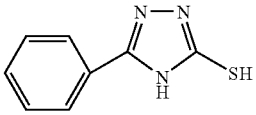
2-26
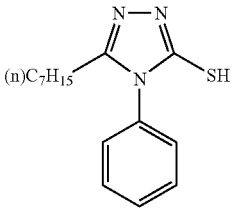
2-27
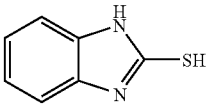
2-28
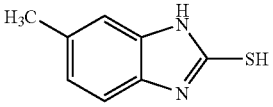
2-29
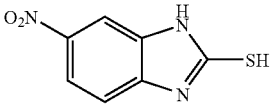
2-30
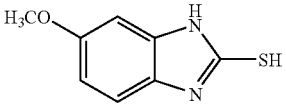

-continued
2-31
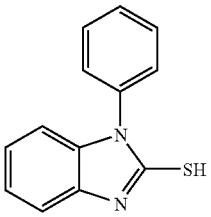
2-32
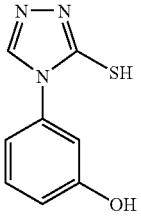
2-33
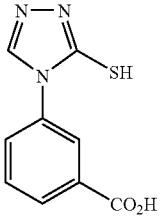
2-34
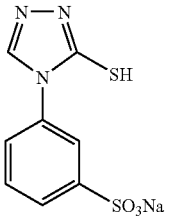
2-35
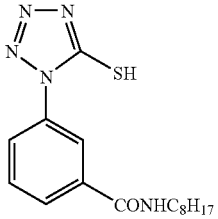
2-36
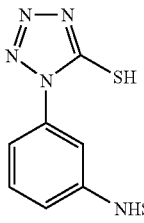
2-37
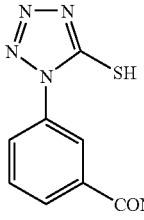
-continued
2-38
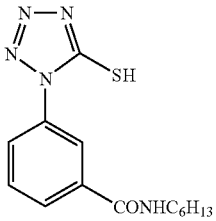
2-39
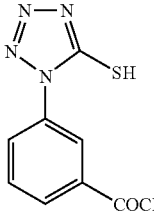
2-40
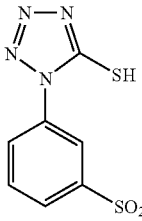
2-41
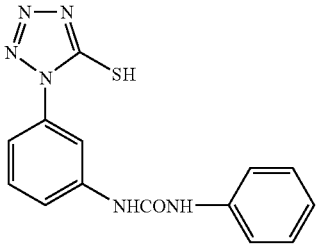
2-42
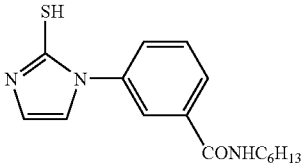
2-43
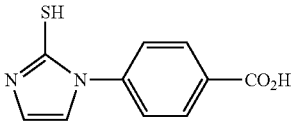
2-44
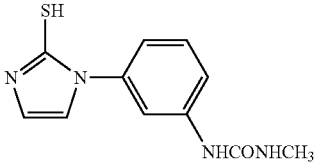
2-45
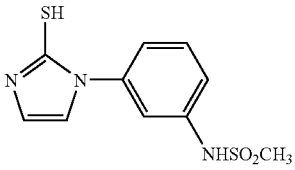

-continued
2-46
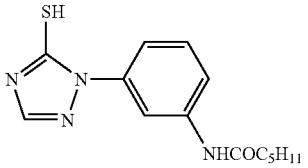
2-47
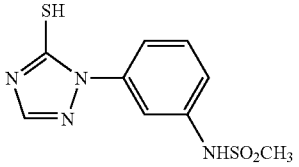
2-48
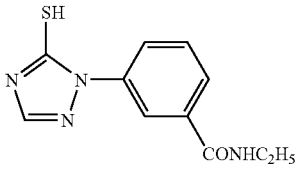
2-49
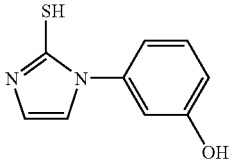
2-50
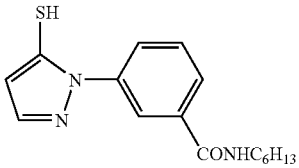
2-51
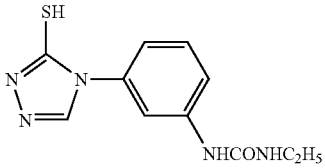
2-52
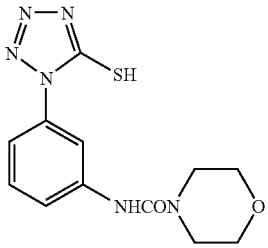
2-53
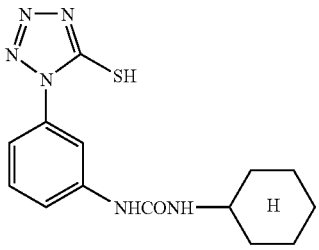
-continued
2-54
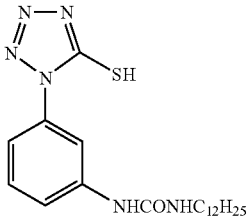
2-55
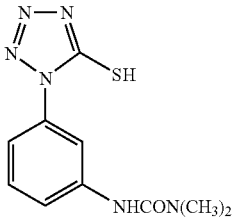
2-56
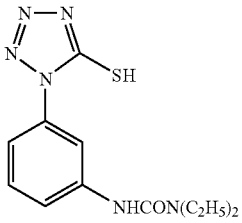
2-57
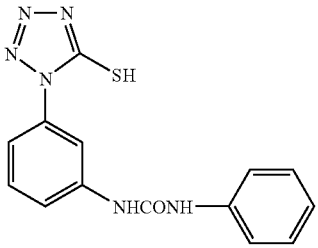
2-58
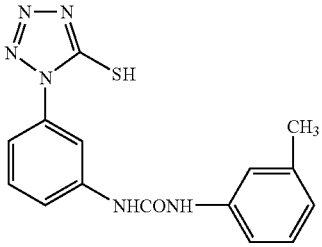
2-59
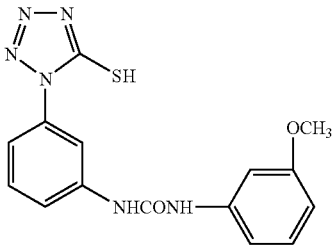

-continued 2-60

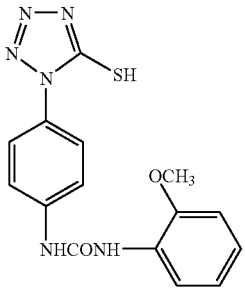

2-61

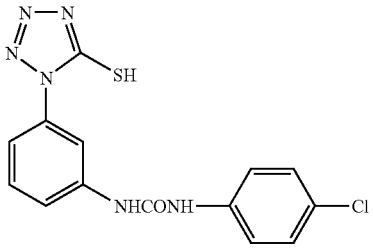

2-62

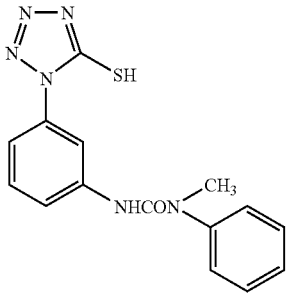

2-63

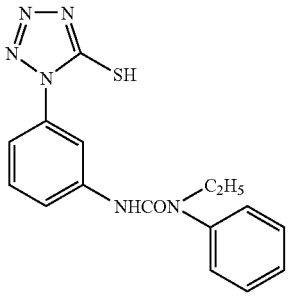

2-64

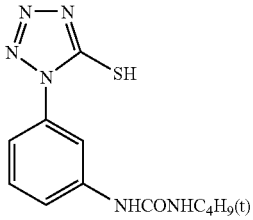

-continued 2-65

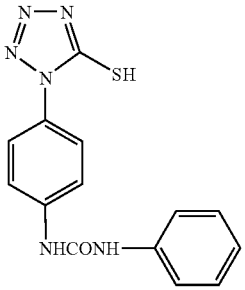

2-66

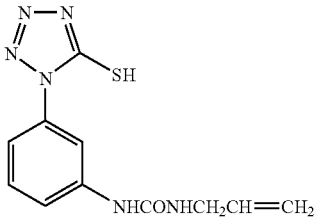

2-67

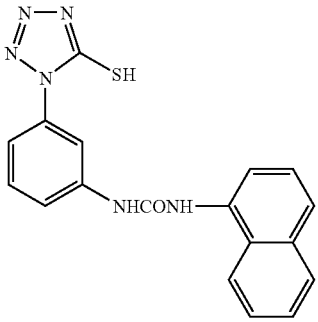

Any one of the compounds represented by the general formula (1) may be used by being dissolved in water, or an appropriate solvent such as any one of alcohols (e.g., methanol, ethanol, propanaol and fluorinated alcohol), any one of ketones (e.g., acetone and methyl ethyl ketone), dimethyl formamide, dimethyl sufoxide and methyl Cellosolve.

Further, the compound represented by the general formula (1) may be dissolved using an oil such as dibutyl phthalate, tricresyl phosphate, glyceryl triacetate and diethyl phthalate, or an auxiliary solvent such as ethyl acetate and cyclohexanone by a well known emulsify-dispersing method, and thereafter the resultant solution is subjected to a mechanical treatment to prepare an emulsion for use. Still further, any one of the compound represented by the general formula (1) in the form of a powder is dispersed in water using a device selected from the group consisting of: a ball mill, a colloid mill and an ultrasonic wave and then the resultant dispersion may be used.

The compound represented by the general formula (1) may be contained in any layer disposed on a support, so long as the layer contains silver halide, that is, in a so-called image-forming layer or in the layer adjacent to the image-forming layer.

Furthermore, an amount of the compound represented by the general formula (1) to be added is, per mol of silver halide, preferably in the range of from $1\times10^{-4}$ mol to $5\times10^{-1}$ mol, and more preferably in the range of from $5\times10^{-4}$ mol to $5\times10^{-2}$ mol.

1-1-4. Reducing Agent

It is preferable that the photothermographic material according to the invention comprises a thermally developing agent which is a reducing agent for the organic silver salt. The reducing agent for the organic silver salt may be any substance (preferably an organic substance), so long as it can reduce a silver ion to metallic silver. Examples of such reducing agents include those as described in paragraphs [0043] to [0045] of JP-A No. 11-65021, and in pp. 7 (line 34) to 18 (line 12) of EP-A No. 0803764.

Preferable reducing agents for use in the invention are so-called hindered phenol-type reducing agents having a substituent at an ortho position of a phenolic hydroxyl group, or bisphenol-type reducing agents. Particualrly preferable are the compounds represented by the general formula (R) shown below. These compounds will now be described in detail.

General Formula (R)

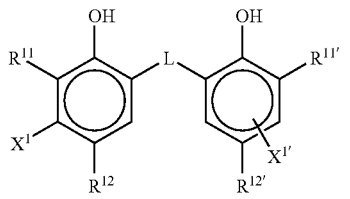

wherein $R^{11}$ and $R^{11'}$ each independently represent an alkyl group having from 1 to 20 carbon atoms; $R^{12}$ and $R^{12'}$ each independently represent a hydrogen atom or a substituent for the benzene ring; L represents a group of —S— or —$CHR^{13}$— in which $R^{13}$ represents a hydrogen atom or an alkyl group having from 1 to 20 carbon atoms; and $X^1$ and $X^{1'}$ each independently represent a hydrogen atom or a substituent for the benzene ring.

Now, each substituent will be described in detail.

1) $R^{11}$ and $R^{11'}$ $R^{11}$ and $R^{11'}$ each independently represent an optionally substituted alkyl group having from 1 to 20 carbon atoms and the substituent for the alkyl group is not particularly limited. Preferable examples of such substituents include an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom.

2) $R^{12}$ and $R^{12'}$, and $X^1$ and $X^{1'}$ $R^{12}$ and $R^{12'}$ each independently represent a hydrogen atom or a substituent for the benzene ring.

$X^1$ and $X^{1'}$ each independently represent a hydrogen atom or a substituent for the benzene ring.

Preferable examples of the substituent for the benzene ring include an alkyl group, an aryl group, a halogen atom, an alkoxy group and an acylamino group.

3) L

L represents a group —S— or a group —$CHR^{13}$—, wherein $R^{13}$ represents a hydrogen atom or an alkyl group having from 1 to 20 carbon atoms and the alkyl group may have a substituent.

Specific examples of the alkyl group as non-substituted $R^{13}$ include a methyl group, an ethyl group, a propyl group, a butyl group, a heptyl group, an undecyl group, an isopropyl group, a 1-ethylpentyl group and a 2,4,4-trimethylpentyl group.

Examples of substituents for the alkyl group, in the same manner as those for $R^{11}$, include a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group and a sulfamoyl group.

4) Preferable Substituents $R^{11}$ and $R^{11'}$ are preferably a secondary or tertiary alkyl group having from 3 to 15 carbon atoms. Specific examples of such alkyl groups include an isopropyl group, an isobutyl group, a t-butyl group, a t-amyl group, a t-octyl group, a cyclohexyl group, a cyclopentyl group, a 1-methylcyclohexyl group, and a 1-methylcyclopropyl group. $R^{11}$ and $R^{11'}$ are more preferably a tertiary alkyl group having from 4 to 12 carbon atoms, still more preferably a t-butyl group, a t-amyl group, and a 1-methylcyclohexyl group, and most preferably a t-butyl group.

Preferably, $R^{12}$ and $R^{12'}$ are each independently an alkyl group having from 1 to 20 carbon atoms. Specific examples of such alkyl groups include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, and a methoxyethyl group, and more preferably a methyl group, an ethyl group, a propyl group, an isopropyl group and a t-butyl group.

Preferably, $X^1$ and $X^{1'}$ are each independently a hydrogen atom, a halogen atom, and an alkyl group, and more preferably a hydrogen atom.

L is preferably a group —$CHR^{13}$—.

$R^{13}$ is preferably a hydrogen atom or an alkyl group having from 1 to 15 carbon atoms. Preferable examples of such alkyl groups include a methyl group, an ethyl group, a propyl group, an isopropyl group and 2,4,4-trimethypentyl group. Particularly preferable examples of the alkyl group as $R^{13}$ include a hydrogen atom, a methyl group, a propyl group and an isopropyl group.

When $R^{13}$ is a hydrogen atom, $R^{12}$ and $R^{12'}$ are each independently preferably an alkyl group having from 2 to 5 carbon atoms, with an ethyl group and a propyl group being more preferable and an ethyl group being most preferable.

When $R^{13}$ is a primary or secondary alkyl group having form 1 to 8 carbon atoms, $R^{12}$ and $R^{12'}$ are each independently preferably a methyl group. As the primary or secondary alkyl group having from 1 to 8 carbon atoms of $R^{13}$, a methyl group, an ethyl group, a propyl group and an isopropyl group are more preferable, with a methyl group, an ethyl group and a propyl group being still more preferable.

When $R^{11}$, $R^{11'}$, $R^{12}$, and $R^{12'}$ are each independently a methyl group, $R^{13}$ is preferably a secondary alkyl group. In this case, as the secondary alkyl group of $R^{13}$, an isopropyl group, an isobutyl group, and a 1-ethylpentyl group are preferable and an isopropyl group is more preferable.

The above-described reducing agents exert different thermal developing properties by the combination of $R^{11}$, $R^{11'}$, $R^{12}$, $R^{12'}$ and $R^{13}$ suitably selected. Since the thermal developing properties may be controlled by simultaneously using at least two types of reducing agents at various mixing ratios, it is preferable, depending on applications, to use at least two types of reducing agents in combination.

Specific examples of the compound represented by the general formula (R) usable in the invention are shown below; however, the invention is by no means limited thereto.

(R-1)
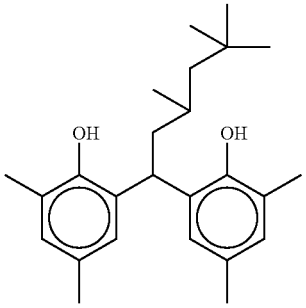
(R-2)
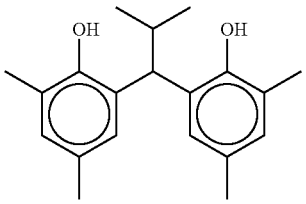
(R-3)
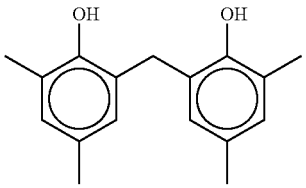
(R-4)
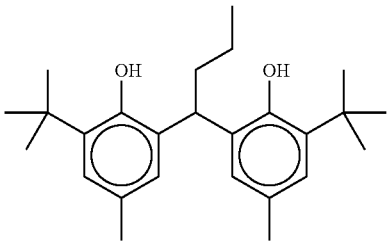
(R-5)
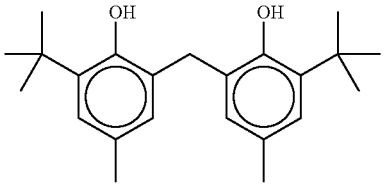
(R-6)
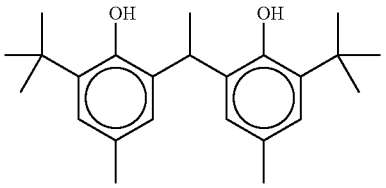
(R-7)
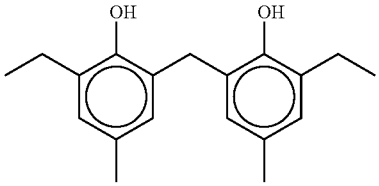
-continued
(R-8)
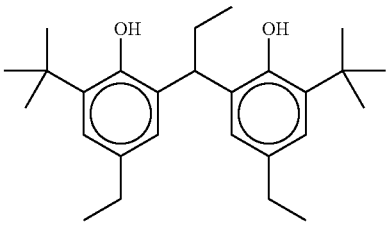
(R-9)
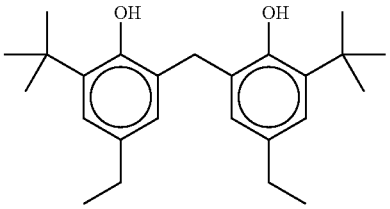
(R-10)
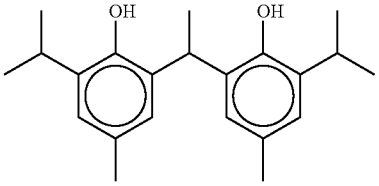
(R-11)
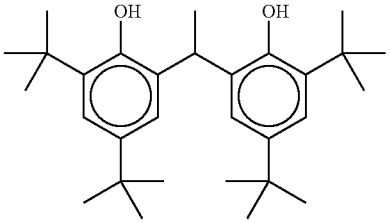
(R-12)
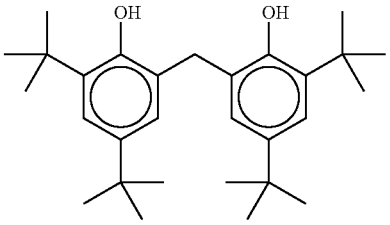
(R-13)
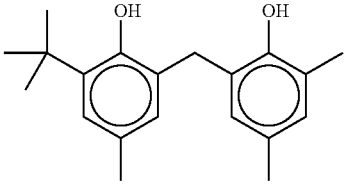
(R-14)
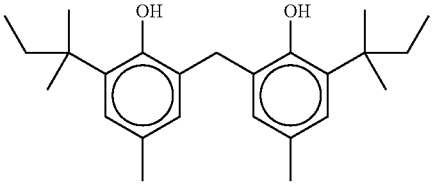

-continued
(R-15)
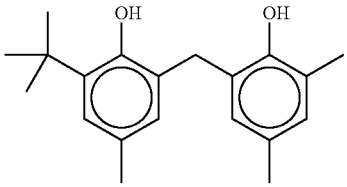
(R-16)
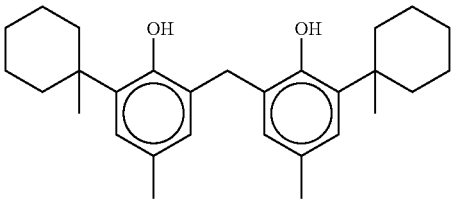
(R-17)
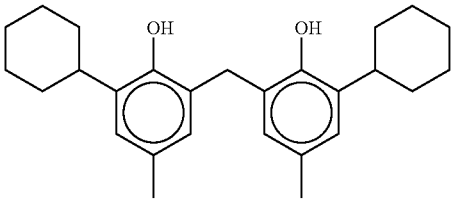
(R-18)
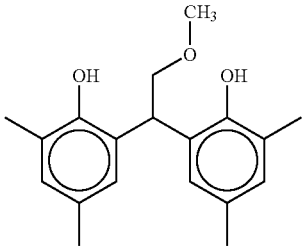
(R-19)
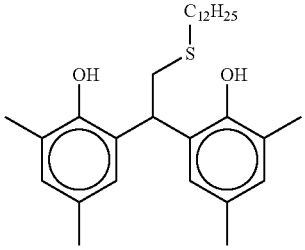
(R-20)
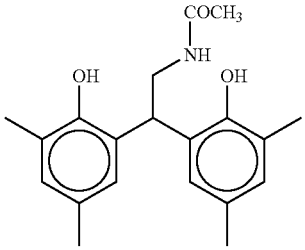
(R-21)
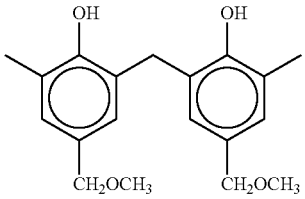
-continued
(R-22)
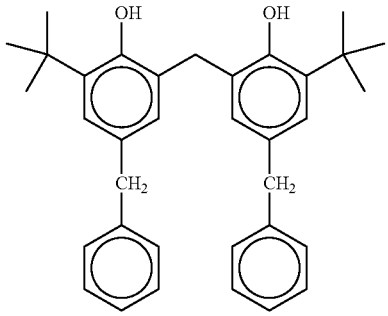
(R-23)
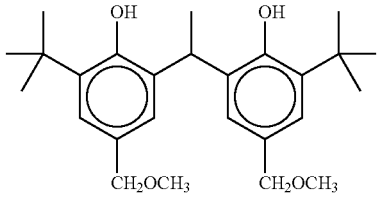
(R-24)
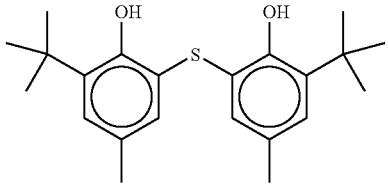
(R-25)
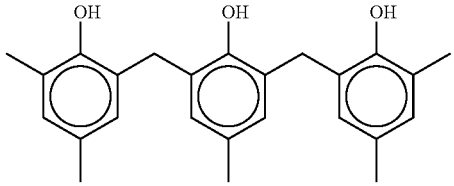
(R-26)
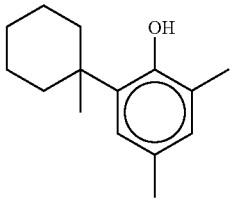
(R-27)
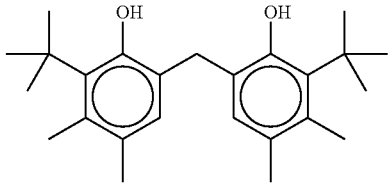
(R-28)
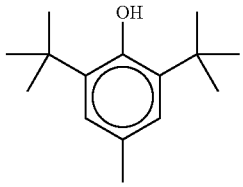

-continued (R-29)

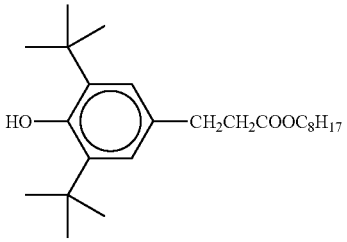

(R-30)

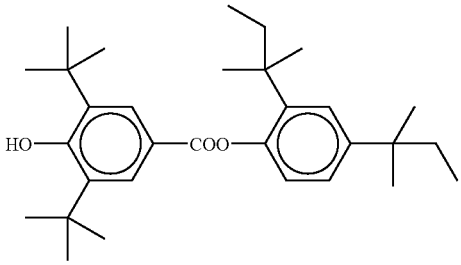

(R-31)

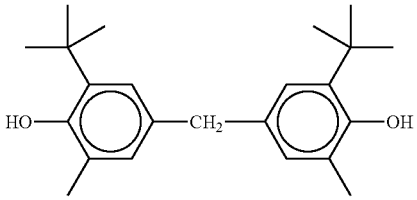

(R-32)

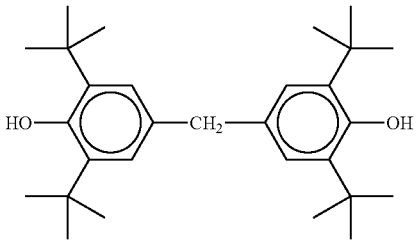

(R-33)

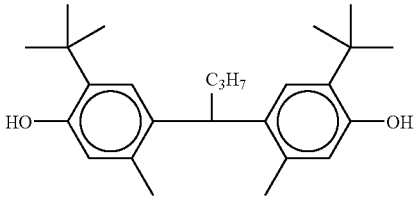

(R-34)

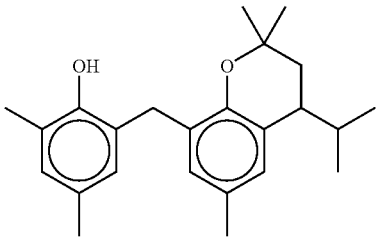

Among the above-shown reducing agents, the compounds of (R-1) to (R-20) are particularly preferable.

An amount of the reducing agent to be added in the invention is preferably in the range of from 0.01 $g/m^2$ to 5.0 $g/m^2$, more preferably in the range of from 0.1 $g/m^2$ to 3.0 $g/m^2$, per mol of silver on a surface provided with an image-forming layer, preferably in the range of from 5 mol % to 50 mol % and more preferably in the range of from 10 mol % to 40 mol %.

Although the reducing agent according to the invention may be included in the image-forming layer containing the organic silver salt and the photosensitive silver halide, and a layer adjacent thereto, it is more preferable to include the reducing agent in the image-forming layer.

In the invention, the reducing agent may be present in the coating solution in any form of a solution, an emulsified-dispersion, a solid fine particle dispersion and the like, and the resultant coating solution may be included in the photosensitive material.

As the conventionally known emulsify-dispersing method, a method in which the reducing agent is dissolved using an oil such as dibutyl phthalate, tricresyl phosphate, glyceryl triacetate and diethyl phthalate, or an auxiliary solvent such as ethyl acetate and cyclohexanone, and thereafter the resultant solution is subjected to mechanical treatment to prepare an emulsified dispersion.

Further, as solid fine particle dispersing methods, employable is a method in which the reducing agent is dispersed in an appropriate solvent such as water using a ball mill, a colloid mill, a vibration mill, a sand mill, a jet mill, a roller mill or an ultrasonic wave to prepare a solid dispersion. Preferably, the dispersing method is employed using the sand mill. Incidentally, any one of a protective colloid (e.g., polyvinyl alcohol), and a surfactant (e.g., an anionic surfactant such as sodium triisopropyl naphthalene sulfonate that is a mixture of different types of such sulfonates in which substitution positions of three isopropyl groups are different from one another) may be used. The aqueous dispersion may contain a preservative (e.g., sodium benzoisothiazolinate).

A particularly preferable method is the solid fine particle dispersing method. The reducing agent is added as fine particles having an average particle size in the range of from 0.01 μm to 10 μm, preferably in the range of from 0.05 μm to 5 μm, and more preferably in the range of from 0.1 μm to 1 μm. According to the invention, it is preferable that any other solid dispersion is used employing the above-described ranges of particle sizes.

1-1-5. Developing Accelerator

In the photothermographic material according to the invention, sulfonamide phenolic compounds represented by the general formula (A) as described in JP-A Nos. 2000-267222 and 2000-330234, hindered phenolic compounds represented by the general formula (II) as described in JP-A No. 2001-92075, hydrazine-type compounds represented by the general formula (1) as described in Japanese Patent Application No. 2001-074278, and phenolic or naphtholic compounds represented by the general formula (2) as described in Japanese Patent Application No. 2000-76240 are preferably used. These developing accelerators are used, relative to the reducing agent, in the range of from 0.1 mol % to 20 mol %, preferably in the range of from 0.5 mol % to 10 mol %, and more preferably in the range of from 1 mol % to 5 mol %. The method of introducing the developing accelerator to the photosensitive material may be performed in the same manner as in the reducing agent, and particularly it is preferably incorporated after being changed into a solid dispersion or an emulsified dispersion. When the developing accelerator is incorporated in the form of the emulsified dispersion, it is preferably incorporated in the form an emulsified dispersion prepared by dispersing operation using a high boiling solvent which is solid at room temperature and a low boiling auxiliary solvent, or in the form of a so-called oilless emulsified dispersion using no high boiling solvent.

Among the above-described developing accelerators according to the invention, the hydrazine-type compounds represented by the general formula (1) as described in Japanese Patent Application No. 2001-074278 and the phenolic or naphtholic compounds represented by the general formula (2) as described in Japanese Patent Application No. 2000-76240 are particularly preferable.

Specific examples of developing accelerators according to the invention are described below; however, the invention is by no means limited thereto.

(A-1)

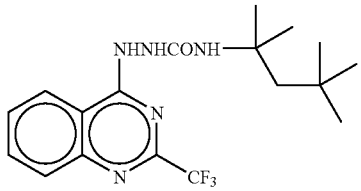

(A-2)

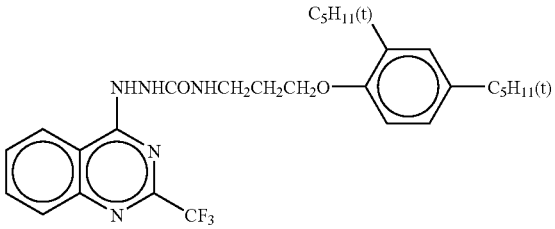

(A-3)

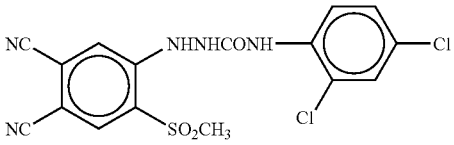

(A-4)

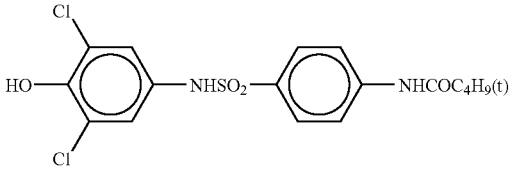

(A-5)

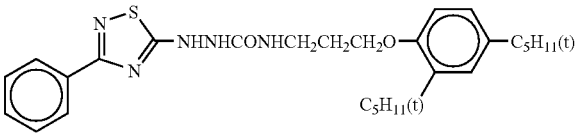

(A-6)

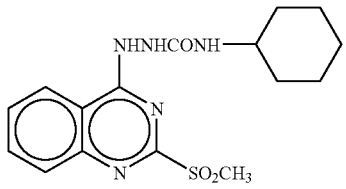

(A-7)

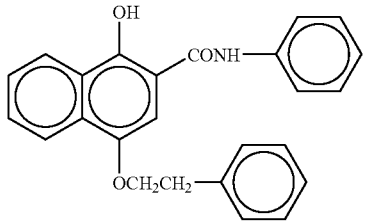

-continued (A-8)

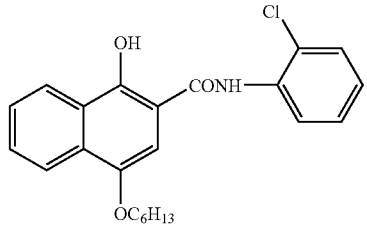

(A-9)

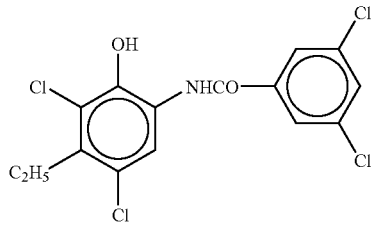

(A-10)

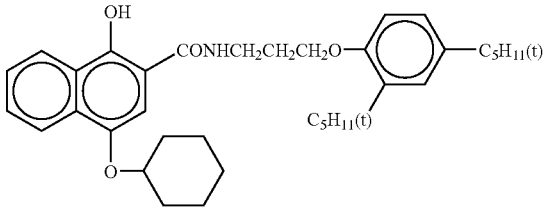

1-1-6. Hydrogen Bond-forming Compound

According to the invention, it is preferable that a non-reducing compound having a group capable of forming a hydrogen bond with a compound having an aliphatic hydroxyl group (—OH) of a reducing agent is simultaneously used.

Examples of such groups capable of forming a hydrogen bond include a phosphoryl group, a sulfoxide group, a sulfonyl group, a carbonyl group, an amide group, an ester group, an urethane group, an ureido group, a tertiary amino group, and a nitrogen-containing aromatic group. Among these, compounds having a phosphoryl group, a sulfoxide group, an amide group (not having >N—H group but blocked like >N—Ra, in which Ra represents a substituent exclusive of H), an urethane group (not having >N—H group but blocked like >N—Ra, in which Ra represents a substituent exclusive of H), an ureido group (not having >N—H group but blocked like >N—Ra, in which Ra represents a substituent exclusive of H) are preferable.

Particularly preferable hydrogen bond-forming compounds for use in the invention are compounds represented by the following general formula (D):

General Formula (D)

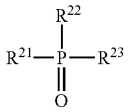

wherein $R^{21}$, $R^{22}$, and $R^{23}$ each independently represent at least one group selected from the group consisting of: an alkyl group, an aryl group, an alkoxy group, an aryloxy group, an amino group, and a heterocyclic group, which may be unsubstituted or substituted.

When any one of $R^{21}$, $R^{22}$, and $R^{23}$ has a substituent, examples of such substituents include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group and a phosphoryl group; on this occasion the substituent is preferably an alkyl group or an aryl group, and examples of such alkyl groups and aryl groups include a methyl group, an ethyl group, an isopropyl group, a t-butyl group, a t-octyl group, a phenyl group, a 4-alkoxyphenyl group and a 4-acyloxyphenyl group.

Specific examples of such alkyl groups of $R^{21}$, $R^{22}$, and $R^{23}$ include a methyl group, an ethyl group, a butyl group, an octyl group, a dodecyl group, an isopropyl group, a t-butyl group, a t-amyl group, a t-octyl group, a cyclohexyl group, 1-methylcyclohexyl group, a benzyl group, a phenethyl group and a 2-phenoxypropyl group.

Specific examples of such aryl groups include a phenyl group, a cresyl group, a xylyl group, a naphthyl group, a 4-t-butylphenyl group, a 4-t-octylphenyl group, a 4-anisidyl group and a 3,5-dichlorophenyl group.

Specific examples of such alkoxy groups include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group and a benzyloxy group.

Specific examples of such aryloxy groups include a phenoxy group, a cresyloxy group, an isopropylphenoxy group, a 4-t-butylphenoxy group, a naphthoxy group and a biphenyloxy group.

Specific examples of such amino groups include a dimethylamino group, a diethylamino group, a dibutylamino group, a dioctylamino group, an N-methyl-N-hexylamino group, a dicyclohexylamino group, a diphenylamino group and an N-methyl-N-phenylamino group.

As $R^{21}$, $R^{22}$ and $R^{23}$, an alkyl group, an aryl group, an alkoxy group, or aryloxy group is preferable. From the standpoint of the effects exerted by the invention, it is preferable that at least one of $R^{21}$, $R^{22}$ and $R^{23}$ is an alkyl group or an aryl group, and it is more preferable that at least two of $R^{21}$, $R^{22}$ and $R^{23}$ are an alkyl group or an aryl group. Further, taking availability at a low cost into consideration, it is preferable that $R^{21}$, $R^{22}$, and $R^{23}$ are the same groups.

Specific examples of hydrogen bond-forming compounds including the compound represented by the general formula (D) according to the invention are listed below; however, the invention is by no means limited thereto.

(D-1)

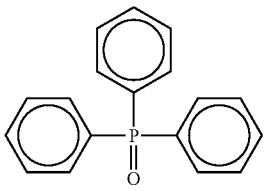

(D-2)

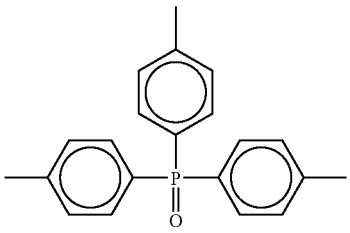

-continued (D-3)

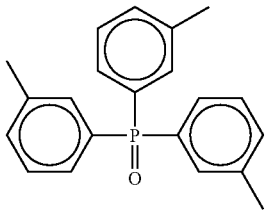

(D-4)

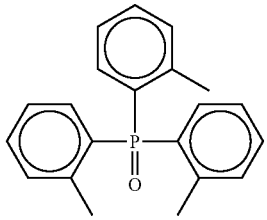

(D-5)

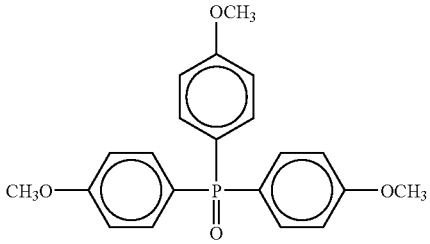

(D-6)

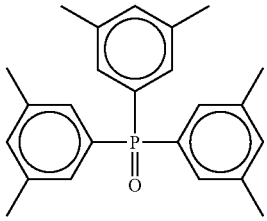

(D-7)

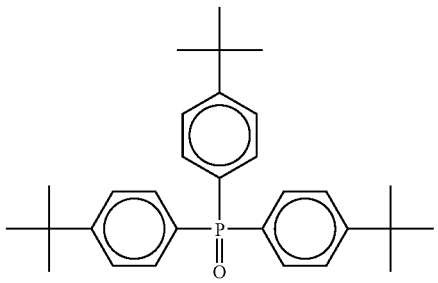

(D-8)

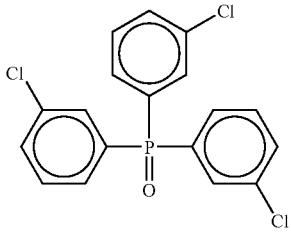

(D-9)

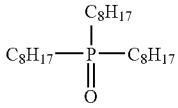

-continued (D-10)

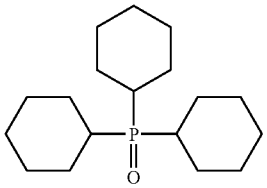

(D-11)

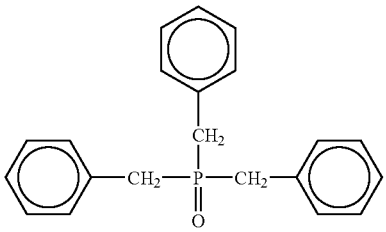

(D-12)

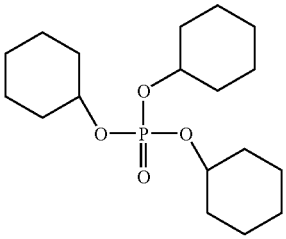

(D-13)

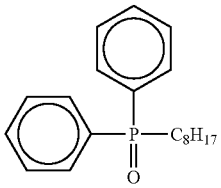

(D-14)

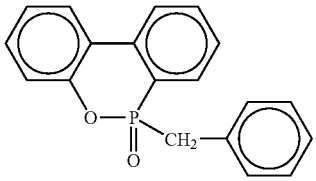

(D-15)

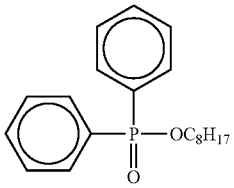

(D-16)

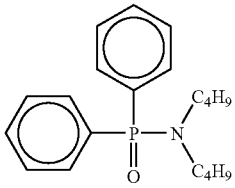

-continued (D-17)

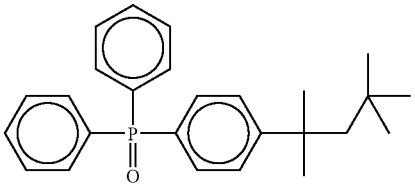

(D-18)

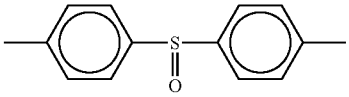

(D-19)

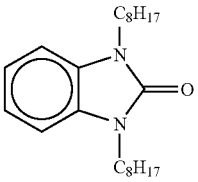

(D-20)

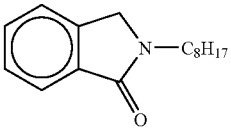

(D-21)

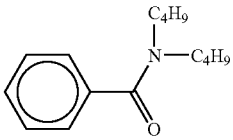

In addition to the above listed, specific examples of hydrogen bond-forming compounds include those as described in Japanese Patent Application Nos. 2000-192191 and 2000-194811.

The hydrogen bond-forming compound according to the invention may be incorporated in a coating solution, in the same manner as for the reducing agent, in any form selected from the group consisting of a solution, an emulsified dispersion and a solid fine particle dispersion, and thus contained in the photosensitive material. The hydrogen bond-forming compound according to the invention forms a complex in a solution state by forming a hydrogen bond with a compound having a phenolic hydroxyl group, whereby the complex, depending on combinations of the reducing agents and the compounds represented by the general formula (D) used in the invention, may be isolated as crystals.

In order to exhibit a stable property, it is particularly preferable that the thus-isolated crystal powder is used as the solid fine particle dispersion. Further, preferably employed is a method in which the reducing agent and the hydrogen bond-forming compound according to the invention are mixed, each as a powder, and then dispersed using an appropriate dispersing agent utilizing a sand grinder mill or the like to form a complex at the time of dispersing operation.

The hydrogen bond-forming compound according to the invention is used, relative to the reducing agent, preferably in the range of from 1 mol % to 200 mol %, more preferably in the range of from 10 mol % to 150 mol % and still more preferably in the range of from 30 mol % to 100 mol %.

1-1-7. Binder

A binder contained in the layer containing the organic silver salt according to the invention may be any type of polymers. Such binders are preferably transparent or semi-transparent and ordinarily colorless. Representative examples of the binders include natural resins or polymers and copolymers, synthetic resins or polymers and copolymers, and other media which form a film. Specific examples thereof include gelatins, rubbers, polyvinyl alcohols, hydoxyethyl celluloses, cellulose acetates, cellulose acetate butyrates, polyvinyl pyrrolidones, casein, starch, polyacrylic acids, polymethyl methacrylic acids, polyvinyl chlorides, polymethacrylic acids, styrene/maleic acid anhydride copolymers, styrene/acrylonitrile copolymers, styrene/butadiene copolymers, polyvinyl acetals (e.g., polyvinyl formal and polyvinyl butyral), polyesters, polyurethanes, phenoxy resins, polyvinylidene chlorides, polyepoxides, polycarbonates, polyvinyl acetates, polyolefins, cellulose esters and polyamides. A coatin layer may be formed from an aqueous solution, a solution in an organic solvent or an emulsion of the binder.

According to the invention, a glass transition temperature (hereinafter sometimes referred to as "Tg") of the binder in the organic silver salt-containing layer is preferably in the range of from 10° C. to 80° C., more preferably in the range of from 20° C. to 70° C., and still more preferably in the range of from 23° C. to 65° C.

As used herein, Tg is calculated according to the following equation:

$$1/Tg=\Sigma(Xi/Tgi)$$

The polymer whose glass transition point Tg is calculated as above comprises n's monomers copolymerized (i indicates the number of the monomers copolymerized, falling between 1 and n); Xi indicates the mass fraction of i'th monomer ($\Sigma Xi=1$); Tgi indicates the glass transition point (in terms of the absolute temperature) of the homopolymer of i'th monomer alone; and $\Sigma$ indicates the sum total of i falling between 1 and n. Incidentally, the value of glass transition point (Tgi) of the homopolymer of each monomer alone is adopted from the values described in "*Polymer Handbook*" (3rd Edition) (written by J. Brandrup, E. H. Immergut (Wiley-Interscience, 1989)).

A single kind of polymer may be used for the binder, or alternatively, two or more kinds of polymers may be used in combination. For example, a combination of a polymer having a glass transition point of higher than 20° C. and another polymer having a glass transition point of lower than 20° C. is possible. In case where at least two kinds of polymers that differ in Tg are blended for use therein, it is desirable that the mass-average Tg of the resulting blend falls within the ranges specified as above.

In case where the organic silver salt-containing layer is formed by applying a coating solution in which at least 30% by mass of the solvent is water, followed by drying, and in case where the binder to be included in the organic silver salt-containing layer is soluble or dispersible in an aqueous solvent (watery solvent), and especially when the binder to be included in the organic silver salt-containing layer is a polymer latex having an equilibrium water content of at most 2% by mass at 25° C. and 60% RH, the photothermographic material achieves improved properties. Most preferably, the binder for use in the present invention has ionic conductivity at most 2.5 mS/cm. In order to prepare such a binder, employable is a method of preparing a polymer followed by purification through a functional membrane for separation.

The aqueous solvent as used herein in which the polymer binder is soluble or dispersible in water or a mixture of water and at most 70% by mass of a water-miscible organic solvent. The water-miscible organic solvent includes, for example, alcohols such as methyl alcohol, ethyl alcohol, propyl alcohol; cellosolves such as methyl cellosolve, ethyl cellosolve, butyl cellosolve; ethyl acetate, and dimethylformamide.

The terminology "aqueous solvent" as used herein refers to polymer systems in which the polymer is not only thermodynamically dissolved but also is in the form of a dispersion.

The term "equilibrium water content at 25° C. and 60% RH" as used herein is represented by the following equation, in which $W^1$ indicates the mass of a polymer in humidity-conditioned equilibrium at 25° C. and 60% RH, and $W^0$ indicates the absolute dry mass of the polymer at 25° C.

$$\text{Equilibrium water content at 25° C. and 60\% } RH=\{(W^1-W^0)/W^0\}\times 100 \text{ (mass \%)}$$

For the details of the definition of water content and the method for measuring it, for example, referred to is "*Lecture of High Polymer Engineering*", No.14, Test Methods for High Polymer Materials (by the Society of High Polymer of Japan, Chijin Shokan).

Preferably, the equilibrium water content at 25° C. and 60% RH of the binder polymer for use in the present invention is at most 2% by mass, more preferably from 0.01 to 1.5% by mass, even more preferably from 0.02 to 1% by mass.

Polymers for use in the present invention are preferably dispersible in aqueous solvents. Preferable polymer dispersions include, for example, a polymer latex in which water-insoluble hydrophobic polymer microparticles are dispersed, a dispersion in which a molecular or micellar polymer is dispersed, and the like. Any of such a polymer dispersion is preferred for use in the present invention. The particles in the polymer dispersion preferably have a mean particle size falling between 1 and 50,000 nm, more preferably approximately between 5 and 1,000 nm. The particle size distribution of the dispersed particles is not specifically limited. For example, the dispersed particles may have a broad particle size distribution, or may have a monodispersed size distribution.

Preferable examples of polymers which are dispersible in an aqueous solvent for use in the present invention include hydrophobic polymers such as acrylic polymers, poly(esters), rubbers (e.g., SBR resins), poly(urethanes), poly(vinyl chlorides), poly(vinyl acetates), poly(vinylidene chlorides), and poly(olefins). These polymers may be linear, branched or crosslinked. They may be homopolymers from a single monomer, or copolymers from two or more kinds of monomers. The copolymers may be random copolymers or block copolymers. The polymers preferably have a number-average molecular weight falling between 5,000 and 1,000,000, and more preferably between 10,000 and 200,000. If too small a molecular weight of polymer is used, the mechanical strength of the image-forming layer is insufficient; in contrast, if too large a molecular weight of polymer is used, film forming properties are poor.

Preferred examples of polymer latex for use in the present invention are mentioned below. These polymer latexes are expressed by their constituent monomers, in which each numeral in parentheses indicates the proportion, in terms of % by mass, of the monomer unit, and the molecular weight of the constituent monomers represents the number-average molecular weight. When polyfunctional monomers are used, the molecular weights of the constituent monomers are omitted and only referred to as "crosslinked" in parentheses since the concept of molecular weight does not apply thereto. Tg indicates the glass transition point of a polymer latex.

P-1; a latex (MW: 37,000; Tg: 61° C.) of MMA(70)/EA(27)/MAA(3)

P-2; a latex (MW: 40,000; Tg: 59° C.) of MMA(70)/2EHA(20)/St(5)/AA(5)

P-3; a latex (crosslinked; Tg: −17° C.) of St(50)/Bu(47)/MAA(3)

P-4; a latex (crosslinked; Tg: 17° C.) of St(68)/Bu(29)/AA(3)

P-5; a latex (crosslinked; Tg: 24° C.) of St(71)/Bu(26)/AA(3)

P-6; a latex (crosslinked) of St(70)/Bu(27)/IA(3)

P-7; a latex (crosslinked; Tg: 29° C.) of St(75)/Bu(24)/AA(1)

P-8; a latex (crosslinked) of St(60)/Bu(35)/DVB(3)/MAA(2)

P-9; a latex (crosslinked) of St(70)/Bu(25)/DVB(2)/AA(3)

P-10; a latex (MW: 80,000) of VC(50)/MMA(20)/EA(20)/AN(5)/AA(5)

P-11; a latex (MW: 67,000) of VDC(85)/MMA(5)/EA(5)/MAA(5)

P-12; a latex (MW: 12,000) of Et(90)/MAA(10)

P-13; a latex (MW: 130,000; Tg: 43° C.) of St(70)/2EHA(27)/AA(3)

P-14; a latex (MW: 33,000; Tg: 47° C.) of MMA(63)/EA(35)/AA(2)

P-15; a latex (crosslinked; Tg: 23° C.) of St(70.5)/Bu(26.5)/AA(3)

P-16; a latex (crosslinked; Tg: 20.5° C.) of St(69.5)/Bu(27.5)/AA(3)

Abbreviations of constituent monomers are as follows:

MMA: methyl metacrylate;

EA: ethy acrylate;

MAA: methacylic acid;

2EHA: 2-ethylhexyl acrylate;

St: Styrene;

Bu: Butadiene;

AA: acrylic acid;

DVB: divinyl benzene;

VC: vinyl chloride;

AN: acrylonitrile;

VDC: vinylidene chloride;

Et: ethylene; and

IA: itaconic acid.

The polymer latexes mentioned above are commercially available. Some available products employable in the present invention are mentioned below. Examples of acrylic polymers include CEBIAN A-4635, 4718 and 4601 (produced by Daicel Chemical Industries), and NIPOL Lx811, 814, 821, 820 and 857 (produced by Nippon Zeon); examples of poly(esters) include FINETEX ES650, 611, 675 and 850 (produced by Dai-Nippon Ink & Chemicals), and WD-size and WMS (produced by Eastman Chemical); examples of poly(urethanes) include HYDRAN AP10, 20, 30 and 40 (produced by Dai-Nippon Ink & Chemicals); examples of rubbers include LACSTAR 7310K, 3307B, 4700H and 7132C (produced by Dai-Nippon Ink & Chemicals), and Nipol Lx416, 410, 438C and 2507 (produced by Nippon Zeon); examples of poly(vinyl chlorides) include G351 and G576 (produced by Nippon Zeon); examples of poly(vinylidene chlorides) include L502 and L513 (produced by Asahi Kasei); and examples of poly(olefins) include CHEMIPEARL S120 and SA100 (produced by Mitsui Petrochemical).

These polymer latexes may be used either singly or, as necessary, in combination of two or more.

Particularly preferable polymer latex for use in the present invention is styrene/butadiene copolymer latex. In the styrene/butadiene copolymer, the ratio of styrene monomer unit to butadiene monomer unit preferably falls between 40/60 and 95/5 by mass. Further, the proportion of styrene monomer unit and butadiene monomer unit preferably accounts for from 60 to 99% by mass of the copolymer. The preferred range of the molecular weight of the copolymer is the same as described above.

Preferred styrene/butadiene copolymer latexes for use in the present invention are the above-mentioned P-3 to P-8, P-14 and P-15, and commercially available products, LACSTAR-3307B, 7132C, and NIPOL Lx416.

The organic silver salt-containing layer of the photothermographic material of the present invention may optionally contain a hydrophilic polymer serving as a binder, such as gelatin, polyvinyl alcohol, methyl cellulose, hydroxypropyl cellulose and the like. The amount of the hydrophilic polymer to be included in the layer is preferably at most 30% by mass, and more preferably at most 20% by mass of the total binder in the organic silver salt-containing layer.

It is preferable to use a polymer latex as the binder for forming the organic silver salt-containing layer (that is, the image-forming layer) of the photothermographic material of the present invention. Specifically, the binder is used in the organic silver salt-containing layer in a ratio of a total binder/an organic silver salt falling between 1/10 and 10/1, and more preferably between 1/5 and 4/1 by mass.

The organic silver salt-containing layer is a photosensitive layer (an emulsion layer) which generally contains a photosensitive silver salt, that is, a photosensitive silver halide. In the layer, the ratio of total binder/silver halide preferably falls between 5 and 400, and more preferably between 10 and 200 by mass.

The overall amount of the binder in the image-forming layer of the photothermographic material of the present invention preferably falls between 0.2 and 30 g/m$^2$, and more preferably between 1 and 15 g/m$^2$. The image-forming layer may optionally contain a crosslinking agent, and a surfactant for improving the coatability of the coating solution.

According to the invention, a solvent (for the purpose of simplicity, a solvent and a dispersing medium are unanimously expressed as solvent) of a coating solution for an organic silver salt-containing layer of the photosensitive material is preferably an aqueous solvent containing 30% by mass or more of water. As the components exclusive of water, any types of water-miscible organic solvents such as methyl alcohol, ethyl alcohol, isopropyl alcohol, Methyl Cellosolve, Ethyl Cellosolve, dimethyl formamide, and ethyl acetate may be used. A water content of such solvent is preferably 50% by mass or more, and more preferably 70% by mass or more.

Examples of preferable solvent compositions include, taking a case of water=100 for granted, water/methyl alcohol=90/10, water/methyl alcohol=70/30, water/methyl alcohol/dimethyl formamide=80/15/5, water/methyl alcohol/Ethyl Cellosolve=85/10/5 and water/methyl alcohol/isopropyl alcohol=85/10/5 (numerical values being indicated in terms of "% by mass").

1-1-8. Fogging Inhibitor

According to the invention, it is preferable to contain any one of compounds which are represented by the following general formula (H) as the fogging inhibitor:

$$Q\text{-}(Y)_n\text{—}C(Z_1)\text{—}(Z_2)X \quad (H)$$

wherein Q represents an alkyl group, an aryl group or a heterocyclic group; Y represents a divalent linking group; n represents 0 or 1; $Z^1$ and $Z^2$ each independently represent a halogen atom; and X represents a hydrogen atom or an electron-attracting group.

In the general formula (H), Q preferably represents a phenyl group substituted with an electron-attracting group having a positive Hammett's substituent constant σp. Regarding the Hammett's substituent constant, the *Journal of Medicinal Chemistry,* 1973, Vol. 16, No. 11, pp. 1207 to 1216 may be referred to.

Examples of such electron-attracting groups include a halogen atom (e.g., a fluorine atom (σp value: 0.06)), a chlorine atom (σp value: 0.23), a bromine atom (σp value: 0.23) and an iodine atom (σp value: 0.18)), a trihalomethyl group (e.g., a tribromomethyl group (σp value: 0.29), a trichloromethyl group (σp value: 0.33) and a trifluoromethyl group (σp value: 0.54)), a cyano group (σp value: 0.66), a nitro group (σp value: 0.78), an aliphatic, aryl or a heterocyclic sulfonyl group (e.g., a methane sulfonyl group (σp value: 0.72)), an aliphatic, aryl or a heterocyclic acyl group (e.g., an acetyl group (σp value: 0.50) and a benzoyl group (σp value: 0.43)), an alkynyl group (e.g., a group of C≡CH (σp value: 0.23)), an aliphatic, aryl or a heterocyclic oxycarbonyl group (e.g., a methoxycarbonyl group (σp value: 0.45) and a phenoxycarbonyl group (σp value; 0.44)), a carbamoyl group (σp value: 0.36), a sulfamoyl group (σp value: 0.57), a sulfoxide group, a heterocyclic group and a phosphoryl group.

A σp value is preferably in the range of from 0.2 to 2.0, and more preferably in the range of from 0.4 to 1.0.

Particularly preferable electron-attracting groups are a carbamoyl group, an alkoxycarbonyl group, an alkylsulfonyl group, an alkylphosphoryl group, a carboxyl group, an alkyl- or aryl-carbonyl group, and an arylsulfonyl group. Particularly preferable groups are a carbamoyl group, an alkoxycarbonyl group, an alkylsulfonyl group, and an alkylphosphoryl group. Most preferable group is a carbamoyl group.

In the general formula (H), X is preferably an electron-attracting group, and more preferably a halogen atom, an aliphatic, aryl or a heterocyclic sulfonyl group, an aliphatic, aryl or a heterocyclic acyl group, an aliphatic, aryl or a heterocyclic oxycarbonyl group, a carbamoyl group or a sulfamoyl group. A halogen atom is particularly preferred.

Among the halogen atoms, a chlorine atom, a bromine atom and an iodine atom are preferable; a chlorine atom and a bromine atom are more preferable; and a bromine atom is particularly preferable.

In the general formula (H), Y preferably represents —C(=O)—, —SO— or —$SO_2$—, with —C(=O)— or —$SO_2$— being more preferable, and —$SO_2$— being particularly preferable.

In the general formula (H), n represents 0 or 1, with 1 being preferable.

Specific examples of compounds represented by the general formula (H) according to the invention are listed below; however, the invention is by no means limited thereto.

(H-1)

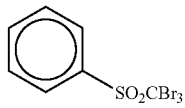

(H-2)

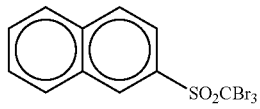

(H-3)

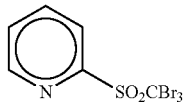

(H-4)

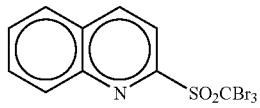

(H-5)

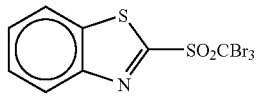

(H-6)

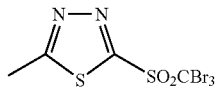

(H-7)

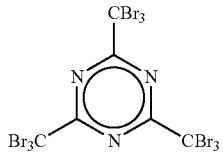

(H-8)

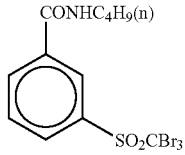

(H-9)

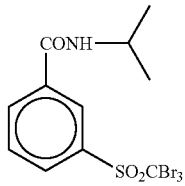

(H-10)

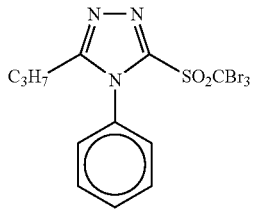

-continued (H-11)

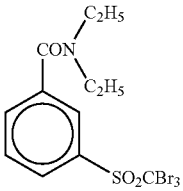

(H-12)

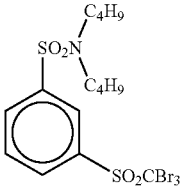

(H-13)

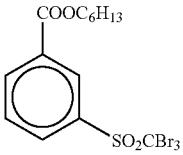

(H-14)

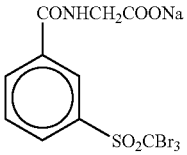

(H-15)

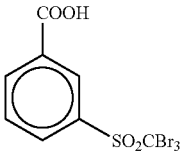

(H-16)

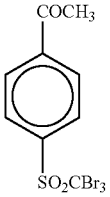

(H-17)

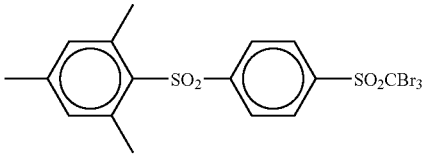

(H-18)

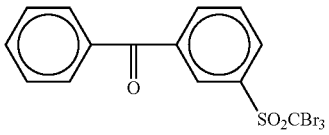

(H-19)

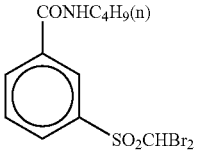

-continued (H-20)

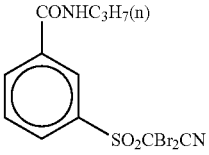

(H-21)

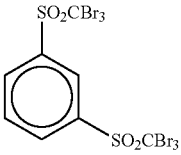

(H-22)

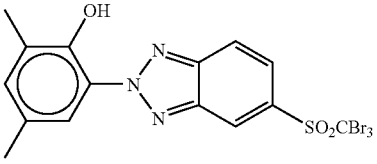

(H-23)

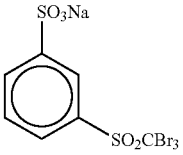

(H-24)

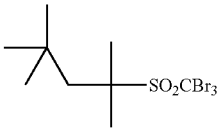

The compound represented by the general formula (H) according to the invention is used, per mol of non-photosensitive silver salt in the image-forming layer, preferably in the range of from $1\times10^{-4}$ mol to 0.8 mol, more preferably in the range of from $1\times10^{-3}$ mol to 0.1 mol, and still more preferably in the range of from $5\times10^{-3}$ mol to 0.05 mol.

Particularly in the case where the silver halide having a composition in which a silver iodide content is high according to the present invention is used, an addition amount of the compound represented by the general formula (H) is a critical factor so as to obtain a sufficient antifogging effect, and the compound is most preferably used in an amount ranging from $5\times10^{-3}$ mol to 0.03 mol.

As the methods for incorporating the compound represented by the general formula (H) according to the invention in the photosensitive material, the same methods as those described for the reducing agent are applicable.

A melting point of the compound represented by the general formula (H) is preferably 200° C. or lower and more preferably 170° C. or lower.

As other organic polyhalogen compounds for use in the invention, compounds set forth in paragraphs [0111] to [0112] of JP-A No. 11-65021 are mentioned. In particular, organic halides represented by the formula (P) in Japanese Patent Application No. 11-87297, organic polyhalogen compounds represented by the general formula (II) in JP-A No. 10-339934 and organic polyhalogen compounds described in Japanese Patent Application No. 11-205330 are preferable.

1-1-9. Other Fogging Inhibitors

As other fogging inhibitors, a mercury (II) salt as described in paragraph [0113] of JP-A No. 11-65021, benzoic acids as described in paragraph [0114] of P-A No. 11-65021, a salicylic acid derivative as described in JP-A No. 2000-206642, a formalin scavenger compound represented by the formula (S) in JP-A No. 2000-221634, a triazine compound stated in claim 9 of JP-A No. 11-352624, compounds represented by the general formula (III) of JP-A No. 6-11791, 4-hydoxy-6-methyl-1,3,3a, 7-tetrazaindene and the like are used in the invention.

As the fogging inhibitor, stabilizer and stabilizer precursor, those described in paragraph [0070] of JP-A No. 10-62899, pp. 20 (line 57) to 21 (line 7) of EP-A No. 0803764, and compounds described in JP-A Nos. 9-281637 and 9-329864 are used in the invention.

The photothermographic material according to the invention may contain an azolium salt for the purpose of inhibiting fogging. As the azolium salt, compounds represented by the general formula (XI) as described in JP-A No. 59-193447, compounds as described in JP-B No. 55-12581, and compounds represented by the general formula (II) as described in JP-A No. 60-153039 may be used. The azolium salt may be added in any portion of the photosensitive material; however, as the layer to be added with the azolium salt, the layer at a surface having the photosensitive layer is preferable, and the layer containing the organic silver salt is more preferable.

Addition of the azolium salt may be conducted in any step for preparing a coating solution. When the azolium salt is added to the layer containing the organic silver salt, the azolium salt may be added in any step of from preparation of the organic silver salt to preparation of a coating solution; however, the azolium salt is preferably added during a period of after the preparation of the organic silver salt to immediately before the coating. In order to add the azolium salt, any addition method, such as that in a powder state, a solution state or a fine particle dispersion state thereof, may be adopted. The azolium salt may also be added in a state of solution mixed with other additives such as a sensitizing dye, a reducing agent and a toning agent.

According to the invention, an addition amount of the azolium salt may be arbitrary; however, it is preferably in the range of from $1\times10^{-6}$ mol to 2 mol, and more preferably in the range of from $1\times10^{-3}$ mol to 0.5 mol, per mol of silver.

1-1-10. Other Additives

1) Mercapto, Disulfide and Thiones

According to the invention, in order to control development by inhibiting or accelerating the development, improve spectral sensitizing efficiency, improve storability before and after the development, a mercapto compound, a disulfide compound or a thione compound can be incorporated. Compounds as described in paragraphs [0067] to [0069] of JP-A No. 10-62899, compounds represented by the general formula (I) and their specific examples as described in paragraphs [0033] to [0052] of JP-A No. 10-186572, compounds described in page 20, lines 36 to 56 of EP-A No. 0803764, and compounds as described in Japanese Patent Application No. 11-273670 may be mentioned.

2) Toning Agent

In the photothermographic material according to the invention, a toning agent is preferably included. Such toning agents are described in paragraphs [0054] to [0055] of JP-A No. 10-62899, page 21, lines 23 to 48 of EP-A No. 0803764, JP-A No. 2000-356317 and Japanese Patent Application No. 2000-187298. In particular, phthalazinones (phthalazinone, phthalazinone derivatives or their metal salts, e.g., 4-(1-naphthyl)phthalazinone, 6-chlorophthalazinone, 5,7-dimethoxy phthalazinone and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate and tetrachlorophthalic acid anhydride); phthalazines (phthalazine, phthalazine derivatives or their metal salts, e.g., 4-(1-naphthyl)phthalazine, 6-isopropylphthalazine, 6-t-butylphthalazine, 6-chlorophthalazine, 5,7-dimethoxyphthalazine and 2,3-dihydrophthalazine) are preferable. When combined with a silver halide having a composition whose silver iodide content is high, a combination of phthalazines and phthalic acids are particularly preferred.

An addition amount of the phthalazines is, per mol of the organic silver salt, preferably in the range of from 0.01 mol to 0.3 mol, more preferably in the range of from 0.02 mol to 0.2 mol, and particularly preferably in the range of from 0.02 mol to 0.1 mol. Such addition amounts are critical factors to accelerate development, which is a concern of a silver halide emulsion disclosed herein, having a composition whose silver iodide content is high. If appropriate addition amounts thereof are employed, sufficient development and lowered fogging are both achieved 3) Plasticizer and Lubricant Plasticizers and lubricants employable in the photosensitive layer according to the invention are described in paragraph [0117] of JP-A No. 11-65021. Slipping agents are described in paragraphs [0061] to [0064] of JP-A No. 11-84573, and paragraphs [0049] to [0062] of Japanese Patent Application No. 11-106881.

4) Dye and Pigment

In order to improve tones, prevent an interference fringe pattern to be generated by laser light exposure, and prevent irradiation, various types of dyes and pigments (e.g., C. I. Pigment Blue 60, C. I. Pigment Blue 64, and C. I. Pigment Blue 15:6) may be included in the photosensitive layer according to the invention. These dyes and pigments are detailed, for exmple, in WO98/36322, JP-A No. 10-268465, and 11-338098.

5) Ultra-High Contrast Agent

In order to form ultra-high contrast images applied for a printing plate fabrication, an ultra-high contrast agent is preferably included in an image-forming layer. As the ultra-high contrast agents, adding methods thereof, and respective addition amounts are described in paragraph [0118] of JP-A No. 11-65021, and paragraphs [0136] to [0193] of JP-A No. 11-223898, compounds represented by the formula (H), the formulas (1) to (3) and the formulas (A) and (B) in Japanese Patent Application No. 11-87297, and compounds represented by the general formulas (III) to (V) in Japanese Patent Application No. 11-91652 (specifically, compounds denoted as Chemicals 21 to 24). Also, high contrast promoting agents are described in paragraph [0102] of JP-A No. 11-65021, and paragraph [0194] to [0195] of JP-A No. 11-223898.

When formic acid or a salt thereof is used as a strong fogging agent, it may be added to a side provide with the image-forming layer containing the photosensitive silver halide in an amount, per mol of silver, preferably of 5 mmol or less, and more preferably of 1 mmol or less.

When the ultra-high contrast agent is used in the photothermographic material according to the invention, it is preferable to use the agent in combination with an acid or a salt thereof formed through hydration of phosphorus pentaoxide. As the acid or the salt thereof formed through hydration of phosphorus pentoxide, mentioned are metaphosphoric acid (and salts thereof), pyrophosphoric acid (and salts thereof, orthophosphoric acid (and salts thereof), triphosphoric acid (and salts thereof), tetraphosphoric acid (and salts thereof) and hexametaphosphoric acid (and salts thereof). Acids formed through hydration of phosphorus pentoxide or the salts thereof which are particularly preferably used are orthophosphoric acid (and salts thereof and hexametaphosphoric acid (and salts thereof). Specific examples of the salts include sodium orthophosphate, sodium dihydrogen orthophosphate, sodium hexametaphosphate and ammonium hexametaphosphate.

An amount of the acid formed through hydration of phosphorus pentoxide or the salt thereof to be used (in terms of a coating amount based on 1 $m^2$ of the photosensitive material) may be a desired quantity, depending on properties of sensitivity, fog, and the like; however, it is preferably in the range of from 0.1 $mg/m^2$ to 500 $mg/m^2$, and more preferably in the range of from 0.5 $mg/m^2$ to 100 $mg/m^2$.

1-1-11. Preparation and Application of Coating Solution

A temperature at which the coating solution for the image-forming layer according to the invention is prepared is preferably in the range of from 30° C. to 65° C., more preferably from 35° C. to 60° C., and still more preferably from 35° C. to 55° C. It is also preferable that the temperature of the coating solution for the image-forming layer immediately after addition of the polymer latex is maintained in the range of from 30° C. to 65° C.

1-2. Other Layers, and Components Thereof

The photothermographic material according to the invention may have a non-photosensitive layer, in addition to the image-forming layer. The non-photosensitive layer may be divided depending on its disposition into the following; (a) a surface protective layer formed on the image-forming layer (on a position remote from the support), (b) an intermediate layer formed between any two of a plurality of image-forming layers or between the image-forming layer and the protective layer, (c) an undercoat layer formed between the image-forming layer and the support, and (d) a back layer formed on an opposite side of the image-forming layer.

Further, a layer acting as an optical filter may be provided in the photosensitive material as a layer of the above-described (a) or (b). An antihalation layer may be formed in the photosensitive material as a layer of the above-described (c) or (d).

1) Surface Protective Layer

The photothermographic material according to the invention may have a surface protective layer for the purpose of preventing adhesion of the image-forming layer. The surface protective layer may be of a monolayer or of a multilayer. Such surface protective layers are described in paragraphs [0119] to [0120] of JP-A No. 11-65021, and Japanese Patent Application No. 2000-171936.

As the binder used for the surface protective layer according to the invention, gelatin is preferably used. Also, polyvinyl alcohol (PVA) is preferably used solely or in combination with gelatin. As gelatin, inert gelatin (e.g., Nitta Gelatin 750), phthalated gelatin (e.g., Nitta Gelatin 801) and the like may be used.

As PVA, those described in paragraphs [0009] to [0020] of JP-A No. 2000-171936 may be used. PVA-105 as a completely saponified PVA, PVA-205 and PVA-335 as a partly saponified PVA, and MP-203 as a modified polyvinyl alcohol (manufactured by Kuraray Co., Ltd.) are preferably used.

A coating amount (based on 1 $m^2$ of the support) of polyvinyl alcohol in the protective layer (for one layer) is preferably in the range of from 0.3 $g/m^2$ to 4.0 $g/m^2$, and more preferably in the range of from 0.3 $g/m^2$ to 2.0 $g/m^2$.

A coating amount (based on 1 $m^2$ of the support) of the entire binder (including water-soluble polymer and latex polymer) in the surface protective layer (for one layer) is preferably in the range of from 0.3 $g/m^2$ to 5.0 $g/m^2$, and more preferably in the range of from 0.3 $g/m^2$ to 2.0 $g/m^2$.

2) Antihalation Layer

In the photothermographic material according to the invention, an antihalation layer may be provided at a side distant from a light source relative to the photosensitive layer. Such antihalation layers are described, for example, in paragraphs [0123] to [0124] of JP-A No. 11-65021, JP-A Nos. 11-223898, 9-230531, 10-36695, 10-104779, 11-231457, 11-352625 and 11-352626.

The antihalation layer contains an antihalation dye capable of absorbing light in a range of wavelengths of light for exposing the photothermographic material. When such a wavelength is in an infrared region, a dye absorbing an infrared ray may be used; on this occasion, the dye which do not absorb visible light is used.

When antihalation is performed using a dye capable of absorbing visible light, it is preferred that color of the dye are rendered substantially decolored after image formation, by employing a device to decolorize the dye by heat generated by thermal development. It is particularly preferable to add a thermally decolorizable dye and a base precursor to the non-photosensitive layer to make the resultant non-photosensitive layer to function as an antihalation layer. Such techniques are described, for example, in JP-A No. 11-231457.

An addition amount of the decolorizable dye is determined depending on the use purpose of the dye. Ordinarily, the decolorizable dye is used in such an amount to obtain an optical density (absorbance) measured at a predetermined wavelength exceeding 0.1. The optical density is preferably in the range of from 0.2 to 2. The use amount of the decolorizable dye to obtain the desired optical density is usually in the range of from about 0.001 $g/m^2$ to about 1 $g/m^2$.

If the dyes are decolorized in such a manner, the optical density can be lowered to 0.1 or less after thermal development. Two or more types of decolorizable dyes may be used in combination in a thermally decolorizable-type recording material or in the photothermographic material. In a similar way, two or more types of base precursors may be used in combination.

When thermally decoloring is conducted using such a decolorizable dye and base precursor, it is preferable from the viewpoint of thermal decolorability to use a substance which, when used in combination with the base precursor, can lower the melting point by at least 3° C. (e.g., diphenylsulfone or 4-chlorophenyl(phenyl)sulfone), as described in JP-A No. 11-352626.

3) Back Layer

As to a back layer which is applicable to the invention, descriptions are found in paragraphs [0128] to [0130] of JP-A No. 11-65021.

According to the invention, a coloring agent having an absorption maximum in a wavelength region of from 300 nm to 450 nm can be added for the purposes of enhancing a silver color tone and improving a change in an image with time. Such coloring agents are described in JP-A Nos. 62-210458, 63-104046, 63-103235, 63-208846, 63-306436, 63-314535, 1-61745, Japanese Patent Application No. 11-276751, etc. These coloring agents are usually added in an amount in a range of from 0.1 mg/m$^2$ to 1 g/m$^2$. As to a layer for the agent to be added to, the back layer provided on an opposite side of the photosensitive layer is preferable.

4) Matting Agent

According to the invention, it is preferable to add a matting agent to the surface protective layer and the back layer for the purpose of improving a transportation property. Such matting agents are described in paragraphs [0126] and [0127] of JP-A No. 11-65021.

A coating amount of the matting agent is preferably in a range of from 1 mg/m$^2$ to 400 mg/m$^2$, and more preferably from 5 mg/m$^2$ to 300 mg/m$^2$ per m$^2$ of the photothermographic material.

A matte degree of an emulsion surface is not particularly limited so far as a so-called star dust-like defect, in which a small blank area is generated in an imaged portion to cause light leaks, does not occur. However, a Beck's smoothness is preferably in a range of from 30 seconds to 2,000 seconds and particularly preferably in a range of from 40 seconds to 1,500 seconds. The Beck's smoothness may easily be obtained according to "Testing Method for Smoothness of Paper and Paperboard with Beck's Tester", the Japanese Industrial Standards (JIS) P8119 and the TAPPI Standard Method T479.

According to the invention, the Beck's smoothness as a matte degree for the back layer is preferably in a range of from 10 seconds to 1,200 seconds, more preferably from 20 seconds to 800 seconds, and still more preferably from 40 seconds to 500 seconds.

According to the invention, the matting agent is preferably contained in an outermost surface layer, a layer which functions as the outermost surface layer of the photothermographic material, a layer in the vicinity of an outer surface layer or a layer which functions as the so-called protective layer.

5) Polymer Latex

A polymer latex can be added to the surface protective layer and the back layer.

Such polymer latexes are described in "*Synthetic Resin Emulsion*", compiled by Taira Okuda and Hiroshi Inagaki, Kobunshi Kankokai (Polymer Publishing), 1978, "*Application of Synthesized Latex*", compiled by Takaaki Sugimura, Yasuo Kataoka, Soichi Suzuki and Keiji Kasahara, Kobunshi Kankokai (Polymer Publishing), 1993, Soichi Muroi, "*Chemistry of Synthesized Latex*", Kobunshi Kankokai (Polymer Publishing), 1970 and the like. Specific examples of the polymer latexes include a latex of a methyl methacrylate (33.5% by mass)/ethyl acrylate (50% by mass)/methacrylic acid (16.5% by mass) copolymer, a latex of a methyl methacrylate (47.5% by mass)/butadiene (47.5% by mass)/itaconic acid (5% by mass) copolymer, a latex of an ethyl acrylate/methacrylic acid copolymer, a latex of a methyl methacrylate (58.9% by mass)/2-ethylhexyl acrylate (25.4% by mass)/styrene (8.6% by mass)/2-hydroxyethyl metacrylate (5.1% by mass)/acrylic acid (2.0% by mass) copolymer, and a latex of a methyl methacrylate (64.0% by mass)/styrene (9.0% by mass)/butylacrylate (20.0% by mass)/2-hydroxyethyl metacrylate (5.0% by mass)/acrylic acid (2.0% by mass) copolymer.

The polymer latex is used in an amount, based on the entire binder in the surface protective layer or the back layer, of preferably from 10% by mass to 90% by mass, and particularly preferably from 20% by mass to 80% by mass.

6) Film Surface pH

In the photothermographic material according to the invention, a pH of a film surface before thermal development is preferably 7.0 or less, and more preferably 6.6 or less. A lower limit thereof is not particularly limited, but is approximately 3. A most preferable pH range is from 4 to 6.2.

For adjusting the pH of the film surface, it is preferable from the viewpoint of lowering the pH of the film surface to use an organic acid such as a phthalic acid derivative, a non-volatile acid such as sulfuric acid or a volatile base such as ammonia. Particularly, ammonia is preferable in achieving a low pH of the film surface, because ammonia is particularly volatile and may be removed during a coating process or before thermal development.

It is also preferable that a non-volatile base such as sodium hydroxide, potassium hydroxide or lithium hydroxide is used together with ammonia. Measuring methods of the pH of the film surface are described in paragraph [0123] of Japanese Patent Application No. 11-87297.

7) Hardening Agent

A hardening agent may be used in each of the photosensitive layer, the protective layer, the back layer and the like according to the invention.

Examples of such hardening agents employable are found in various methods described in T. H. James, "*The Theory of the Photographic Process*", 4th edition, pp. 77 to 87, Macmillan Publishing Co., Inc., 1977. Other preferable examples of the hardening agents include not only chrome alum, a sodium salt of 2,4-dichloro-6-hydroxy-s-triazine, N,N-ethylene bis(vinylsulfonacetamide) and N,N-propylene bis(vinylsulfonacetamide), but also multivalent metal ions described in the above literature, pp. 78, polyisocyanates described in U.S. Pat. No. 4,281,060 and JP-A No. 6-208193, epoxy compounds described in U.S. Pat. No. 4,791,042 and vinyl sulfone type compounds described in JP-A No. 62-89048.

The hardening agent is added in the form of a solution. Addition of a hardening agent solution to the coating liquid for the protective layer is conducted during a time period of from 180 minutes before a coating operation to immediately before the coating operation, and preferably from 60 minutes before a coating operation to 10 seconds before the coating operation, and mixing methods and mixing conditions of the hardening agent solution are not particularly limited so far as the effects of the invention are sufficiently exerted.

Specific examples of the mixing methods include a mixing method using a tank in which an average dwell time calculated from an addition flow rate and a feeding flow rate to a coater is specified to be a desired time and a mixing method using a static mixer or the like described in N. Harnby, M. F. Edwards and A. W. Nienow, "*Techniques of Mixing Liquids*", translated by Koji Takahashi, Chapter 8, Nikkan Kogyo Newspaper, 1989.

8) Surfactant

Surfactants applicable to the invention are described in paragraph [0132] of JP-A No. 11-65021.

According to the invention, it is preferable to use a fluorine-based surfactant. As specific examples of such surfactants, mentioned are compounds described in JP-A Nos. 10-197985, 2000-19680, 2000-214554 and the like. A polymeric fluorine-based surfactant described in JP-A No. 9-281636 is also preferably used. In the photothermographic material according to the invention, fluorine-based surfactants described in Japanese Patent Application Nos. 2000-206560 are preferably used.

9) Anti-Static Agent

In the invention, an anti-static layer comprising any one of electrically conductive materials such as various types of known metal oxides and electrically conductive polymers may be contained. The anti-static layer may be provided on any of an image-forming layer side and a back layer side, such that the anti-static layer may simultaneously serve as the above-described undercoat layer, back layer, protective layer or the like or may be provided separately from these layers. Preferably, the anti-static layer is provided between the support and the back layer. As for the anti-static layer, techniques described in paragraph [0135] of JP-A No. 11-65021, JP-A Nos. 56-143430, 56-143431, 58-62646 and 56-120519, paragraphs [0040] to [0051] of JP-A No. 11-84573, U.S. Pat. No. 5,575,957, paragraphs [0078] to [0084] of JP-A No. 11-223898 are employable.

10) Support

As a transparent support, a polyester, in particular, polyethylene terephthalate, which has been thermally treated in a temperature range of from 130° C. to 185° C. in order to relax residual internal stress in a film at the time of biaxially stretching and to eliminate stress of thermal contraction generated in thermal development, is preferably used.

In a case of the photothermographic material for medical use, the transparent support may be colored with blue dyes (for example, Dye-1 described in JP-A No. 8-240877) or may remain colorless. Specific examples of such supports are described in paragraph [0134] of JP-A No. 11-65021.

To the support, undercoating techniques using a water-soluble polyester described in JP-A No. 11-84574, a styrene/butadiene copolymer described in JP-A No. 10-186565, vinylidene chloride copolymers described in JP-A No. 2000-39684 and paragraphs [0063] to [0080] of Japanese Patent Application No. 11-106881 and the like are preferably adopted.

11) Other Additives

To the photothermographic material, an anti-oxidant, a stabilizing agent, a plasticizer, a UV absorbent or a covering aid may further be added. A solvent described in paragraph [0133] of JP-A No. 11-65021 may also be added thereto. These various additives are included in either the photosensitive layer or the non-photosensitive layer. Concerning these matters, references may be made to WO98/36322, EP-A No. 803764, JP-A Nos. 10-186567, 10-18568 and the like.

12) Coating Method

The photothermographic material according to the invention may be coated by any method. Specifically, various types of coating methods including extrusion coating, slide coating, curtain coating, dip coating, knife coating, flow coating, and extrusion coating using a type of hopper described in U.S. Pat. No. 2,681,294 are employed. Extrusion coating described in Stephen F. Kistler and Peter M. Schweizer, "*Liquid Film Coating*", pp. 399 to 536, Chapman & Hall, 1997 or slide coating is preferably used. In particular, the slide coating is preferably used.

Examples of shapes of slide coaters used for the slide coating are described in the above book, page 427, FIG. 11b-1. As desired, two or more layers can simultaneously be coated by methods described in the above book, pp. 399 to 536, U.S. Pat. No. 2,761,791 and British Patent No. 837,095.

The coating liquid for the organic silver salt-containing layer according to the invention is preferably a so-called thixotropic fluid. As to the techniques for such a thixotropic fluid, JP-A No. 11-52509 may be referred to.

In the present invention, the viscosity of the coating liqiud for the organic silver salt-containing layer under a shearing velocity of 0.1 $S^{-1}$ is preferably in a range of from 400 mPa·s to 100,000 mPa·s, and more preferably in a range of from 500 mPa·s to 20,000 mPa·s.

The viscosity under a shearing velocity of 1,000 $S^{-1}$ is preferably in a range of from 1 mPa·s to 200 mPa·s, and more preferably in a range of from 5 mPa·s to 80 mPa·s.

It is preferable that the photothermographic material according to the invention is subjected to a thermal treatment immediately after drying the coatings. Particularly, in a case of the photothermographic material in which a water-based latex is used as the binder, film strength is enhanced by the thermal treatment and handling of the photothermographic material may be readily conducted. A temperature of the thermal treatment is, in terms of effective film surface temperature, preferably in the range of from 60° C. to 100° C. while a time period of heating is preferably in the range of from 1 second to 60 seconds. The conditions are more preferably in the range of from 70° C. to 90° C. and in the range of from 2 seconds to 10 seconds, respectively. A preferable heating method according to the invention can be referred to those as described in JP-A No. 2002-107872.

13) Packaging Material

It is preferable that the photothermographic material according to the invention is seal-packed by a packaging material imparted with at least one property of low oxygen permeability and/or low moisture permeability, in order to prevent a photographic property thereof from being deteriorated during a storage period before being put in actual use or, in a case in which an end-product is in a roll state, to prevent the photothermographic material from being curled or being imparted with a winding crimp. The oxygen permeability at 25° C. is preferably less than 50 ml/atm/$m^2$ day, more preferably less than 10 ml/atm/$m^2$ day, and still more preferably less than 1.0 ml/atm/$m^2$ day. The moisture permeability is preferably less than 10 g/atm/$m^2$ day, more preferably less than 5 g/atm/$m^2$ day, and still more preferably less than 1 g/atm/$m^2$ day. As specific examples of such packaging materials imparted with at least one property of low oxygen permeability and/or low moisture permeability, those described in JP-A Nos. 8-254793 and 2000-206653 are employable.

14) Other Usable Techniques

As to techniques usable in the photothermographic material according to the invention, such techniques as described in the following references are further employed: EP-A Nos. 803764 and 883022, WO98/36322, JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565 and 10-186567, from JP-A No. 10-186569 to JP-A No. 10-186572, JP-A Nos. 10-197974, 10-197982 and 10-197983, from JP-A No. 10-197985 to JP-A No. 10-197987, JP-A Nos. 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880 and 11-129629, from JP-A No. 11-133536 to JP-A No. 11-133539, JP-A Nos. 11-133542, 11-133543, 11-223898, 11-352627, 11-305377, 11-305378, 11-305384, 11-305380, 11-316435, 11-327076, 11-338096, 11-338098, 11-338099 and 11-343420, Japanese Patent Application Nos. 2000-187298, 2000-10229, 2000-47345, 2000-206642, 2000-98530, 2000-98531, 2000-112059, 2000-112060, 2000-112104, 2000-112064 and 2000-171936.

15) Color Image Formation

A multi-color photothermographic material may comprise a combination of at least two layers of different colors or may comprise one layer containing all colors therein as described in U.S. Pat. No. 4,708,928.

In a case of the multi-color photothermographic material, respective emulsion layers are, as described in U.S. Pat. No. 4,460,681, ordinarily maintained in a separate manner from one another via a functional or non-functional barrier layer disposed between the respective photosensitive layers.

2. Image-Forming Method 2-1. Exposure

The photothermographic material according to the present invention can be exposed in any manner. Preferably, laser light is used as a light source.

The silver halide emulsion having a high silver iodide content according to the invention has conventionally posed a problem in that sensitivity is low. However, it was found that the problem of such low sensitivity is solved by performing writing-in by means of such an intense irradiation using laser light whereby image recording can be performed by a smaller energy than conventional means. Thus, desired sensitivity can be attained using strong intensity light in a short period of time.

Particularly when a quantity of exposure which realizes a maximum density (Dmax) is provided, a quantity of light on a surface of the photosensitive material is preferably in the range of from 0.1 $W/mm^2$ tp 100 $W/mm^2$, more preferably in the range of from 0.5 $W/mm^2$ to 50 $W/mm^2$, and most preferably in the range of from 1 $W/mm^2$ to 50 $W/mm^2$.

The laser light for use in the present invention is, for example, gas laser ($Ar^+$, He—Ne or He—Cd), YAG laser, dye laser, or semiconductor laser. Also employable is a combination of a semiconductor laser and a secondary harmonic generating element. Laser to be preferably used is selected corresponding to a light absorption peak wavelength of, for example, a spectral sensitizing dye in the photothermographic material, but preferably is the He—Ne laser or a red color semiconductor laser which emits red to infrared light, or the $Ar^+$ laser, the He—Ne laser, the He—Cd laser or a blue color semiconductor laser which emits blue to green light. In recent years, particularly, a module fabricated by unifying SHG (Second Harmonic Generator) element with the semiconductor laser, or the blue semiconductor laser has been developed, thereby rapidly attracting people's attention to a laser output device in a short wavelength region. Since the blue semiconductor laser is capable of performing ultra-fine image recording, increasing a recording density and obtaining a long-life and consistent output, it is expected that demand for the blue semiconductor laser will be increased. The peak wavelength of the laser light is, in terms of blue color, in the range of from 300 nm to 500 nm, and preferably in the range of from 400 nm to 500 nm whereas, in terms of red to infrared, in the range of from 600 nm to 900 nm, and preferably in the range of from 620 nm to 850 nm.

Laser light which oscillates in a longitudinal multi-mode by a method such as high frequency superimposition is preferably employed.

2-2. Thermal Development

The photothermographic material according to the invention may be developed by any method. Ordinarily, a temperature of the photothermographic material which has been exposed image-wise is elevated to allow it to be developed. A development temperature is preferably in a range of from 80° C. to 250° C., and more preferably in a range of from 100° C. to 140° C. The development time period is preferably from 1 second to 60 seconds, more preferably from 5 seconds to 30 seconds, and still more preferably from 5 seconds to 20 seconds.

As to a thermal development system, a plate heater system is preferably used. As to the thermal development system utilizing the plate heater system, methods described in JP-A No. 11-133572 are preferable, in which there is provided a thermal development apparatus that obtains a visible image by allowing a photothermographic material in which a latent image has been formed to contact with a heating unit in a thermal development portion thereof, wherein the thermal development apparatus is characterized in that the heating unit comprises a plate heater, a plurality of pressure rolls are provided along one surface of the plate heater such that the pressure rolls face to the plate heater and the thermal development is performed by allowing the photothermographic material to pass through between the pressure rolls and the plate heater. It is preferable that the plate heater is divided into 2 to 6 steps and that the top portion has a temperature lowered by approximately 1° C. to 10° C. Such methods as described above are also described in JP-A No. 54-30032; according to these methods, moisture and an organic solvent contained in the photothermographic material can be removed out of a system and, also, deformation of the support of the photothermographic material caused by rapid heating can be suppressed.

2-3. System

As a laser imager equipped with a light exposure part and a thermal development part for the medical use, Fuji Medical Dry Imager FM-DPL is used. The system is detailed in Fuji Medical Review No. 8, pp. 39 to 55 and the techniques set forth therein are applicable. Further, the photothermographic material according to the invention may also be applied for the laser imager in "AD network", proposed by Fujifilm Medical Co., Ltd., a network system which meets the DICOM Standards.

3. Application of the Invention

The photothermographic material according to the present invention forms a monochromatic silver image, and hence is preferably used in medical diagnosis, industrial photography, printing and COM (computer output microfilm).

EXAMPLES

The invention will now be illustrated by the following Examples, but it is to be understood that the invention is not limited to the Examples.

Example 1

1. Preparation of PET Support, and Undercoat 1-1. Film Formation

From terephthalic acid and ethylene glycol, PET was produced in an ordinary manner. PET thus produced had an intrinsic viscosity, IV, of 0.66, as measured in a phenol/tetrachloroethane ratio (6/4 by weight) at 25° C. After pelletized, the PET was dried at 130° C. for 4 hours, and melted at 300° C., followed by extrusion through a T-die. After rapid cooling, a non-oriented film was obtained which had a thickness of 175 μm after thermal fixation.

The resultant film was stretched 3.3 times in MD (machine direction) using a roll at different rotating speeds, then stretched 4.5 times in CD (cross direction) using a tenter.

The temperatures for MD and CD stretchings were 110° C. and 130° C., respectively. Then, the film was thermally fixed at 240° C. for 20 seconds, and relaxed by 4% in CD at the same temperature. Subsequently, the chuck of the tenter was released, the both edges of the film was knurled, and the film was rolled up under 4 kg/cm$^2$ to give a rolled film having a thickness of 175 μm.

1-2. Corona Discharge Surface Treatment

Both surfaces of the support were subjected to corona discharge treatment at room temperature at a speed of 20 m/min, using a solid-state corona discharge system MODEL 6KVA manufactured by Pillar Technologies. From the data of the current and the voltage read from the system, the support was found to be processed at 0.375 kV·A·min/m$^2$. The frequency for the treatment was 9.6 kHz, and the gap clearance between an electrode and a dielectric roll was 1.6 mm.

1-3. Undercoat (1) Preparation of a Coating Solution for an Undercoat Layer:

| | |
|---|---|
| Formulation (1) (for an undercoat layer at the side of providing an image-forming layer): | |
| Pesuresin A-520 (a 30% by mass solution) manufactured by Takamatsu Yushi KK | 59 g |
| Polyethylene glycol monononylphenyl ether (average ethylene oxide number = 8.5, a 10% by mass solution) | 5.4 g |
| Polymer microparticles (MP-1000, mean particle size: 0.4 μm) manufactured by Soken Chemical & Engineering Co., Ltd. | 0.91 g |
| Distilled water | 935 ml |
| Formulation (2) (for a first back layer): | |
| Styrene-butadiene copolymer latex (solid content: 40% by mass, styrene/butadiene ratio = 68/32 by mass) | 158 g |
| Sodium 2,4-Dichloro-6-hydroxy-S-triazine (a 8% by mass aqueous solution) | 20 g |
| Sodium laurylbenzenesulfonate (a 1% by mass aqueous solution) | 10 ml |
| Distilled water | 854 ml |
| Formulation (3) (for a second back layer): | |
| $SnO_2$/SbO (9/1 by mass, mean particle size: 0.038 μm, a 17% by mass dispersion) | 84 g |
| Gelatin (a 10% aqueous solution) | 89.2 g |
| Metolose TC-5 (a 2% aqueous solution) manufactured by Shin-etsu Chemical Industry Co., Ltd. | 8.6 g |
| MP-1000 manufactured by Soken Chemical & Engineering Co., Ltd. | 0.01 g |
| Sodium dodecylbenzenesulfonate (a 1% by mass aqueous solution) | 10 ml |
| NaOH (1% by mass) | 6 ml |
| Proxel (manufactured by ICI) | 1 ml |
| Distilled water | 805 ml |
| (2) Coating of Undercoat | |

Both surfaces of the biaxially-oriented polyethylene terephthalate support (thickness: 175 μm) were subjected to corona discharge treatment in the same manner as above. One surface (to have an image-forming layer thereon) of the support was coated with a coating solution of the undercoat layer formulation (1) using a wire bar, and then dried at 180° C. for 5 minutes to provide a wet coated amount of 6.6 ml/m$^2$ (one surface). Next, the other surface (back surface) of the support was coated with a coating solution of the back layer formulation (2) using a wire bar, and then dried at 180° C. for 5 minutes to provide a wet coated amount of 5.7 ml/m$^2$. The thus-coated back surface was further coated with the back layer formulation (3) using a wire bar, and then dried at 180° C. for 6 minutes to provide a wet coated amount of 7.7 ml/m$^2$, to finally give an undercoated support.

2. Coating of Back Layer 2-1. Preparation of Coating Solution for Back Layer (Preparation of Solid Microparticle Dispersion (a) of Basic Precursor)

1.5 kg of a basic precursor compound 1, 225 g of "DEMOL-N" (trade name; available from Kao Corporation), 937.5 g of diphenylsulfone and 15 g of parahydroxy benzoic acid methyl ester (trade name: MEKKINSU M; available from Ueno Pharmaceutical Co., Ltd.) were mixed and, further, made up to be 5.0 kg in a total weight by being added with distilled water and, then, the resultant mixture was dispersed using a lateral sand mill (trade name: UVM-2; available from Aimex, Ltd.). As to a dispersion condition, the mixture was fed to the UVM-2 filled with zirconia beads having an average diameter of 0.5 mm using a diaphragm pump and kept to be dispersed under an inner pressure of 50 hPa or more until a desired degree of dispersion was obtained. Such dispersion processing has been performed until a degree of dispersion became 2.2 in terms of a ratio (D450/D650) of absorbance at 450 nm against that at 650 nm derived from spectral absorption measurements on the dispersed liquid. The thus-obtained dispersion was diluted with distilled water such that a concentration of the basic precursor was 20 wt %, filtered using a filter (average pore diameter: 3 μm; material: polypropylene) to remove dust.

(Preparation of Dye Solid Microparticle Dispersion)

6.0 kg of a cyanine dye compound-1, 3.0 kg of sodium p-dodecylbenzene sulfonate, 0.6 kg of "DEMOL SMB" (trade name; available from Kao Corporation) and 0.15 kg of "Surfynol 104E" (trade name; available from Nissin Chemical Industry Co., Ltd.) were mixed and, then, made up to be 60 kg in a total weight by being added with distilled water. The resultant mixture was dispersed by a lateral sand mill (trade name: UVM-2; available from Aimex, Limited) with zirconia beads having an average diameter of 0.5 mm. Such dispersion processing has been performed until a ratio (D650/D750) of absorbance became 5.0 or more. The thus-obtained dispersion was diluted with distilled water such that a concentration of the cyanine dye was 6 wt %, filtered using a filter (average pore diamete: 1 μm; material: polypropylene) to remove dust.

(Preparation of Coating Solution for Antihalation Layer)

30 g of gelatin, 24.5 g of polyacrylamide, 2.2 g of 1 mol/L caustic soda, 2.4 g of monodisperse polymethyl methacrylate microparticles (average grain size: 8 μm; grain diameter standard deviation: 0.4), 0.08 g of benzoisothiazolinone, 35.9 g of the above-described dye solid microparticle dispersion (a), 74.2 g of the above-described solid microparticle dispersion (a) of the basic precursor, 0.6 g of sodium polyethylenesulfonate, 0.21 g of a blue dye compound-1, 0.15 g of a yellow dye compound-1 and 8.3 g of acrylic acid/ethyl acrylate copolymerization latex (copolymerization ratio: 5/95) were mixed and made up to be 818 mL in a total volume by being added with water, thereby preparing a coating solution for the antihalation layer. (Preparation of Coating Solution for Protective Layer on Back Surface) While keeping a temperature of a vessel at 40° C., 40 g of gelatin, 1.5 g of liquid paraffin emulsion in terms of liquid paraffin, 35 mg of benzoisothiazolinone, 6.8 g of 1 mol/L caustic soda, 0.5 g of sodium t-octylphenoxyethoxyethane sulfonate, 0.27 g of sodium polystyrene sulfonate, 2.0 g of N,N-ethylene bis(vinyl sulfone acetamide), 5.4 ml of a 2% by mass aqueous solution of a fluorinated surfactant (F-1), 5.4 ml of a 2% by mass aqueous solution of a fluorinated surfactant (F-2), 6.0 g of an acrylic acid/ethyl acrylate copolymer (ratio weight of copolymerization: 5/95) and 2.0 g of N,N-ethylenebis(vinyl sulfonamide) were mixed and made up to be 1,000 ml by being added with water, thereby obtaining a coating solution for the protective layer on the back surface.

2-2. Coating of Back Layer

On the back surface side of the above-described undercoated support, the thus-obtained coating solution for the anti-halation layer and the thus-obtained coating solution for the protective layer on the back surface were simultaneously applied in a superimposing manner such that quantities of gelatin applied of the coating solution for the anti-halation layer and the coating solution for the protective layer on the back surface became 0.44 g/m$^2$ and 1.7 g/m$^2$, respectively and dried, thereby preparing the back layer.

3. Image-forming Layer and Surface Protective Layer 3-1. Preparation of Material for Coating 1) Silver Halide Emulsion (Preparation of Silver Halide Emulsion 1)

To 1,420 ml of distilled water were added 4.3 ml of a 1% by mass aqueous potassium bromide solution, followed by further addition of 3.5 ml of an aqueous sulfuric acid solution (5 mols/liter) and 36.7 g of phthalated gelatin. The resulting mixture was maintained at 42° C. with stirring in a stainless reactor, to which were added 195.6 ml of a solution A containing 22.22 g of silver nitrate diluted with distilled water, and 218 ml of a solution B containing 21.8 g of potassium iodide diluted with distilled water, at a fixed flow rate over a period of 9 minutes. Then, to the resultant mixture were further added 317.5 ml of a solution C containing 51.86 g of silver nitrate diluted with distilled water at a fixed flow rate over a period of 120 minutes, and 600 ml of a solution D containing 60.0 g of potassium iodide diluted with distilled water employing a controlled double jet method while maintaining a constant pAg of 8.1. 10 minutes after the commencement of adding the solutions C and D, potassium hexachloroiridate(III) was added thereto to provide $1\times10^{-4}$ mols per mol of silver. Five seconds after the completion of adding the solution C, an aqueous potassium ferrocyanide solution was added thereto to provide $3\times10^{-4}$ mols per mol of silver. pH was controlled to be 3.8 with sulfuric acid (0.5 mols/liter). Stirring was halted, and the resultant mixture was precipitated, desalted and then washed with water. pH was controlled to be 5.9 with sodium hydroxide (1 mol/liter) to thus give a dispersion of silver halide having pAg of 8.0.

The produced dispersion of silver halide was maintained with stirring at 38° C., to which was added 5 ml of a solution of 0.34% by mass 1,2-benzoisothiazolin-3-one in methanol. 40 minutes after, the temperature was raised to 47° C. 20 minutes after raising, $7.6\times10^{--5}$ mols, per mol of silver, of a solution of sodium benzenethiosulfonate in methanol was added; and 5 minutes after, $2.9\times10^{-4}$ mols, per mol of silver, of a solution of tellurium sensitizer C in methanol was added, followed by ripening for 91 minutes. The, a solution of spectral sensitizing dye A and spectral sensitizing dye B in a ratio of 3/1 by mol in methanol was added thereto to give a total amount of the spectral sensitizing dyes A and B of $1.2\times10^{-3}$ mols per mol of silver. Then, one minute after, 1.3 ml of a solution of 0.8% by mass N,N'-dihydroxy-N"-diethylmelamine in methanol was added thereto, to finally prepare a silver halide emulsion 1.

The grains in the thus-prepared silver halide emulsion were silver iodobromide grains having a mean sphere-corresponding diameter of 0.040 μm and having a sphere-corresponding diameter fluctuation coefficient of 18%. The grain size was obtained from 1,000 grains using an electronic microscope and taking an average.

(Preparation of Mixed Emulsion A1 for Coating)

The thus-prepared Silver Halide Emulsion 1 was dissolved, to which was added $7\times10^{-3}$ mol, based on 1 mol of silver, of a 1% by mass aqueous solution of benzothiazolium iodide. Further, water was added to the resultant mixture such that a content of silver halide per 1 kg of a mixed emulsion for a coating solution reached 38.2 g in terms of silver to thereby prepare Mixed Emulsion A1 for Coating.

(Preparation of Silver Halide Emulsion 2)

To 1,421 ml of distilled water were added 3.1 ml of a 1% by mass potassium bromide solution and 3.5 ml of sulfuric acid having a concentration of 0.5 mol/L and 31.7 g of phthalated gelatin. While the resultant mixture was stirred with maintaining 30° C. in a reaction vessel made of stainless steel, an entire amount of both a solution A which had been prepared by adding distilled water to 22.22 g of silver nitrate to be 95.4 ml and a solution B which had been prepared by adding distilled water to 15.3 g of potassium bromide and 0.8 g of potassium iodide to be 97.4 ml was added to the foregoing mixture at a constant flow-rate consuming 4 seconds, followed by further addition of 10 ml of a 3.5% by mass aqueous solution of hydrogen peroxide was added thereto to prepare a mixture. To the thus-prepared mixture were added a solution C which had been prepared by adding distilled water to 51.86 g of silver nitrate to make an entire volume up to be 317.5 ml and a solution D which had been prepared by adding distilled water to 44.2 g of potassium bromide and 2.2 g of potassium iodide to make an entire volume up to be 400 ml such that an entire amount of the solution C was added at a constant flow rate consuming 20 minutes and the solution D was added through a controlled double jet method while keeping a pAg value at 8.1. 10 minutes after such additions of the solution C and the solution D were started, an entire amount of a potassium salt of hexachloroiridic acid (III) was added to reach $1\times10^{-4}$ mol, based on 1 mol of silver. Further, five seconds after the addition of Solution C was completed, an entire amount of an aqueous solution of potassium hexacyanoiron (II) was added to reach $3\times10^{-4}$ mol, based on 1 mol of silver. When the pH of the resultant mixture was adjusted to 3.8 by using sulfuric acid having a concentration of 0.5 mol/L, a stirring operation was stopped to perform precipitation/desalting/washing steps. Then, the pH of the resultant mixture was adjusted to 5.9 by using sodium hydroxide having a concentration of 1 mol/L, thereby preparing a silver halide dispersion having a pAg value of 8.0.

To the silver halide dispersion while being stirred and maintained at 38° C., 5 ml of a 0.34% by mass methanol solution of 1,2-benzoisothiazoline-3-one was added and, after 40 minutes elapsed, heated to 47° C. 20 minutes after such heating, to the resultant mixture was added $7.6\times10^{-5}$ mol, based on 1 mol of silver, of a methanol solution of sodium benzene thiosulfonate, after 5 minutes elapsed, to which was added $2.9\times10^{-4}$ mol, based on 1 mol of silver, of a methanol solution of tellurium sensitizing agent C and ripened for 91 minutes. Thereafter, to the resultant mixture was added $1.2\times10^{-3}$ mol in terms of the sum of Spectral Sensitizing Dye A and Spectral Sensitizing Dye B of a methanol solution of Spectral Sensitizing Dye A and Spectral Sensitizing Dye B, based on 1 mol of silver, in a molar ratio of 3:1, after 1 minute elapsed, to which was added 1.3 ml of a 0.8% by mass methanol solution of N,N'-dihydroxy-N",N"-diethylmelamine to prepare a silver halide emulsion 2.

Grains in the thus-prepared silver halide emulsion were silver iodobromide grains, in which iodine was uniformly contained, having an average sphere-equivalent diameter of 0.042 μm and a variation coefficient of a sphere-equivalent diameter is 20%. Grain size was determined from an average of 1,000 grains by means of an electron microscope. A {100} plane proportion of these grains was measured by the Kubelka-Munk method and found to be 80%.

(Preparation of Mixed Emulsion A2 for Coating Solution)

The thus-prepared Silver Halide Emulsion 2 was dissolved, to which was added $7\times10^{-3}$ mol, based on 1 mol of silver, of a 1% by mass aqueous solution of benzothiazolium iodide. Further, to the resultant mixture was added water such that a content of silver halide per 1 kg of a mixed emulsion for a coating solution to be prepared came to be 38.2 g in terms of silver to prepare Mixed Emulsion A2 for Coating Solution.

2) Preparation of Fatty Acid Silver Salt Dispersion (Preparation of Fatty Acid Silver Salt Dispersion A)

87.6 kg of benenic acid (EDENOR C22-85R manufactured by Henkel), 423 liters of distilled water, 49.2 liters of an aqueous NaOH solution (5 mols/liter), and 120 liters of tert-butanol were admixed together and allowed to cause reaction, with stirring at 75° C. for 1 hour, to prepare a solution of sodium behenate. Separately, 206.2 liters of an aqueous solution (pH 4.0) of 40.4 kg of silver nitrate was prepared, and maintained at 10° C. 635 liters of distilled water and 30 liters of tert-butanol were poured into a reactor and maintained at 30° C., into which were fed, with stirring, the solution containing sodium behenate prepared as above entirely and the aqueous silver nitrate solution prepared as above entirely at a predetermined flow rate, over a period of 93 minutes and 15 seconds, and 90 minutes, respectively.

At this stage, for the duration of 11 minutes after the commencement of feeding the aqueous silver nitrate solution, only the aqueous silver nitrate solution could be added, then the sodium behenate solution was started to be fed, and for the duration of 14 minutes and 15 seconds after completion of feeding the aqueous silver nitrate, only the sodium benenate solution was added to the reactor. At this stage, the temperature inside the reactor was set at 30° C., and the temperature outside it was so controlled to keep the liquid temperature inside constant.

The pipes through which the sodium behenate solution flew was kept warm by steam tracing, and the steam opening was controlled to keep the liquid temperature at the outlet of the nozzle tip at 75° C. The pipes through which the aqueous silver nitrate solution flew was kept warm by circulating cold water outside the double-walled pipe. The positions at which the sodium behenate solution and the aqueous silver nitrate solution, respectively, were added were disposed symmetrically to each other relative to the shaft of the stirrer, with the heights adjusted in order not to contact with the reaction solution.

After addition of the sodium behenate solution was completed, the reaction system was kept standing with stirring and the temperature was maintained for 20 minutes, then raised to 35° C. over 30 minutes, followed by ripening for 210 minutes. Subsequently, centrifugal filtration was conducted to separate solids, which were then washed with water until the conductivity of the filtrate water reached 30 μS/cm, to thus give a silver salt of the fatty acid as solids. The solids were stored as a wet cake without drying.

The silver behenate grains obtained as above were analyzed for the shape by electronmicroscopic photography, revealing that the obtained grains were flaky crystals having the dimensions of a=0.14 μm, b=0.4 μm and c=0.6 μm, all on average (a, b and c are determined as defined above). The mean aspect ratio was 5.2, the mean sphere-corresponding diameter was 0.52 μm and the mean sphere-corresponding fluctuation coefficient was 15%.

To the wet cake, corresponding to a weight of 260 kg in dry weight, were added 19.3 kg of polyvinyl alcohol (product name: PVA-217) and water to make a total weight of 1,000 kg, and formed into a slurry using a dissolver blade, followed by pre-dispersing in a homo-mixer (MODEL PM-10 manufactured by Mizuho Industry, Inc.).

Next, the pre-dispersed stock solution was processed three times in a dispersion mixer (MICROFLUIDIZER M-610 manufactured by Microfluidex International Corporation, equipped with a Z type interaction chamber) at a controlled pressure of 1,260 kg/cm$^2$ to give a dispersion of silver behenate. Cooling was carried out by bellows-type heat exchangers disposed before and after an interaction chamber, with controlling the temperature of the refrigerant to achieve a dispersion temperature of 18° C.

(Preparation of Fatty Acid Silver Dispersion B)

<Preparation of Recrystallized Behenic Acid>

To 100 kg of behenic acid (trade name: EDENOR C22-85R; available from Henkel Corporation) was added 1200 kg of isopropyl alcohol and dissolved at 50° C. and, after the resultant solution was filtered by a filter of 10 μm, the resultant filtrate was cooled to 30° C. to allow recrystallization to proceed. A cooling rate was controlled to be 3° C./hr. Crystals obtained by the above procedures were subjected to centrifugal filtration, washed with 100 kg of isopropyl alcohol in a sprinkling manner and dried. High purity behenic acid, in which a content of behenic acid was 96% by mass, that of lignoceric acid was 2% by mass and that of arachidic acid was 2% by mass, was obtained. Analysis of the above composition was performed by esterifying such recrystallized material and then measuring the thus-esterified recrystallized material by a GC-FID method.

<Preparation of Fatty Acid Silver Dispersion B>

88 kg of recrystallized behenic acid, 422 L of distilled water, 49.2 L of an aqueous NaOH solution at a 5 mol/L concentration and 120 L of t-butyl alcohol were mixed and, then, the resultant mixture was stirred at 75° C. for one hour to allow the mixture to react, thereby obtaining a sodium behenate solution. Separately, 206.2 L (pH 4.0) of an aqueous solution containing 40.4 kg of silver nitrate was prepared and kept at 10° C. A reaction vessel containing 635 L of distilled water and 30 L of t-butyl alcohol was kept at 30° C., to which was added an entire volume of the thus-obtained sodium behenate solution and an entire volume of the aqueous silver nitrate solution each at a constant flow rate for 93 minutes and 15 seconds, and 90 minutes, respectively, while being thoroughly mixed.

At this point, only the aqueous silver nitrate solution was added in a first 11-minute period after the start of addition thereof and, then, the sodium behenate solution was started to be added and only the sodium behenate solution was added in a last 14-minute-and-15 second period after the end of addition of the aqueous silver nitrate solution. At this time, a temperature in the reaction vessel was kept at 30° C. and was controlled externally so as to keep the liquid temperature constant.

Pipes in a feeding system of the sodium behenate solution were arranged such that a temperature of the piping was kept by circulating hot water in an outer portion of a double pipe and an outlet liquid temperature at the end of the feed nozzle was adjusted to be 75° C. Further, the pipes in the feeding system of the sodium behenate solution were regulated such that the pipes were kept warm by circulating hot water in the outer portion of the double pipe and the outlet liquid temperature at the end of the feed nozzle was allowed to be 75° C. Further, a temperature of pipes in a feeding system of a silver nitrate solution was kept by circulating cold water in an outer portion of a double pipe. A point of addition of the sodium behenate solution and a point of addition of the aqueous silver nitrate solution were symmetrically arranged around a stirring axis as a center and these points were adjusted high enough to prevent them from contacting the reaction solution.

After completion of such an addition of the sodium behenate solution, the resultant mixture was allowed to stand for 20 minutes under stirring with a temperature thereof unchanged and, then, elevated to 35° C. consuming 30 minutes and, thereafter, ripened for 210 minutes. Immediately after completion of such ripening, the solids were separated by centrifugal filtration and, then, rinsed with water until electric conductivity of a filtrate became 30 μS/cm. Thus, a fatty acid silver salt was obtained. The thus-obtained solids were stored in a wet cake form without being dried.

When a shape of the obtained grains was assessed by a microscopic photographing, the produced silver behenate grains were crystals each having average values of a=0.21 μm, b=0.4 μm and c=0.4 μm, an average aspect ratio of 2.1, an average sphere-equivalent diameter of 0.51 μm and a coefficient of variation of the sphere-equivalent of 11%.

To the wet cake equivalent to dry solid content of 260 kg were added 19.3 kg of polyvinyl alcohol (trade name; PVA-217) and then water to make a total amount up to be 1,000 kg and, then, the resultant mixture was changed into a slurry state using a dissolver blade and, thereafter, preliminarily dispersed employing a pipeline mixer "PM-10".

Next, such a preliminarily dispersed stock solution was dispersed three times using the MICRO FLUIDIZER-M-610 (equipped with a Z type interaction chamber) under a pressure of 1,150 kg/cm$^2$, thereby obtaining a silver behenate dispersion B. During the dispersion, cooling operation was performed such that coiled heat exchangers were attached each to an inlet and an outlet of the interaction chamber and a temperature of coolant was controlled to keep the dispersion temperature at 18° C.

3) Preparation of Reducing Agent Dispersion

<Preparation of Reducing Agent Complex-1 Dispersion>

10 kg of water was added to 10 kg of a reducing agent complex-1 (6,6'-di-t-butyl-4,4'-dimethyl-2,2'-butylidenediphenol), 0.12 kg of triphenylphosphine oxide and 16 kg of a 10% by mass aqueous solution of a modified polyvinyl alcohol (trade name: POVAL MP203; available from Kuraray Co., Ltd.) and then mixed thoroughly to prepare a slurry. The thus-prepared slurry was fed using a diaphragm pump to a lateral sand mill (trade name: UVM-2; available from Aimex, Ltd.) filled with zirconia beads having an average diameter of 0.5 mm, dispersed for 4 hours and 30 minutes, followed by addition of 0.2 g of a benzoisothiazolinone sodium salt and water such that a concentration of the reducing agent complex reached 22% by mass, thereby obtaining a reducing agent complex-1 dispersion.

As to reducing agent complex grains contained in the thus-obtained reducing agent complex dispersion, a dispersion time period was adjusted such that an average grain size thereof became 0.45 μm in terms of a median diameter. A maximum grain diameter of these grains of the dispersion was 1.4 μm or less. The obtained dispersion was filtered through a polypropylene-made filter having a pore diameter of 3.0 μm to remove foreign matters such as dust and the like and, then, stored.

<Preparation of Reducing Agent-2 Dispersion>

10 kg of water was added to 10 kg of a reducing agent-2 (6,6'-di-t-butyl-4,4'-dimethyl-2,2'-butylidenediphenol) and 16 kg of a 10% by mass aqueous solution of a modified polyvinyl alcohol "MP203" and, then mixed thoroughly to prepare a slurry. The thus-prepared slurry was fed using a diaphragm pump to a lateral sand mill "UVM-2" filled with zirconia beads having an average diameter of 0.5 mm, dispersed for 3 hours and 30 minutes, followed by addition of 0.2 g of a benzoisothiazolinone sodium salt and water such that a concentration of the reducing agent reached 25% by mass. The resultant dispersion was heated at 60° C. for 5 hours to obtain a reducing agent-2 dispersion.

As to reducing agent grains contained in the thus-obtained reducing agent dispersion, a dispersion time period was adjusted such that an average grain size thereof became 0.40 μm in terms of a median diameter. A maximum grain diameter of these grains of the dispersion was 1.5 μm or less. The obtained dispersion was filtered through a polypropylene-made filter having a pore diameter of 3.0 μm to remove foreign matters such as dust and the like, and then stored.

4) Preparation of Hydrogen Bond-Forming Compound-1 Dispersion

To 10 kg of a hydrogen bond-forming compound-1 (tri-(4-t-butylphenyl)phosphinoxide) and 16 kg of a 10% by mass aqueous solution of a modified polyvinyl alcohol "MP203" was added 10 kg of water and, then, mixed thoroughly to prepare a slurry. The thus-prepared slurry was fed using a diaphragm pump to a lateral sand mill "UVM-2" filled with zirconia beads having an average diameter of 0.5 mm, dispersed for 3 hours and 30 minutes, followed by addition of 0.2 g of a benzoisothiazolinone sodium salt and water such that a concentration of the hydrogen bond-forming compound reached 25% by mass. The resultant dispersion was heated at 80° C. for one hour to obtain a hydrogen bond-forming compound-1 dispersion.

Hydrogen bond-forming compound grains contained in the thus-obtained dispersion were found to have an average grain size of 0.35 μm in terms of a median diameter and a maximum grain diameter of 1.5 μm or less. The obtained dispersion was filtered through a polypropylene-made filter having a pore diameter of 3.0 μm to remove foreign matters such as dust, and then stored.

5) Preparation of Developing Accelerator-1 Dispersion 10 kg of water was added to 10 kg of a developing accelerator-1 and 20 kg of a 10% by mass aqueous solution of a modified polyvinyl alcohol "MP203" and then mixed thoroughly to prepare a slurry. The thus-prepared slurry was fed using a diaphragm pump to a lateral sand mill "UVM-2" filled with zirconia beads having an average diameter of 0.5 mm, dispersed for 3 hours and 30 minutes, to which were added 0.2 g of a benzoisothiazolinone sodium salt and water such that a concentration of the developing accelerator reached 20% by mass, thereby obtaining a developing accelerator-1 dispersion.

Developing accelerator grains contained in the thus-obtained development accelerator-1 dispersion were found to have a median diameter of 0.48 μm and a maximum grain diameter of 1.4 μm or less. The obtained developing accelerator-1 dispersion was filtered through a polypropylene-made filter having a pore diameter of 3.0 μm to remove foreign matters such as dust, and then stored.

6) Solid Dispersions of Developing Accelerator-2 and Color Tone Controlling Agent-1

As to respective solid dispersions of a developing accelerator-2 and a color tone controlling agent-1, dispersion operations were performed in the same manner as in the developing accelerator-1 to obtain respective 20% by mass dispersion liquids.

7) Preparation of Polyhalogen Compound Dispersion

<Organic Polyhalogen Compound-1 Dispersion>

14 kg of water was added to 10 kg of an organic polyhalogen compound-1 (tribromomethane sulphonylbenzene), 10 kg of a 20% by mass aqueous solution of a modified polyvinyl alcohol "MP203" and 0.4 kg of a 20% by mass aqueous solution of sodium triisopropylnaphthalene sulfonate, and then mixed thoroughly to prepare a slurry. The thus-prepared slurry was fed using a diaphragm pump to a lateral sand mill "UVM-2" filled with zirconia beads having an average diameter of 0.5 mm, dispersed for 5 hours as a reference time period, to which were added 0.2 g of a benzoisothiazolinone sodium salt and water such that a concentration of an organic polyhalogen compound reached 26% by mass, thereby obtaining an organic polyhalogen compound-1 dispersion.

Organic polyhalogen compound grains contained in the thus-obtained dispersion were found to have a median diameter of 0.41 μm and a maximum grain diameter of 2.0 μm or less. The obtained organic polyhalogen compound dispersion was filtered through a polypropylene-made filter having a pore size of 10.0 μm to remove foreign matters such as dust, and then stored.

<Organic Polyhalogen Compound-2 Dispersion>

10 kg of an organic polyhalogen compound-2, 20 kg of a 10% by mass aqueous solution of a modified polyvinyl alcohol "MP203" and 0.4 kg of a 20% by mass aqueous solution of sodium triisopropylnaphthalene sulfonate were admixed thoroughly so as to prepare a slurry. The thus-prepared slurry was fed using a diaphragm pump to a lateral sand mill "UVM-2" which had been filled with zirconia beads having an average diameter of 0.5 mm, dispersed for 5 hours, to which were added 0.2 g of a benzoisothiazolinone sodium salt and water such that a concentration of an organic polyhalogen compound reached 30% by mass. The resultant dispersion was heated at 40° C. for 5 hours to obtain an organic polyhalogen compound-2 dispersion.

Organic polyhalogen compound grains contained in the thus-obtained dispersion were found to have an average grain size of 0.40 μm in terms of a median diameter and a maximum grain diameter of 1.3 μm or less. The obtained organic polyhalogen compound dispersion was filtered through a polypropylene-made filter having a pore size of 3.0 μm to remove foreign matters such as dust, and then stored.

8) Preparation of Phthalazine Compound-1 Solution 8 kg of a modified polyvinyl alcohol "MP203" was dissolved in 174.57 kg of water, to which were added 3.15 kg of a 20% by mass aqueous solution of sodium triisopropylnaphthalene sulfonate and 14.28 kg of a 70% by mass aqueous solution of a phthalazine compound-1, thereby preparing a 5% by mass solution of the phthalazine compound-1.

9) Preparation of Pigment-1 Dispersion

To 64 g of C. I. Pigment "Blue 60" and 6.4 g of "DEMOL-N" was added 250 g of water and, then, mixed thoroughly to prepare a slurry. The thus-prepared slurry was then fed into a vessel together with 800 g of zirconia beads having an average diameter of 0.5 mm and, then, dispersed for 25 hours using a 1/4G sand grinder mill (available from Aimex, Limited.), and diluted with water to obtain a pigment-1 dispersion having a pigment concentration of 5% by mass. An average grain diameter of pigment contained in the thus-obtained dispersion was 0.21 μm.

10) Preparation of SBR Latex Solution

An SBR latex was prepared in the following manner.

287 g of distilled water, 7.73 g of surfactant (trade name: PIONIN A-43-S (solid content: 48.5% by mass); manufactured by Takemoto Oil & Fat Co., Ltd.), 14.06 ml of 1 mol/L NaOH, 0.15 g of tetra sodium ethylene diamine tetraacetate, 255 g of styrene, 11.25 g of acrylic acid, and 3.0 g of t-dodecylmercaptan were supplied in a reaction vessel of a gas monomer reaction apparatus (Model: TAS-2J TYPE; manufactured by Taiatsu Techno Corporation) and, after the vessel was hermetically sealed, followed by stirring at 200 rpm. The vessel was evacuated using a vacuum pump and, after replacement with nitrogen gas several times, fed with 108.7 g of 1,3-butadiene with pressure and, then, a temperature inside the vessel was elevated to 60° C. Thereafter, a solution in which 1.875 g of ammonium persulfate was dissolved in 50 ml water was poured into the vessel and stirred for 5 hours as it was. A temperature of the resultant content was further elevated to 90° C. and stirred for another 3 hours. After a reaction is completed, the inside temperature of the vessel was lowered to room temperature and pH of the content was adjusted to be 8.4 by performing an addition treatment on the content using 1 mol/L NaOH and $NH_4OH$ so as to establish $Na^+$ ion: $NH_4$+ ion=1:5.3 (in molar ratio). Then, filtration was carried out using a filter made of polypropylene having a pore diameter of 1.0 μm to remove foreign matters such as dust, and then stored to thereby give 774.7 g of SBR latex. When a concentration of a halogen ion was measured using ion chromatography, a chloride ion concentration was found to be 3 ppm. A concentration of a chelating agent was measured by high-speed liquid chromatography, and found to be 145 ppm.

The thus-obtained latex was found to be as follows: an average particle diameter was 90 nm; Tg=17° C.; solid content was 44% by mass; equilibrium moisture content at 25° C. 60% RH was 0.6% by mass; ionic conductance was 4.80 mS/cm (as for ionic conductance, latex starting solution (44% by mass) was measured at 25° C. using a diagometer (trade name: CM-30S; manufactured by Toa Denpa Kogyo Co., Ltd.)); and pH was 8.4.

3-2. Preparation of Coating Solution

1) Preparation of Coating Solution-11 for Image-Forming Layer 1,000 g of the above-obtained fatty acid silver dispersion A, 276 ml of water, 33 g of the pigment-1 dispersion, 21 g of the organic polyhalogen compound-1 dispersion, 58 g of the organic polyhalogen compound-2 dispersion, 173 g of the phthalazine compound-1 solution, 1,082 g of the SBR latex (Tg: 17° C.) liquid, 299 g of the reducing agent complex-1 dispersion, 5.7 g of the development accelerator-1 dispersion, 9 ml of the mercapto compound-1 aqueous solution and 27 ml of the mercapto compound-2 aqueous solution were mixed successively and, then, 117 g of a silver halide mixed emulsion A was added to the resultant mixture just before it was applied and, thereafter, thoroughly mixed to obtain a coating solution for the emulsion layer which was then directly fed to a coating die and applied.

Viscosity of the thus-obtained coating solution for the emulsion layer was measured using a B type viscometer (available from Tokyo Keiki K.K.) at 40° C. (with No. 1 rotor at 60 rpm) and found to be 25 mPa·S.

Viscosities of the coating solution measured under shearing velocities of 0.1, 1, 10, 100 and 1,000 (1/second) at 25° C. using "RFS Fluid Spectrometer" (available from Rheometrix Far East Inc.) were 230, 60, 46, 24 and 18 mPa·S, respectively.

Further, a content of zirconium in the coating solution was 0.38 mg per g of silver.

2) Preparation of Coating Solution-21 for Image-Forming Layer 1,000 g of the above-obtained fatty acid silver dispersion B, 276 ml of water, 35 g of the pigment-1 dispersion, 32 g of the organinc polyhalogen compound-1 dispersion, 46 g of the organinc polyhalogen compound-2 dispersion, 173 g of the phthalazine compound-1 solution, 1082 g of the SBR latex (Tg: 17° C.) liquid, 153 g of the reducing agent-2 dispersion, 55 g of the hydrogen bond-forming compound-1 dispersion, 4.8 g of the development accelerator-1 dispersion, 5.2 g of the development accelerator-2 dispersion, 2.1 g of the color tone adjusting agent-1 dispersion, 8 ml of the mercapto compound-2 aqueous solution were mixed successively and, then, 140 g of a silver halide mixed emulsion A was added to the resultant mixture just before it was applied and, thereafter, thoroughly mixed to obtain a coating solution for the emulsion layer which was then directly fed to a coating die and applied.

Viscosity of the thus-obtained coating solution for the emulsion layer was measured using a B type viscometer (available from Tokyo Keiki K.K.) at 40° C. (with No. 1 rotor at 60 rpm) and found to be 40 mPa·S.

Viscosities of the coating solution measured under shearing velocities of 0.1, 1, 10, 100 and 1,000 (1/second) at 25° C. using "RFS Fluid Spectrometer" (available from Rheometrix Far East Inc.) were 530, 144, 96, 51 and 28 mPa·S, respectively.

Further, a content of zirconium in the coating solution was 0.25 mg per g of silver.

3) Preparation of Coating Solution for Intermediate Layer

A coating solution for an intermediate layer was prepared by mixing 1,000 g of polyvinyl alcohol "PVA-205" (available from Kuraray Co., Ltd.), 272 g of the pigment-1 dispersion, 4,200 ml of a 19% by mass liquid of a latex of methyl methacrylate/styrene/butyl acrylate/hydroxyethyl methacrylate/acrylic acid copolymer (weight ratio of copolymerization: 64/9/20/5/2) and 27 ml of a 5% by mass aqueous solution of "Aerosol OT" (available from American Cyanamide Corporation), 135 ml of a 20% by mass aqueous solution of diammonium phthalate, to the thus-prepared coating solution was added water to make a total amount thereof up to 10,000 g and thereafter, the thus-made up coating solution was adjusted using NaOH to bring a pH of 7.5. Then, the thus-adjusted coating solution for the intermediate layer was fed to a coating die so as to attain a coating amount of 9.1 ml/m$^2$.

Viscosity of the coating solution, measured at 40° C. using a B type viscometer (with No. 1 rotor at 60 rpm), was 58 mPa·S.

4) Preparation of Coating solution for First Surface Protective Layer 64 g of inert gelatin was dissolved in water and, then, to the resultant solution were added 80 g of a 27.5% by mass solution of a latex of methyl methacrylate/styrene/butyl acrylate/hydroxyethyl methacrylate/acrylic acid copolymer (weight ratio of copolymerization: 64/9/20/5/2), 23 ml of a 10% by mass methanol solution of phthalic acid, 23 ml of a 10% by mass aqueous solution of 4-methyl phthalic acid, 28 ml of sulfuric acid at a concentration of 0.5 mol/L, 5 ml of a 5% by mass aqueous solution of "Aerosol OT", 0.5 g of phenoxy ethanol and 0.1 g of benzoisothiazolinone, and then a total weight of the resultant coating solution was made up to 750 g by adding water, thereby preparing a coating solution. The thus-prepared coating solution was mixed with 26 ml of a 4% by mass chrome alum solution using a static mixer immediately before a coating operation and fed to a coating die so as to attain a coating amount of 18.6 ml/m$^2$.

Viscosity of the coating solution, measured at 40° C. using a B type viscometer (with No. 1 rotor at 60 rpm), was 20 mPa·S.

5) Preparation of Coating solution for Second Surface Protective Layer 80 g of inert gelatin was dissolved in water and, then, to the resultant solution were added 102 g of a 27.5% by mass solution of a latex of methyl methacrylate/styrene/butyl acrylate/hydroxyethyl methacrylate/acrylic acid copolymer (weight ratio of copolymerization: 64/9/20/5/2), 3.2 ml of a 5% by mass solution of the fluorinated surfactant F-1, 32 ml of a 2% by mass aqueous solution of the fluorinated surfactant F-2, 23 ml of a 5% by mass solution of "Aerosol 0T", 4 g of polymethylmethacrylate microparticles (average grain diameter: 0.7 μm), 21 g of polymethylmethacrylate microparticles (average grain diameter: 4.5 μm), 1.6 g of 4-methylphthalic acid, 4.8 g of phthalic acid, 44 ml of sulfuric acid at a concentration of 0.5 mol/L and 10 mg of benzoisothiazolinone, and, then, a total weight of the resultant coating solution was made up to 650 g by adding water, thereby preparing a coating solution. The thus-prepared coating solution was mixed with 445 ml of an aqueous solution containing 4% by mass of chrome alum solution and 0.67% by mass of phthalic acid using a static mixer immediately before a coating operation and fed to a coating die so as to attain a coating amount of 8.3 ml/m$^2$.

Viscosity of the coating solution, measured at 40° C. using a B type viscometer (with No. 1 rotor at 60 rpm), was 19 mPa·s.

3-3. Preparation of Coating Sample 3-3-1 Preparation of Photothermographic Material-11

On an undercoat surface of a side opposite to a back surface, coating solutions each for an image-forming layer, an intermediate layer, a first surface protective layer and a second surface protective layer were simultaneously applied in this order using a slide bead application method and dried to prepare a photothermographic material-11. At this time, a coating temperature of the image-forming layer and the intermediate layer was adjusted to be 31° C., while coating temperatures of the first surface protective layer and the second surface protective layer were adjusted to be 36° C. and 37° C., respectively.

Coating amounts (g/m$^2$) of respective compounds in the image-forming layer were as follows:

| | |
|---|---|
| Silver behenate | 5.58 |
| C.I. Pigment Blue 60 | 0.036 |
| organic polyhalogen compound-1 | 0.12 |
| organic polyhalogen compound-2 | 0.37 |
| phthalazine compound-1 | 0.19 |
| SBR latex | 9.98 |
| reducing agent complex-1 | 1.41 |
| development accelerator-1 | 0.025 |
| mercapto compound-1 | 0.002 |
| mercapto compound-2 | 0.012 |
| silver halide (in terms of Ag) | 0.091 |

Coating and drying conditions were as follows:

Coating was performed at a speed of 160 m/min while keeping a gap between an end of a coating die and a support to be from 0.10 mm to 0.30 mm and maintaining a pressure in a reduced pressure chamber lower by from 196 Pa to 882 Pa than the atmospheric pressure. The support was destaticized with ionized air before coating.

Next, the coated liquid was cooled in a chilling zone by blowing wind having a dry-bulb temperature of from 10° C. to 20° C. and, then, transferred in a non-contact type manner and, thereafter, dried by a dry air having a dry-bulb temperature of from 23° C. to 45° C. and a wet-bulb temperature of from 15° C. to 21° C. in a helical non-contact type drying apparatus.

After the coating solution was dried, the thus-dried coating solution was moisture-conditioned at 25° C. such that it had a moisture of from 40%RH to 60% RH and, then, a surface of the resultant film was heated up to from 70° C. to 90° C. and, subsequently, cooled down to 25° C.

A matte degree expressed by Beck's smoothness of the thus-prepared photothermographic material was found to be 550 seconds for the image-forming layer side and 130 seconds for the back surface. Further, a pH of the film surface at a side of a surface provided with the image-forming layer was measured and found to be 6.0.

2) Preparation of PhotoThermographic Material-21

A photothermographic material-21 was prepared in the same manner as in the photothermographic material-11 except that the image-forming layer coating solution-11 was changed to an image-forming layer coating solution-2, the yellow dye compound-1 was removed from the anti-halation layer and the fluorinated surfactants F-1 to F-2 in the back surface protective layer and the surface protective layer at a side of the image-forming layer were changed to fluorinated surfactants F-3 and F-4.

Coating amounts (g/m$^2$) of respective compounds in the image-forming layer were as follows:

| | |
|---|---|
| Silver behenate | 5.27 |
| C.I. Pigment Blue 60 | 0.036 |
| organic polyhalogen compound-1 | 0.17 |
| organic polyhalogen compound-2 | 0.28 |
| phthalazine compound-1 | 0.18 |
| SBR latex | 9.43 |
| reducing agent-2 | 0.77 |
| hydrogen bond-forming compound | 0.28 |
| developing accelerator-1 | 0.019 |
| developing accelerator-2 | 0.020 |
| color tone controlling agent-1 | 0.008 |
| mercapto compound-2 | 0.003 |
| silver halide (in terms of Ag) | 0.091 |

Chemical structures of compounds used in the Examples are shown below.

Spectral Sensitizing Dye A

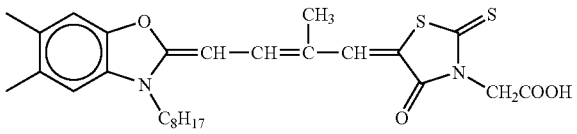

-continued

Spectral Sensitizing Dye B

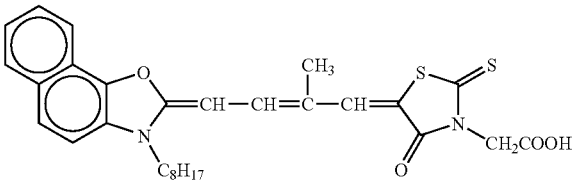

Tellurium Sensitizer C

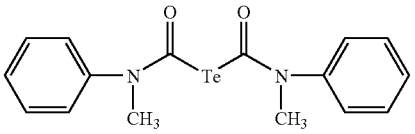

Base Precursor Compound-1

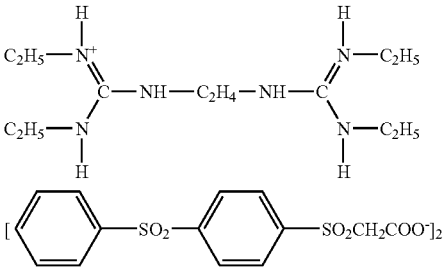

Cyanine Dye Compound-1

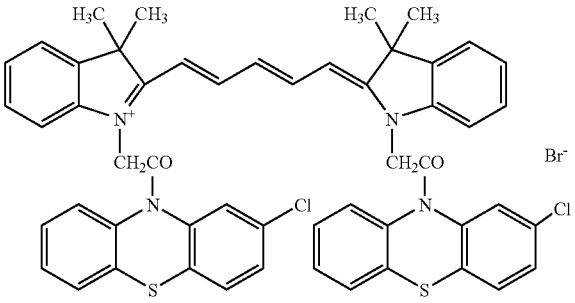

Blue Dye Compound-1

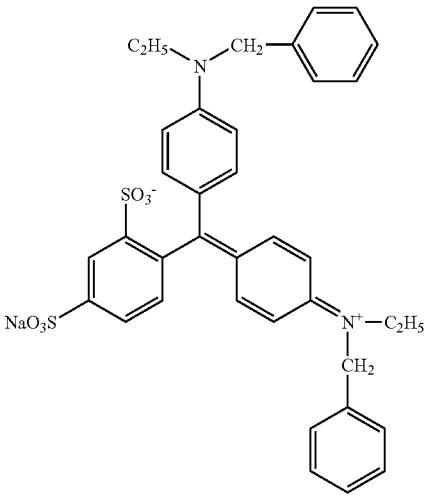

-continued
Yellow Dye Compound-1
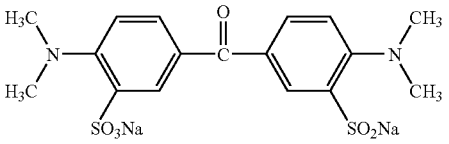
Reducing Agent Complex-1
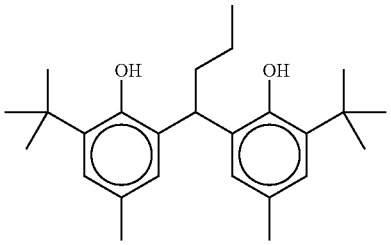
and
1:1 complex of
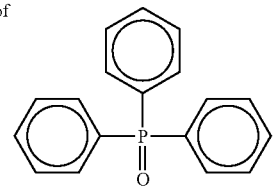
Reducing Agent-2
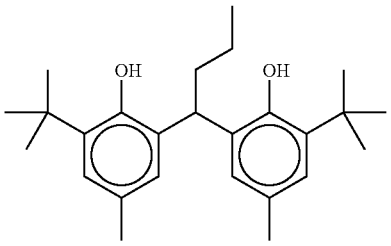
Hydrogen Bond-Forming Compound-1
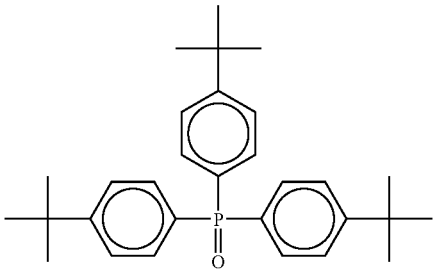
Polyhalogen Compound-1
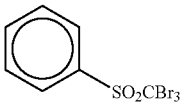
Polyhalogen Compound-2
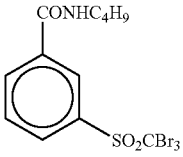
-continued
Mercupto Compound-1
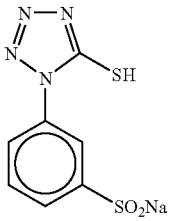
Mercapto Compound-2
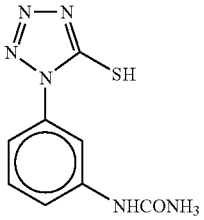
Phthalazine Compound-1
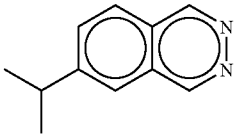
Development Accelerator-1
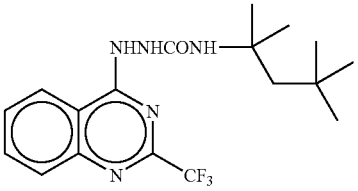
Development Accelerator-2
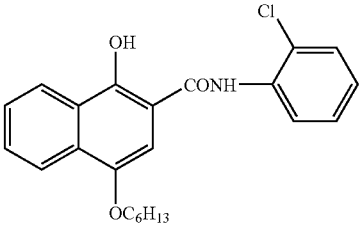
Color Tone Controlling Agent-1
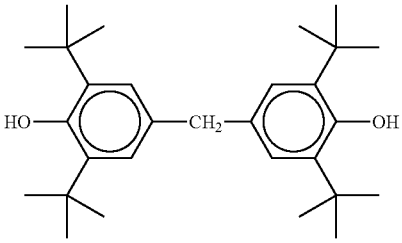

(F-1)

$CF_3(CF_2)_nCH_2CH_2SCH_2CH_2COOLi$

A mixture of n=5 to 11

(F-2)

$CF_3(CF_2)_nCH_2CH_2O(CH_2CH_2O)_mH$

A mixture of n=5 to 11, and m 5 to 15

(F-3)

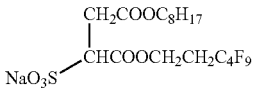

(F-4)

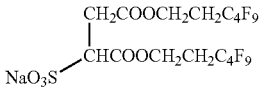

3-3-3. Preparation of Photothermographic Materials-12 and -22

Photothermographic Material-12 and Photothermographic Material-22 were prepared in the same manner as Photothermographic Material-11 and Photothermographic Material-21, respectively, except that Mixed Emulsion A2 for Coating Solution was used instead of Mixed Emulsion A1 for Coating Solution.

3-3-4. Preparation of Photothermographic Materials-13 and -24

1) Preparation of Silver Halide Emulsion 3

Silver Halide Emulsion 3 was prepared in the same manner as Silver Halide Emulsion 1 except that, 4 minutes after 1.3 ml of a 0.8% by mass methanol solution of N,N'-dihydroxy-N",N"-diethyl melamine was added, a methanol solution of an illustrative compound (2-17) as the compound represented by the general formula (1) was added in an amount of $1.4\times10^{-2}$ mol per mol of silver.

2) Preparation of Mixed Emulsion A3 for Coating Solution

Silver Halide Emulsion 3 was dissolved, and a 1% by mass aqueous solution of benzothiazolium iodide was added in an amount of $7\times10^{-3}$ mol per mol of silver. To the resultant solution was added water such that a silver halide content reached 38.2 g in terms of silver per kg of the mixed emulsion for coating solution, to which were added an illustrative compound (17) as the compound represented by the general formula (1) such that a silver halide content reached 0.34 g in terms of silver per kg of the mixed emulsion for coating.

3) Preparation of Coating Solution-13 for Image-forming layer 1,000 g of Fatty Acid Silver Salt Dispersions A obtained in a manner as described above, 276 ml of water, 33 g of Pigment-1 Dispersion, 21 g of Organic Polyhalogen Compound-1 Dispersion, 58 g of Organic Polyhalogen Compound-2 Dispersion, 173 g of Phthalazine Compound-1 Solution, 1,082 g of SBR Latex (Tg: 17° C.) Solution, 299 g of Reducing Agent Complex-1 Dispersion, 5.7 g of Developing Accelerator-1 Dispersion, 9 ml of Mercapto Compound-1 Aqueous Solution, and 27 ml of Mercapto Compound-2 Aqueous Solution were added in this order. Immediately before coating, 117 g of Mixed Emulsion A3 for Coating Solution was added to the resultant mixture and thoroughly stirred, thereby obtaining a coating solution for an image-forming layer. The thus-obtained coating solution for the image-forming layer was fed into a coating die as it was to be applied.

Viscosity of the resultant coating solution for image-forming layer was measured using a B-type viscometer (No. 1 rotor at 60 rpm) (available from Tokyo Keiki Co., Ltd.) and found to be 25 [mPa·s] at 40° C.

Viscosities of the coating solution, measured by RFS Fluidspectrometer (trade name; available from Rheometric Far East. Ltd.) at 25° C., were 230 [mPa·s], 60 [mPa·s], 46 [mPa·s], 24 [mPa·s], and 18 [mPa·s] at shearing velocities of 0.1 [1/second], 1 [1/second], 10 [1/second], 100 [1/second] and 1000 [1/second], respectively.

A content of zirconium in the coating solution was 0.38 mg, based on 1 g of silver.

4) Preparation of Coating Solution-23 for Image-Forming Layer 1,000 g of Fatty Acid Silver Salt Dispersions B obtained in a manner as described above, 276 ml of water, 35 g of Pigment-1 Dispersion, 32 g of Organic Polyhalogen Compound-1 Dispersion, 46 g of Organic Polyhalogen Compound-2 Dispersion, 173 g of Phthalazine Compound-1 Solution, 1,082 g of SBR Latex (Tg: 17° C.) Solution, 153 g of Reducing Agent-2 Dispersion, 55 g of Hydrogen bond-forming compound-1 Dispersion, 4.8 g of Developing Accelerator-1 Dispersion, 5.2 g of Developing Accelerator-2 Dispersion, 2.1 g of Color Tone Controlling Agent-1 Dispersion, and 8 ml of Mercapto Compound-2 Aqueous Solution were added in this order. Immediately before coating, 140 g of Mixed Emulsion A3 for Coating Solution was added to the resultant mixture and thoroughly stirred, thereby obtaining a coating solution for an emulsion layer. The thus-obtained coating solution for the emulsion layer was fed to a coating die as it was to be applied.

Viscosity of the resultant coating solution for emulsion layer was measured using a B-type viscometer (No. 1 rotor at 60 rpm) (available from Tokyo Keiki Co., Ltd.) and found to be 40 [mPa·s] at 40° C.

Viscosities of the coating solution, measured by RFS Fluidspectrometer (trade name; available from Rheometric Far East. Ltd.) at 25° C., were 530 [mPa·s], 144 [mPa·s], 96 [mPa·s], 51 [mPa·s], and 28 [mPa·s] at shearing velocities of 0.1 [1/second], 1 [1/second], 10 [1/second], 100 [1/second] and 1000 [1/second], respectively.

A content of zirconium in the coating solution was 0.25 mg, based on 1 g of silver.

5) Coating

Photothermographic Material-13 and Photothermographic Material-23 were prepared in the same manner as Photothermographic Material-11 and Photothermographic Material-12, respectively, except that Coating Solution-13 for Image-forming layer and Coating Solution-23 for Image-forming layer were used instead of Coating Solution-11 for Image-forming layer and Coating Solution-12 for Image-forming layer in Example 1, respectively.

3-3-5. Preparation of Photothermographic Materials-14 and -24

1) Preparation of Silver Halide Emulsion 4

Silver Halide Emulsion 4 was prepared in the same manner as Silver Halide Emulsion 1, except that 4 minutes after 1.3 ml of a 0.8% by mass methanol solution of N,N'-dihydroxy-N",N"-diethyl melamine was added, a methanol solution of an illustrative compound (2-28) as the compound represented by the general formula (1) was added in an amount of $1.4\times10^{-2}$ mol per mol of silver. 2) Preparation of Mixed Emulsion A4 for Coating Solution Silver Halide Emulsion 4 was dissolved, and a 1% by mass aqueous solution of benzothiazolium iodide was added in an amount of $7\times10^{-3}$ mol per mol of silver. To the resultant solution was added water such that a silver halide content reached 38.2 g in terms of silver per kg of the mixed emulsion for coating, to which was added an illustrative compound (2-28) as the compound represented by the general formula (1) such that a silver halide content reached 0.34 g in terms of silver per kg of the mixed emulsion for coating.

3) Preparation of Coating Solution-14 for Image-Forming Layer 1,000 g of Fatty Acid Silver Salt Dispersions A obtained in a manner as described above, 276 ml of water, 33 g of Pigment-1 Dispersion, 21 g of Organic Polyhalogen Compound-1 Dispersion, 58 g of Organic Polyhalogen Compound-2 Dispersion, 173 g of Phthalazine Compound-1 Solution, 1,082 g of SBR Latex (Tg: 17° C.) Solution, 299 g of Reducing Agent Complex-1 Dispersion, 5.7 g of Developing Accelerator-1 Dispersion, 9 ml of Mercapto Compound-1 Aqueous Solution, and 27 ml of Mercapto Compound-2 Aqueous Solution were added in this order. Immediately before coating, 117 g of Mixed Emulsion A4 for Coating Solution was added to the resultant mixture and thoroughly stirred, thereby obtaining a coating solution for an image-forming layer. The thus-obtained coating solution for the image-forming layer was fed into a coating die as it was to be applied.

Viscosity of the resultant coating solution for the image-forming layer was measured using a B-type viscometer (No. 1 rotor at 60 rpm) (available from Tokyo Keiki Co., Ltd.) and found to be 25 [mPa·s] at 40° C.

Viscosities of the coating solution, measured by RFS Fluidspectrometer (trade name; available from Rheometric Far East. Ltd.) at 25° C., were 230 [mPa·s], 60 [mPa·s], 46 [mPa·s], 24 [mPa·s], and 18 [mPa·s] at shearing velocities of 0.1 [1/second], 1 [1/second], 10 [1/second], 100 [1/second] and 1000 [1/second], respectively.

A content of zirconium in the coating solution was 0.38 mg, based on 1 g of silver.

4) Preparation of Coating Solution-24 for Image-Forming Layer 1,000 g of Fatty Acid Silver Salt Dispersions B obtained in a manner as described above, 276 ml of water, 35 g of Pigment-1 Dispersion, 32 g of Organic Polyhalogen Compound-1 Dispersion, 46 g of Organic Polyhalogen Compound-2 Dispersion, 173 g of Phthalazine Compound-1 Solution, 1,082 g of SBR Latex (Tg: 17° C.) Solution, 153 g of Reducing Agent-2 Dispersion, 55 g of Hydrogen bond-forming compound-1 Dispersion, 4.8 g of Developing Accelerator-1 Dispersion, 5.2 g of Developing Accelerator-2 Dispersion, 2.1 g of Color Tone Adjusting Agent-1 Dispersion, and 8 ml of Mercapto Compound-2 Aqueous Solution were added in this order. Immediately before coating, 140 g of Mixed Emulsion A4 for Coating Solution was added to the resultant mixture and thoroughly stirred, thereby obtaining a coating solution for an image-forming layer. The thus-obtained coating solution for the image-forming layer was fed into a coating die as it was to be applied.

Viscosity of the resultant coating solution for the image-forming layer was measured using a B-type viscometer (No. 1 rotor at 60 rpm) (available from Tokyo Keiki Co., Ltd.) and found to be 40 [mPa·s] at 40° C.

Viscosities of the coating solution, measured by RFS Fluidspectrometer (trade name; available from Rheometric Far East. Ltd.) at 25° C., were 530 [mPa·s], 144 [mPa·s], 96 [mPa·s], 51 [mPa·s], and 28 [mPa·s] at shearing velocities of 0.1 [1/second], 1 [1/second], 10 [1/second], 100 [1/second] and 1000 [1/second], respectively.

A content of zirconium in the coating solution was 0.25 mg, based on 1 g of silver.

5) Coating

Photothermographic Material-14 and Photothermographic Material-24 were prepared in the same manner as Photothermographic Material-11 and Photothermographic Material-12, respectively, except that Coating Solution-14 for Image-forming layer and Coating Solution-24 for Image-forming layer were used instead of Coating Solution-11 for Image-forming layer and Coating Solution-12 for Image-forming layer in Example 1, respectively.

3-3-6. Preparation of Photothermographic Materials-15 and -25

1) Preparation of Silver Halide Emulsion 5

Silver Halide Emulsion 5 was prepared in the same manner as Silver Halide Emulsion 1 except that, 4 minutes after 1.3 ml of a 0.8% by mass methanol solution of N,N'-dihydroxy-N",N"-diethyl melamine was added, a methanol solution of an illustrative compound (2-26) as the compound represented by the general formul (1) was added in an amount of $1.4\times10^{-2}$ mol per mol of silver.

2) Preparation of Mixed Emulsion A5 for Coating Solution

Mixed Emulsion for Silver Halide 5 was dissolved, and a 1% by mass aqueous solution of benzothiazolium iodide was added in an amount of $7\times10^{-3}$ mol against 1 mol of silver. To the resultant solution was added water such that a silver halide content reached 38.2 g in terms of silver per kg of the mixed emulsion for coating, to which was added an illustrative compound (2-26) as the compound represented by the general formula (1) such that a silver halide content reached 0.34 g in terms of silver per kg of the mixed emulsion for coating.

3) Preparation of Coating Solution-15 for Image-Forming Layer 1,000 g of Fatty Acid Silver Salt Dispersions A obtained in a manner as described above, 276 ml of water, 33 g of Pigment-1 Dispersion, 21 g of Organic Polyhalogen Compound-1 Dispersion, 58 g of Organic Polyhalogen Compound-2 Dispersion, 173 g of Phthalazine Compound-1 Solution, 1,082 g of SBR Latex (Tg: 17° C.) Solution, 299 g of Reducing Agent Complex-1 Dispersion, 5.7 g of Developing Accelerator-1 Dispersion, 9 ml of Mercapto Compound-1 Aqueous Solution, and 27 ml of Mercapto Compound-2 Aqueous Solution were added in this order. Immediately before coating, 117 g of Mixed Emulsion A5 for Coating was added to the resultant mixture and thoroughly stirred, thereby obtaining a coating solution for an image-forming layer. The thus-obtained coating solution for the image-forming layer was fed into a coating die as it was to be applied.

Viscosity of the resultant coating solution for the image-forming layer was measured using a B-type viscometer (No. 1 rotor at 60 rpm) (available from Tokyo Keiki Co., Ltd.) and found to be 25 [mPa·s] at 40° C.

Viscosities of the coating solution, measured by RFS Fluidspectrometer (trade name; available from Rheometric Far East. Ltd.) at 25° C., were 230 [mPa·s], 60 [mPa·s], 46 [mPa·s], 24 [mPa·s], and 18 [mPa·s] at shearing velocities of 0.1 [1/second], 1 [1/second], 10 [1/second], 100 [1/second] and 1000 [1/second], respectively.

A content of zirconium in the coating solution was 0.38 mg, based on 1 g of silver.

4) Preparation of Coating Solution-25 for Image-Forming Layer 1,000 g of Fatty Acid Silver Salt Dispersions B obtained in a manner as described above, 276 ml of water, 35 g of Pigment-1 Dispersion, 32 g of Organic Polyhalogen Compound-1 Dispersion, 46 g of Organic Polyhalogen Compound-2 Dispersion, 173 g of Phthalazine Compound-1 Solution, 1,082 g of SBR Latex (Tg: 17° C.) Solution, 153 g of Reducing Agent-2 Dispersion, 55 g of Hydrogen bond-forming compound-1 Dispersion, 4.8 g of Developing Accelerator-1 Dispersion, 5.2 g of Developing Accelerator-2 Dispersion, 2.1 g of Color Tone Adjusting Agent-1 Dispersion, and 8 ml of Mercapto Compound-2 Aqueous Solution were added in this order. Immediately before coating, 140 g of Mixed Emulsion A5 for Coating was added to the resultant mixture and thoroughly stirred, thereby obtaining a coating solution for an image-forming layer. The thus-obtained coating solution for the image-forming layer was fed into a coating die as it was to be applied.

Viscosity of the resultant coating solution for the image-forming layer was measured using a B-type viscometer (No. 1 rotor at 60 rpm) (available from Tokyo Keiki Co., Ltd.) and found to be 40 [mPa·s] at 40° C.

Viscosities of the coating solution, measured by RFS Fluidspectrometer (trade name; available from Rheometric Far East. Ltd.) at 25° C., were 530 [mPa·s], 144 [mPa·s], 96 [mPa·s], 51 [mPa·s], and 28 [mPa·s] at shearing velocities of 0.1 [1/second], 1 [1/second], 10 [1/second], 100 [1/second] and 1000 [1/second], respectively.

A content of zirconiumin the coating solution was 0.25 mg, based on 1 g of silver.

5) Coating

Photothermographic Material-15 and Photothermographic Material-25 were prepared in the same manner as Photothermographic Material-11 and Photothermographic Material-12, respectively, except that Coating Solution-15 for Image-forming layer and Coating Solution-25 for Image-forming layer were used instead of Coating Solution-11 for Image-forming layer and Coating Solution-12 for Image-forming layer, respectively.

3-3-7. Preparation of Photothermographic Materials-16 and -26

1) Preparation of Silver Halide Emulsion 6

Silver Halide Emulsion 6 was prepared in the same manner as Silver Halide Emulsion 1, except that 4 minutes after 1.3 ml of a 0.8% by mass methanol solution of N,N'-dihydroxy-N",N"-diethyl melamine was added, a methanol solution of an illustrative compound (2-6) as the compound represented by the general formula (1) was added in an amount of $1.4\times10^{-2}$ mol per mol of silver.

2) Preparation of Mixed Emulsion A6 for Coating Solution

Silver Halide Emulsion 6 was dissolved, and a 1% by mass aqueous solution of benzothiazolium iodide was added in an amount of $7\times10^{-3}$ mol per mol of silver. To the resultant solution was added water such that a silver halide content reached 38.2 g in terms of silver per kg of the mixed emulsion for coating, to which was added an illustrative compound (2-6) as the compound represented by the general formula (1) such that a silver halide content reached 0.34 g in terms of silver per kg of the mixed emulsion for coating.

3) Preparation of Coating Solution-16 for Image-Forming Layer 1,000 g of Fatty Acid Silver Salt Dispersions A obtained in a manner as described above, 276 ml of water, 33 g of Pigment-1 Dispersion, 21 g of Organic Polyhalogen Compound-1 Dispersion, 58 g of Organic Polyhalogen Compound-2 Dispersion, 173 g of Phthalazine Compound-1 Solution, 1,082 g of SBR Latex (Tg: 17° C.) Solution, 299 g of Reducing Agent Complex-1 Dispersion, 5.7 g of Developing Accelerator-1 Dispersion, 9 ml of Mercapto Compound-1 Aqueous Solution, and 27 ml of Mercapto Compound-2 Aqueous Solution were added in this order. Immediately before coating, 117 g of Mixed Emulsion A6 for Coating was added to the resultant mixture and thoroughly stirred, thereby obtaining a coating solution for an image-forming layer. The thus-obtained coating solution for the image-forming layer was fed into a coating die as it was to be applied.

Viscosity of the resultant coating solution for the image-forming layer was measured using a B-type viscometer (No. 1 rotor at 60 rpm) (available from Tokyo Keiki Co., Ltd.) and found to be 25 [mPa·s] at 40° C.

Viscosities of the coating solution, measured by RFS Fluidspectrometer (trade name; available from Rheometric Far East. Ltd.) at 25° C., were 230 [mPa·s], 60 [mPa·s], 46 [mPa·s], 24 [mPa·s], and 18 [mPa·s] at shearing velocities of 0.1 [1/second], 1 [1/second], 10 [1/second], 100 [1/second], and 1000 [1/second], respectively.

A content of zirconium in the coating solution was 0.38 mg, based on 1 g of silver.

4) Preparation of Coating Solution-26 for Image-Forming Layer 1,000 g of Fatty Acid Silver Salt Dispersions B obtained in a manner as described above, 276 ml of water, 35 g of Pigment-1 Dispersion, 32 g of Organic Polyhalogen Compound-1 Dispersion, 46 g of Organic Polyhalogen Compound-2 Dispersion, 173 g of Phthalazine Compound-1 Solution, 1,082 g of SBR Latex (Tg: 17° C.) Solution, 153 g of Reducing Agent-2 Dispersion, 55 g of Hydrogen bond-forming compound-1 Dispersion, 4.8 g of Developing Accelerator-1 Dispersion, 5.2 g of Developing Accelerator-2 Dispersion, 2.1 g of Color Tone Adjusting Agent-1 Dispersion, and 8 ml of Mercapto Compound-2 Aqueous Solution were added in this order. Immediately before coating, 140 g of Mixed Emulsion A6 for Coating Solution was added to the resultant mixture and thoroughly stirred, thereby obtaining a coating solution for an image-forming layer. The thus-obtained coating solution for the image-forming layer was fed into a coating die as it was to be applied.

Viscosity of the resultant coating solution for the image-forming layer was measured using a B-type viscometer (No. 1 rotor at 60 rpm) (available from Tokyo Keiki Co., Ltd.) and found to be 40 [mPa·s] at 40° C.

Viscosities of the coating solution, measured by RFS Fluidspectrometer (trade name; available from Rheometric Far East. Ltd.) at 25° C., were 530 [mPa·s], 144 [mPa·s], 96 [mPa·s], 51 [mPa·s], and 28 [mPa·s] at shearing velocities of 0.1 [1/second], 1 [1/second], 10 [1/second], 100 [1/second] and 1000 [1/second], respectively.

A content of zirconium in the coating solution was 0.25 mg, based on 1 g of silver.

5) Coating

Photothermographic Material-16 and Photothermographic Material-26 were prepared in the same manner as Photothermographic Material-11 and Photothermographic Material-12, respectively, except that Coating Solution-16 for Image-forming layer and Coating Solution-26 for Image-forming layer were used instead of Coating Solution-11 for Image-forming layer and Coating Solution-12 for Image-forming layer, respectively.

3-3-8. Preparation of Photothermographic Materials-17 and -27

1) Preparation of Mixed Emulsion A7 for Coating

Silver Halide Emulsion 1 was dissolved, to whoich was added water such that a silver halide content reached 38.2 g in terms of silver per kg of the mixed emulsion for coating, thereby preparing Mixed Emulsion A7 for Coating Solution.

2) Preparation of Coating Solution-17 for Image-Forming Layer 1,000 g of Fatty Acid Silver Salt Dispersions A obtained in a manner as described above, 276 ml of water, 33 g of Pigment-1 Dispersion, 21 g of Organic Polyhalogen Compound-1 Dispersion, 58 g of Organic Polyhalogen Compound-2 Dispersion, 173 g of Phthalazine Compound-1 Solution, 1,082 g of SBR Latex (Tg: 17° C.) Solution, 299 g of Reducing Agent Complex-1 Dispersion, and 5.7 g of Developing Accelerator-1 Dispersion were added in this order. Immediately before coating, 117 g of Mixed Emulsion A7 for Coating was added to the resultant mixture and thoroughly stirred, thereby obtaining a coating solution for an image-forming layer. The thus-obtained coating solution for the image-forming layer was fed into a coating die as it was to be applied.

Viscosity of the resultant coating solution for the image-forming layer was measured by a B-type viscometer (No. 1 rotor at 60 rpm) (available from Tokyo Keiki Co., Ltd.) and found to be 25 [mPa·s] at 40° C.

Viscosities of the coating solution, measured by RFS Fluidspectrometer (trade name; available from Rheometric Far East. Ltd.) at 25° C., were 230 [mPa·s], 60 [mPa·s], 46 [mPa·s], 24 [mPa·s], and 18 [mPa·s] at shearing velocities of 0.1 [1/second], 1 [1/second], 10 [1/second], 100 [1/second] and 1000 [1/second], respectively.

A content of zirconium in the coating solution was 0.38 mg, based on 1 g of silver.

3) Preparation of Coating Solution-27 for Image-Forming Layer 1,000 g of Fatty Acid Silver Salt Dispersions B obtained in a manner as described above, 276 ml of water, 35 g of Pigment-1 Dispersion, 32 g of Organic Polyhalogen Compound-1 Dispersion, 46 g of Organic Polyhalogen Compound-2 Dispersion, 173 g of Phthalazine Compound-1 Solution, 1,082 g of SBR Latex (Tg: 17° C.) Solution, 153 g of Reducing Agent-2 Dispersion, 55 g of Hydrogen bond-forming compound-1 Dispersion, 4.8 g of Developing Accelerator-1 Dispersion, 5.2 g of Developing Accelerator-2 Dispersion, and 2.1 g of Color Tone Controlling Agent-1 Dispersion were added in this order. Immediately before coating, 140 g of Mixed Emulsion A7 for Coating Solution was added to the resultant mixture and thoroughly stirred, thereby obtaining a coating solution for an image-forming layer. The thus-obtained coating solution for the image-forming layer was fed into a coating die as it was to be applied.

Viscosity of the resultant coating solution for the image-forming layer was measured by a B-type viscometer (No. 1 rotor at 60 rpm) (available from Tokyo Keiki Co., Ltd.) and found to be 40 [mPa·s] at 40° C.

Viscosities of the coating solution, measured by RFS Fluidspectrometer (trade name; available from Rheometric Far East. Ltd.) at 25° C., were 530 [mPa·s], 144 [mPa·s], 96 [mPa·s], 51 [mPa·s], and 28 [mPa·s] at shearing velocities of 0.1 [1/second], 1 [1/second], 10 [1/second], 100 [1/second] and 1000 [1/second], respectively.

A content of zirconium in the coating solution was 0.25 mg, based on 1 g of silver.

5) Coating

Photothermographic Material-17 and Photothermographic Material-27 were prepared in the same manner as Photothermographic Material-11 and Photothermographic Material-12, respectively, except that Coating Solution-17 for Image-forming layer and Coating Solution-27 for Image-forming layer were used instead of Coating Solution-11 for Image-forming layer and Coating Solution-12 for Image-forming layer, respectively.

Formulations of silver halide emulsions applied are shown in Table 1 below.

TABLE 1

| Sample No. | Emulsion No. | Halogen composition | Compound No. represented by General Formula (1) | Coating solution No. | Remarks |
|---|---|---|---|---|---|
| 11 | 1 | AgI | None | 2-17, 2-23 | Present Invention |
| 12 | 2 | AgBrI 3.5 | None | 2-17, 2-23 | Comparative Example |
| 13 | 3 | AgI | 2-17 | 2-17, 2-23 | Present Invention |
| 14 | 4 | AgI | 2-28 | 2-17, 2-23 | Present Invention |
| 15 | 5 | AgI | 2-26 | 2-17, 2-23 | Present Invention |
| 16 | 6 | AgI | 2-6 | 2-17, 2-23 | Present Invention |
| 17 | 1 | AgI | None | None | Comparative Example |
| 21 | 1 | AgI | None | 2-17, 2-23 | Present Invention |
| 22 | 2 | AgI | None | 2-17, 2-23 | Comparative Example |
| 23 | 3 | AgI | 2-17 | 2-17, 2-23 | Present Invention |
| 24 | 4 | AgI | 2-28 | 2-17, 2-23 | Present Invention |
| 25 | 5 | AgI | 2-26 | 2-17, 2-23 | Present Invention |
| 26 | 6 | AgI | 2-6 | 2-17, 2-23 | Present Invention |
| 27 | 1 | AgI | None | None | Comparative Example |

4. Evaluation of Photographic Performances

1) Packaging

Each of thus-obtained samples was cut into 20×12 inch sized sheets, packed with a packaging material mentioned below at 25° C. 50% RH, then stored for 2 weeks at room temperature, and assessed according to the tests mentioned below.

(Packaging Material)

The packaging material used was 50 μm thick polyethylene film comprising 10 μm PET/12 μm PE/9 μm aluminum foil/15 μm Ny/50 μm polyethylene containing 3% carbon.

Oxygen transmittance was 0.02 ml/atm·$m^2$·25° C.·day; and moisture transmittance was 0.10 g/atm·$m^2$·25° C.·day.

2) Exposure and Thermal Developing Treatment

The samples were exposed to light using Fuji Medical Dry Laser Imager FM-DP L (equipped with a 660 nm semiconductor laser having a maximum output of 60 mW (IIIB)) and, then, thermally developed (for 24 seconds in total with four plates of panel heaters respectively set at 112° C., 119° C., 121° C., and 121° C. for each of Photothermographic Materials-11 to -17 and for 14 seconds in total in the same manner for Photothermographic Material-21 to -27).

3) Evaluation (Fogging)

Density at an unexposed area in the obtained image was measured using a Macbeth densitometer.

(Sensitivity)

Sensitivity was denoted in terms of a reciprocal number of exposed amount necessary to provide an optical density of fog+1.0 and shown as a relative value taking the sensitivity of Sample 11 to be 100.

(Evaluation of Storability of Unexposed Photosensitive Material)

The photosensitive material thus obtained was stored at 30° C. for 2 months and a change in fogging thereof with a passage of time was examined. The change in fogging is shown in terms of difference (ΔFog) in density between at an initial time of storage and at the end of storage.

(Evaluation of Printout Performance)

The samples treated as above were kept under an illumination intensity of 1,000 lux using a fluorescent light for 3 days in an atmosphere of 30° C. 70% RH. An increase in density at a fogging portion as compared with that before the treatment was regarded as printout performance.

The results are shown in Table 2 below.

TABLE 2

| Sample No. | Sensitivity | ΔFog | Printout performance | Remarks |
|---|---|---|---|---|
| 11 | 100 | 0.04 | 0.01 | Present Invention |
| 12 | 107 | 0.08 | 0.14 | Comparative Example |
| 13 | 104 | 0.01 | 0.01 | Present Invention |
| 14 | 105 | 0.01 | 0.00 | Present Invention |
| 15 | 104 | 0.00 | 0.01 | Present Invention |
| 16 | 103 | 0.02 | 0.00 | Present Invention |
| 17 | 82 | 0.06 | 0.04 | Comparative Example |
| 21 | 101 | 0.05 | 0.02 | Present Invention |
| 22 | 109 | 0.07 | 0.11 | Comparative Example |
| 23 | 106 | 0.00 | 0.01 | Present Invention |
| 24 | 107 | 0.01 | 0.01 | Present Invention |
| 25 | 106 | 0.00 | 0.00 | Present Invention |
| 26 | 103 | 0.01 | 0.01 | Present Invention |
| 27 | 84 | 0.07 | 0.04 | Comparative Example |

As is apparent from the results shown above, it is revealed that the samples according to the invention are high in sensitivity and excellent in printout performance and also excellent in storability without causing an increase in fogging during storage.

Example 2

Preparation and undercoating of a PET support were performed in the same manner as in Example 1.

2. Back Layer 2-1. Preparation of Coating Solution for Back Layer

1) Preparation of Solid Fine Particle Dispersion (a) of Base Precursor 64 g of Base Precursor Compound-1, 10 g of DEMOL N (trade name; manufactured by Kao Corporation), 28 g of diphenylsulfone, and 220 ml of distilled water were mixed and, then, the resultant mixture was dispersed as beads using a 1/4 G Sand-Grinder Mill (trade name; manufactured by Imex Co., Ltd.) to obtain Solid Fine Particle Dispersion (a) of the base precursor compound having an average particle diameter of 0.2 μm.

2) Preparation of Dye Solid Fine Particle Dispersion (a)

9.6 g of Cyanine Dye Compound-1, 5.8 g of sodium p-dodecyl sulfonate, and 305 ml of distilled water were mixed and the resultant mixture was dispersed as beads using a 1/4 G Sand-Grinder Mill (trade name; manufactured by Imex Co., Ltd.) to give Dye Solid Fine Particle Dispersion (a) having an average particle diameter of 0.2 μm.

3) Preparation of Coating Solution for Antihalation Layer 17 g of gelatin, 9.6 g of polyacrylamide, 70 g of Solid Fine Particle Dispersion (a) of Base Precursor thus prepared above, 56 g of Dye Solid Fine Particle Dispersion (a) thus prepared above, 1.5 g of monodispersed fine particles of polymethyl methacrylate (average particle diameter: 8 μm; standard deviation of particle diameter: 0.4), 0.03 g of benzoisothiazolinone, 2.2 g of sodium polyethylene sulfonate, 0.2 g of Blue Dye Compound-1, 3.9 g of Yellow Dye Compound-1, and 844 ml of water were mixed to prepare a coating solution for an antihalation layer.

4) Preparation of Coating Solution for Back Surface Protective Layer

In a vessel maintained at 40° C., 50 g of gelatin, 0.2 g of sodium polystyrene sulfonate, 2.4 g of N,N-ethylene bis (vinyl sulfonamide), 1 g of sodium t-octylphenoxyethoxyethane sulfonate, 30 mg of benzoisothiazolinone, 37 mg of fluorine-type surfactant (F-1), 0.15 mg of fluorine-type surfactant (F-2), 64 mg of fluorine-type surfactant (F-3), 32 mg of fluorine-type surfactant (F-4), 8.8 g of an acrylic acid/ethylacrylate copolymer (weight ratio of copolymerization: 5/95), 0.6 g of Aerosol OT (trade name; manufactured by American Cyanamid Company), 1.8 g of a liquid paraffin emulsion in terms of liquid paraffin, and 950 ml of water were mixed to prepare a coating solution for a back surface protective layer.

2-2. Coating of Back Layer

On a back surface side of the thus-undercoated support, the coating solution for the antihalation layer was applied such that a coated amount of solid fine particle dye reached 0.04 g/m$^2$, and the coating solution for the back surface protective layer was applied in a simultaneous multi-layer manner such that a coated amount of gelatin reached 1.7 g/m$^2$ and then dried to prepare a back layer.

3. Image-forming Layer, Intermediate Layer, and Surface Protective Layer 3-1. Preparation of Material for Coating 1) Preparation of Silver Halide Emulsion (Preparation of Comparative Silver Halide Emulsion A)

To 1,420 ml of distilled water was added 4.3 ml of a 1% by mass potassium iodide solution, followed by further addition of 3.5 ml of sulfuric acid having a concentration of 0.5 mol/L and 36.7 g of phthalated gelatin. While the resultant mixture was stirred, being maintained at 35° C., in a reaction vessel made of stainless steel, to which were added an entire amount of both a solution A which had been prepared by adding distilled water to 22.22 g of silver nitrate to be 195.6 ml and a solution B which had been prepared by adding distilled water to 21.8 g of potassium iodide to be 219 ml at a constant flow-rate for 9 minutes, followed by addition of 10 ml of a 3.5% by mass aqueous solution of hydrogen peroxide and 10.8 ml of a 10% by mass aqueous solution of benzimidazole. To the thus-prepared mixture was added a solution C which had been prepared by adding distilled water to 51.86 g of silver nitrate to be 317.5 ml and a solution D which had been prepared by adding distilled water to 60 g of potassium iodide to be 600 ml, in which an entire amount of the solution C was added at a constant flow rate for 120 minutes and the solution D was added through a controlled double jet method while keeping a pAg value at 8.1.

10 minutes after such additions of Solution C and Solution D were started, an entire amount of potassium hexachloroiridate (III) was added to reach $1\times10^{-4}$ mol, based on 1 mol of silver. When a pH of the resultant mixture was adjusted to 3.8 using sulfuric acid having a concentration of 0.5 mol/L, a stirring operation was stopped to perform precipitation/desalting/washing steps. Then, the pH of the resultant mixture was adjusted to 5.9 using sodium hydroxide having a concentration of 1 mol/L, thereby preparing a silver halide dispersion having a pAg value of 8.0. Grains in the thus-prepared silver halide emulsion were pure silver iodide grains having an average sphere-equivalent diameter of 0.037 μm and a variation coefficient of a sphere-equivalent diameter was 17%. Grain size was determined from an average of 1,000 grains by means of an electron microscope.

To the silver halide dispersion was added, with stirring and maintained at 38° C., 5 ml of a 0.34% by mass methanol solution of 1,2-benzoisothiazoline-3-one and, after 40 minutes elapsed, followed by further addition of $1.2\times10^{-3}$ mol as a total of Spectral Sensitizing Dye A and Sensitizing Dye B, based on 1 mol of silver, of a methanol solution of a 1:1 mixture in a molar ratio of Spectral Sensitizing Dye A and Sensitizing Dye B and, after one minute elapsed, heated to 47° C. 20 minutes after the heating, to the resultant mixture was added $7.6\times10^{-5}$ mol, based on 1 mol of silver, of a methanol solution of sodium benzene thiosulfonate. Further, after 5 minutes elapsed, a pAg of the resultant mixture was adjusted to be 5.5, and then to the mixture was added $5.1\times10^{-4}$ mol, based on 1 mol of silver, of a tellurium sensitizing agent (bis(N-phenyl-N-methyl carbamoyl) telluride) and, thereafter, ripened for 84 minutes. After the pAg of the resultant mixture was adjusted to be 7.5, the mixture was added 1.3 ml of a 0.8% by mass methanol solution of N,N'-dihydroxy-N"-diethylmelamine and, further, after 4 minutes elapsed, added with $4.8\times10^{-3}$ mol, based on 1 mol of silver, of a methanol solution of 5-methyl-2-mercaptobenzimidazole and $5.4\times10^{-3}$ mol, based on 1 mol of silver, of a methanol solution of 1-phenyl-2-heptyl-5-mercapto-1,3,4-triazole to prepare Comparative Silver Halide Emulsion A.

(Preparation of Comparative Silver Halide Emulsion B)

Comparative Silver Halide Emulsion B was prepared in the same manner as Comparative Silver Halide Emulsion A, except that an entire amount of an aqueous solution of potassium hexacyanoiron (II) was added instead of potassium hexachloroiridate (III) to reach $3\times10^{-3}$ mol, based on 1 mol of silver.

(Preparation of Comparative Silver Halide Emulsion C)

Comparative Silver Halide Emulsion C was prepared in the same manner as Comparative Silver Halide Emulsion A, except that potassium hexachloroiridate (III) was removed therefrom.

(Preparation of Silver Halide Emulsions-1' to -7' According to the Present Invention)

<Emulsion-1': Ir/Fe (Ir: uniform; Fe: uniform)>

Silver Halide Emulsion-1' according to the invention was prepared in the same manner as Comparative Silver Halide Emulsion A, except that potassium hexachloroiridate (III) and an aqueous solution of potassium hexacyanoiron (II) were added to Solution C and Solution D, respectively, to render them uniformly doped in quantities of $5\times10^{-4}$ mol and $5\times10^{-3}$ mol, based on 1 mol of silver, respectively.

<Emulsion-2': Ir/Fe (Ir: core; Fe: shell)>

Silver Halide Emulsion-2' according to the invention was prepared in the same manner as Silver Halide Emulsion 1' according to the invention, except that an aqueous solution of potassium hexachloroiridate (III) was added only to Solution C instead of Solutions C and D to render it doped in a core portion and, also, an aqueous solution of potassium hexacyanoiron (II) only to Solution D instead of Solution C and D to render it doped in a shell portion.

<Emulsion-3': Ir/Fe (Ir: core; Fe: surface)>

Silver Halide Emulsion-3' according to the invention was prepared in the same manner as Silver Halide Emulsion-1' according to the invention, except that an aqueous solution of potassium hexacyanoiron (II) was added directly to a grain-forming reaction vessel after a grain has been formed instead of Solutions C and D.

<Emulsion-4': Ru/Fe (Ru: core; Fe: surface)>

Silver Halide Emulsion-4' according to the invention was prepared in the same manner as Silver Halide Emulsion-3' according to the invention except that an aqueous solution of potassium hexachlororuthenate (II) was added instead of a solution of potassium hexachloroiridate (III) to reach $5\times10^{-4}$ mol, based on 1 mol of silver.

<Emulsion-5': Cu/Fe (Cu: core; Fe: surface)>

Silver Halide Emulsion-5' according to the invention was prepared in the same manner as Silver Halide Emulsion-3' according to the invention, except that an aqueous solution of copper (III) nitrate was added instead of a solution of potassium hexachloroiridate (III) to reach $5\times10^{-4}$ mol, based on 1 mol of silver.

<Emulsion-6': Fe/Pt (Fe: core; Pt: surface)>

Silver Halide Emulsion-6' according to the invention was prepared in the same manner as Silver Halide Emulsion-5' according to the invention, except that an aqueous solution of hexacyanoiron (II) was added instead of an aqueous solution of copper (II) nitrate to reach $5\times10^{-3}$ mol, based on 1 mol of silver and, also, an aqueous solution of potassium tetrachloroplatinate (II) was added instead of an aqueous solution of potassium hexacyanoiron (II) to reach $5\times10^{-3}$ mol, based on 1 mol of silver.

<Emulsion-7': Os/Fe (Os: core; Fe: surface)>

Silver Halide Emulsion-7' according to the invention was prepared in the same manner as Silver Halide Emulsion-4' according to the invention, except that an aqueous solution of potassium hexachloroosmate (III) was added instead of an aqueous solution of potassium hexaiodoruthenate (II) to reach $5\times10^{-4}$ mol, based on 1 mol of silver.

(Preparation of Emulsions 1a to 1c, and 1' to 7' for Addition to Coating Solution)

Silver halide emulsions thus obtained were separated into a plurality of small portions and dissolved and, then, 1-(3-methylureido) phenyl-5-mercaptotetrazole was added to each of the thus-separated silver halide emulsions to reach $5\times10^{-3}$ mol therein, based on 1 mol of silver, to which was added water to make a silver halide content, based on 1 kg of an emulsion for addition to a coating solution, to be 38.2 g in terms of silver.

2) Preparation of Fatty Acid Silver Dispersion 87.6 kg of behenic acid (product name: Edenor C22-85R; manufactured by Henkel Co.), 423 L of distilled water, 49.2 L of an aqueous solution of NaOH having a concentration of 5 mol/L and 120 L of t-butyl alcohol were mixed and, then, allowed to react with one another, while being stirred at 75° C. for 1 hour, to obtain a sodium behenate solution. Apart from the sodium behenate solution, 206.2 L of an aqueous solution (pH: 4.0) containing 40.4 kg of silver nitrate was prepared and maintained at 10° C. A reaction vessel charged with 635 L of distilled water and 30 L of t-butyl alcohol was maintained at 30° C. and, then, while being sufficiently stirred, charged with an entire amount of the foregoing sodium behenate solution and an entire amount of the foregoing silver nitrate aqueous solution at a constant flow rate for 93 minutes 15 seconds and 90 minutes, respectively. At that time, the silver nitrate aqueous solution was solely added for 11 minutes after the addition of the silver nitrate aqueous solution was started. After that, the addition of the sodium behenate solution was started. For 14 minutes 15 seconds after the addition of the silver nitrate aqueous solution was completed, the sodium behenate solution was solely added. At that time, a temperature inside the reaction vessel was maintained at 30° C. and a solution temperature was maintained constant by means of an external temperature control. Further, piping of an addition system for the sodium behenate solution was warmed by circulating warm water in an outer part of a double-walled tube so that the solution temperature at an outlet of an addition nozzle tip was adjusted to be 75° C. Piping of an addition system of the aqueous silver nitrate solution was also heat-controlled by circulating cold water in an outer part of a double-walled tube. Positions where the sodium behenate solution and the aqueous silver nitrate solution were added were arranged symmetrically in relation to a stirring shaft in the center, and respective heights of the positions were adjusted such that they do not touch a reaction solution.

After the addition of the sodium behenate solution was completed, the resultant reaction solution was held at a temperature thereof as it was for 20 minutes with stirring and, then, the temperature was elevated up to 35° C. for 30 minutes. After that, the reaction solution was ripened for 210 minutes. Immediately after such ripening, the solids were separated by centrifugal filtration and, then, the thus-separated solids were rinsed with water until electrical conductivity of the filtrate reached 30 μS/cm. Thus, a fatty acid silver salt was obtained. The solids obtained in such a manner as described above was stored as a wet cake without drying.

Shapes of silver behenate particles thus obtained were evaluated by electron microscopic photography. The obtained silver behenate particles were flaky crystals having average values of a=0.14 μm, b=0.4 μm and c=0.6 μm, an average aspect ratio of 5.2, an average sphere-equivalent diameter of 0.52 μm, and a variation coefficient of a sphere-equivalent diameter of 15% (a, b and c were defined according to respective definitions previously described herein).

19.3 kg of polyvinyl alcohol (trade name: PVA-217; manufactured by Kuraray Co., Ltd.) and water were added to the wet cake corresponding to 260 kg of dried solid content to make an entire amount of the resultant mixture up to be 1,000 kg and, then, the resultant mixture was formed into a slurry using dissolver-blades. Further, the slurry was preliminarily dispersed with a pipeline-mixer (Model PM-10; manufactured by Mizuho Industrial Co., Ltd.)

Then, a stock solution thus preliminarily dispersed was processed three times with a dispersing machine (trade name: Microfluidizer M-610 equipped with a Z-type interaction chamber; manufactured by Microfluidex International Corporation) under a pressure adjusted to 1,260 kg/cm$^2$ to obtain a silver behenate dispersion. A dispersion temperature was set at 18° C. by adjusting a temperature of coolant such that a cooling operation was performed using coil type heat exchangers installed in front and rear of the interaction chamber, respectively.

3) Preparation of Reducing Agent Dispersion (a)

7.2 kg of water was added to 10 kg of Reducing Agent Complex-1, 0.12 kg of triphenyl phosphine oxide, and 16 kg of a 10% by mass aqueous solution of modified polyvinylalcohol (trade name: POVAL MP203; manufactured by Kuraray Co. Ltd.). Then, the resultant mixture was thoroughly mixed into a slurry. The slurry was fed by means of a diaphragm pump into a horizontal-type sand mill (trade name: UVM-2; manufactured by Imex Co., Ltd.) filled with zirconia beads having an average diameter of 0.5 mm, and dispersed for 4 hours 30 minutes. Then, 0.2 g of a sodium salt of benzoisothiazolinone and water were added to the resultant dispersion so as to make a concentration of the reducing agent complex to be 25% by mass, thereby obtaining a Reducing Agent Complex-1 Dispersion (a). Particles of the reducing agent complex contained in the reducing agent complex dispersion thus obtained had a median particle diameter of 0.46 μm and a maximum particle diameter of 1.6 μm or less. The thus-obtained reducing agent complex dispersion was filtrated with a filter made of polypropylene having a pore diameter of 3.0 μm to remove foreign matters such as dust and, then, stored.

4) Preparation of Polyhalogen Compound (Preparation of Organic Polyhalogen Compound Dispersion (a))

14 kg of water was added to 10 kg of Organic Polyhalogen Compound-1, 10 kg of a 20% by mass aqueous solution of modified polyvinylalcohol (trade name: POVAL MP203; manufactured by Kuraray Co., Ltd.), and 0.4 kg of a 20% by mass aqueous solution of sodium triisopropylnaphthalene sulfonate. Then, the resultant mixture was thoroughly mixed to form a slurry. The slurry was fed by means of a diaphragm pump into a horizontal-type sand mill (trade name: UVM-2; manufactured by Imex Co., Ltd.) filled with zirconia beads having an average diameter of 0.5 mm, and dispersed for 5 hours. Then, 0.2 g of a sodium salt of benzoisothiazolinone and water were added to such a dispersion so as to make a concentration of the organic polyhalogen compound to be 26% by mass, thereby obtaining Organic Polyhalogen Compound Dispersion (a). Particles of the organic polyhalogen compound contained in the organic polyhalogen compound dispersion thus obtained had a median particle diameter of 0.41 μm and a maximum particle diameter of 2.0 μm or less. The organic polyhalogen Compound dispersion obtained above was filtrated with a filter made of polypropylene having a pore diameter of 10.0 μm to remove foreign matters such as dust and, then, stored.

(Preparation of Organic Polyhalogen Compound Dispersion (b))

10 kg of Organic Polyhalogen Compound-2, 20 kg of a 10% by mass aqueous solution of modified polyvinylalcohol (trade name: POVAL MP203; manufactured by Kuraray Co., Ltd.), 0.4 kg of a 20% by mass aqueous solution of sodium triisopropylnaphthalene sulfonate, and 8 kg of water were thoroughly mixed to form a slurry. The slurry was fed by means of a diaphragm pump into a horizontal-type sand mill (trade name: UVM-2; manufactured by Imex Co., Ltd.) filled with zirconia beads having an average diameter of 0.5 mm, and dispersed for 5 hours. Then, 0.2 g of a sodium salt of benzoisothiazolinone and water were added to such a dispersion so as to make a concentration of the organic polyhalogen compound to be 25% by mass. The resultant dispersion was heated at 40° C. for 5 hours to obtain Organic Polyhalogen Compound-3 Dispersion. Particles of the organic polyhalogen compound contained in the organic polyhalogen compound dispersion thus obtained had a median particle diameter of 0.36 μm and a maximum particle diameter of 1.5 μm or less. The organic polyhalogen compound dispersion thus obtained was filtrated with a filter made of polypropylene having a pore diameter of 3.0 μm to remove foreign matters such as dust and, then, stored.

6) Preparation of Phthalazine Compound-1 Solution 8 kg of modified polyvinylalcohol (trade name: MP203; manufactured by Kuraray Co., Ltd.) was dissolved in 174.57 kg of water. Then, 3.15 kg of a 20% by mass aqueous solution of sodium triisopropylnaphthalene sulfonate and 14.28 kg of a 70% by mass aqueous solution of Phthalazine Compound-1 (6-isopropylphthalazine) were added to the resultant solution to prepare a 5% by mass solution of Phthalazine Compound-1.

7) Preparation of Aqueous Solution of Mercapto Compound-1

7 g of Mercapto Compound-1 was dissolved in 993 g of water to prepare a 0.7% by mass aqueous solution.

8) Preparation of Pigment-1 Dispersion 250 g of water was added to 64 g of C.I. Pigment Blue 60 and 6.4 g of DEMOL N (trade name; manufactured by Kao Corporation). Then, the resultant mixture was thoroughly mixed to form a slurry. 800 g of zirconia beads having an average diameter of 0.5 mm was prepared and charged in a vessel together with the slurry. The slurry was dispersed for 25 hours using a dispersing machine (trade name: 1/4 G Sand-Grinder Mill; manufactured by Imex Co., Ltd.) and, then, taken out of the vessel, to which was added water to make a concentration of such pigment to be a 5% by mass, thereby obtaining Pigment-1 Dispersion. Pigment particles contained in the pigment dispersion thus obtained had an average particle diameter of 0.21 μm.

9) Preparation of SBR Latex Solution

An SBR latex at Tg=23° C. was prepared in the following manner.

70.5 parts by mass of styrene, 26.5 parts by mass of butadiene, and 3 parts by mass of acrylic acid were subjected to emulsion polymerization using ammonium persulfate as a polymerization initiator and an anionic surfactant as an emulsifying agent and, then, the resultant reaction product was aged at 80° C. for 8 hours. Thereafter, the reaction product was cooled to 40° C. and, then, a pH thereof was brought to 7.0. Further, to the resultant mixture was added SANDET BL (trade name; manufactured by Sanyo Chemical Industries, Ltd.) to give a concentration of 0.22%. A pH of the resultant mixture was adjusted to 8.3 using an aqueous 5% NaOH solution, further, adjusted to 8.4 using an aqueous ammonia solution, in which a molar ratio of $Na^+$ ion to $NH_4$+ ion was employed was 1:2.3.

Still further, 0.15 ml of an aqueous 7% solution of a sodium salt of benzoisothiazolinone was added to the thus-pH-adjusted mixture, thereby preparing an SBR latex solution. (SBR latex: latex of -St(70.5)-Bu(26.5)-AA(3))

The latex was found to be as follows: an average particle diameter at Tg=23° C.: 0.1 μm; concentration: 43% by mass; equilibrium moisture content at 25° C. 60% RH: 0.6% by mass; ionic conductance: 4.2 mS/cm (as for ionic conductance, latex starting solution (43% by mass) was measured at 25° C. using a diagometer (trade name: CM-30S; manufactured by Toa Denpa Kogyo Co., Ltd.)); and pH: 8.4.

SBR latices having different Tg's have been prepared in the same manner as described above, with properly changing ratios between styrene and butadiene.

3-2. Preparation of Coating Solution

1) Preparation of Coating Solution for Image-forming Layer 1,000 g of Fatty Acid Silver Salt Dispersion obtained in a manner as described above, 104 ml of water, 30 g of Pigment-1 Dispersion, 6.3 g of Organic Polyhalogen Compound (a) Dispersion, 20.7 g of Organic Polyhalogen Compound (b) Dispersion, 173 g of Phthalazine Compound-1 Solution, 1,082 g of SBR Latex (Tg: 23° C.) Solution, 258 g of Reducing Agent Dispersion (a), and 9 g of Mercapto Compound Solution were added in this order. Immediately before coating, each of emulsions for addition to coating solutions was added to the resultant mixture such that an amount thereof became 6.6% in a molar ratio in terms of silver against the organic acid silver to prepare each of well-mixed coating solutions 1a to 1c, and 1' to 7' for image-forming layers. Each of the thus-obtained coating solutions for image-forming layers was fed into a coating die as it was to be applied.

2) Preparation of Coating Solution for Intermediate Layer 2 ml of a 5% by mass aqueous solution of Aerosol OT (trade name; manufactured by American Cyanamid Company) and 10.5 ml of a 20% by mass aqueous solution of diammonium phthalate were added to 772 g of a 10% by mass aqueous solution of polyvinyl alcohol (trade name: PVA-205; manufactured by Kuraray Co., Ltd.), 5.3 g of Pigment-1 Dispersion, and 226 g of a 27.5% by mass solution of a latex of a methyl methacrylate/styrene/butyl acrylate/hydroxyethyl methacrylate/acrylic acid copolymer (copolymerization ratio by weight: 64/9/20/5/2) and, then, water was added to the resultant mixture to make an entire amount thereof up to be 880 g. A pH value of the thus-made mixture was adjusted to 7.5 using NaOH, thereby obtaining a coating solution for an intermediate layer. The coating solution was fed into a coating die such that a coating amount became 10 $ml/m^2$.

Viscosity of the coating solution measured by a B-type viscometer (No. 1 rotor at 60 rpm) was 65 [mPa·s] at 40° C.

3) Preparation of Coating Solution for First Layer of Surface Protective Layer 64 g of inert gelatin was dissolved in water. To the resultant gelatin solution were added 80 g of a 27.5% by mass solution of a latex of a methyl methacrylate/styrene/butyl acrylate/hydroxyethyl methacrylate/acrylic acid copolymer (copolymerization ratio by weight: 64/9/20/5/2), 23 ml of a 10% by mass methanol solution of phthalic acid, 23 ml of a 10% by mass aqueous solution of 4-methyl phthalic acid, 28 ml of sulfuric acid having a concentration of 0.5 mol/L, 5 ml of a 5% by mass aqueous solution of Aerosol OT (trade name; manufactured by American Cyanamid Company), 0.5 g of phenoxyethanol and 0.1 g of benzoisothiazolinone. Then, water was added to the resultant mixture to make an entire amount thereof up to be 750 g, thereby obtaining a coating solution. Immediately before coating, the coating solution was mixed with 26 ml of a 4% by mass chrome alum solution using a static mixer and, then, fed to a coating die such that a coating amount became 18.6 $ml/m^2$.

Viscosity of the coating solution measured by a B-type viscometer (No. 1 rotor at 60 rpm) was 20 [mPa·s] at 40° C.

4) Preparation of Coating Solution for Second Layer of Surface Protective Layer 80 g of inert gelatin was dissolved in water. To the resultant gelatin solution were added 102 g of a 27.5% by mass solution of a latex of a methyl methacrylate/styrene/butyl acrylate/hydroxyethyl methacrylate/acrylic acid copolymer (copolymerization ratio by weight: 64/9/20/5/2), 3.2 ml of a 5% by mass solution of a fluorine-type surfactant (F-1), 32 ml of a 2% by mass aqueous solution of a fluorine-type surfactant (F-2), 23 ml of a 5% by mass solution of Aerosol OT (trade name; manufactured by American Cyanamid Company), 4 g of polymethyl methacrylate fine particles (average particle diameter: 0.7 μm), 21 g of polymethyl methacrylate fine particles (average particle diameter: 4.5 μm), 1.6 g of 4-methyl phthalic acid, 4.8 g of phthalic acid, 44 ml of sulfuric acid having a concentration of 0.5 mol/L, and 10 mg of benzoisothiazolinone. Then, water was added to the resultant mixture to make an entire amount thereof up to be 650 g, thereby obtaining a mixture. Immediately before coating, to the thus-obtained mixture was further added 445 ml of an aqueous solution containing 4% by mass of chrome alum and 0.67% by mass of phthalic acid using a static mixer to obtain a coating solution for a second surface protective layer. The thus-obtained coating solution for the second surface protective layer was fed into a coating die such that a coating amount became 8.3 ml/m$^2$.

Viscosity of the coating solution measured by a B-type viscometer (No. 1 rotor at 60 rpm) was 19 [mPa·s] at 40° C.

3-3. Preparation of Photothermographic Materials 1a to 1c, and 1' to 7'

On a surface opposite to a back surface, coating solutions each for an image-forming layer, an intermediate layer, a first surface protective layer, and a second surface protective layer were simultaneously applied through a slide bead coating method in this order to prepare the samples of photothermographic materials. Temperatures, at that time, of coating solutions were adjusted such that the coating solution for the image-forming layer and that for the intermediate layer were maintained at 35° C., that for the first surface protective layer was maintained at 36° C., and that for the second surface protective layer was maintained at 37° C.

Coating amount (g/m$^2$) of each compound in the image-forming layer is shown below.

| | |
|---|---|
| Silver behenate | 6.19 |
| Pigment (C.I. Pigment Blue 60) | 0.036 |
| Polyhalogen Compound-1 | 0.04 |
| Polyhalogen Compound-2 | 0.12 |
| Phthalazine Compound-1 | 0.21 |
| SBR latex | 11.1 |
| Reducing Agent Complex-1 | 1.54 |
| Mercapto Compound-1 | 0.002 |
| Silver halide (in terms of silver) | 0.10 |
| Each of compounds of types 1 to 4 | $1 \times 10^{-3}$ mol per mol of silver halide |

Coating and drying conditions are described below.

Coating was performed at a coating speed of 160 m/min. A distance between the tip of the coating die and the support was set in the range of from 0.10 mm to 0.30 mm. Pressure inside a reduced pressure chamber was set lower than the atmospheric pressure by from 196 Pa to 882 Pa. The support was destaticized with ionized air before coating.

After the coated solution was cooled in a subsequent chilling zone with air having a dry bulb temperature of from 10° C. to 20° C., the coated support was transported to a helical non-contact-type drying apparatus in a non-contact manner and, then, dried therein with drying air having a dry bulb temperature of from 23° C. to 45° C. and a wet bulb temperature of from 15° C. to 21° C. to obtain coated samples 21 to 27.

After such drying, the thus-obtained samples were conditioned in moisture contents at 25° C. from 40% to 60% RH and, then, heated such that a temperature of each of surfaces thereof was elevated to 70° C.-90° C. and, subsequently, cooled such that the temperature of the surface was lowered to 25° C.

Matte degrees of the thus-prepared photothermographic material were 550 seconds on the side of the surface of the image-forming layer and 130 seconds on the side of the back surface in terms of Beck's smoothness. The pH value of such a film surface on the side of the image-forming layer was measured and found to be 6.0.

Chemical structures of compounds employed in Examples 2 to 4 according to the invention were the same as those in Example 1.

4. Evaluation of Photographic Performance (Preparation)

Each of the thus-obtained samples was cut into 20×12 inch sized sheets, packed with a packaging material mentioned below at 25° C. 50% RH and, then, stored for 2 weeks at room temperature.

(Packaging Material)

The packaging material used was 50 μm thick polyethylene film comprising 10 μm PET/12 μm PE/9 μm aluminum foil/15 μm Ny/50 μm polyethylene containing 3% carbon.

Oxygen transmittance was 0.02 ml/atm·m$^2$·25° C.·day; and moisture transmittance was 0.10 g/atm·m$^2$·25° C.·day.

The above described photothermographic material was assessed according to the tests mentioned below.

(Exposure of Photothermographic Material)

The photothermographic material was exposed to light in the following manner.

Using a modified Fuji Medical Dry Laser Image FM-DP L, the obtained photothermographic materials were exposed to light and subjected to development treatment.

The exposure was conducted by irradiating such photosensitive material with a 660 nm semiconductor laser having a maximum output of 60 mW (IIIB) in a manner of focusing in an area of 100 μm×100 μm. The exposure was conducted with stepwise changing irradiation quantities of laser. The development was conducted by means of a thermal development part of the FM-DP L, with using four plates of panel heaters therein which had respectively been set at 112° C., 119° C., 121° C., and 121° C. in which an entire developing time was 24 seconds.

(Evaluation of Samples)

Density of the resultant image was measured using a Macbeth densitometer to prepare a characteristic curve of the density to a logarithm of exposed amount.

Sensitivity:

Sensitivity was denoted in terms of a reciprocal number of exposed amount necessary to provide a blackening density of fog+1.0 and is shown as a relative value taking the sensitivity of Sample No. 1 to be 100. Incidentally, as the value becomes larger, the sensitivity becomes higher.

Dmin:

Density of a non-image portion was measured using a Macbeth densitometer.

Storage Properties of Image:

The samples which have been thermally developed were cut into 20×12 inch sized sheets and kept under an illumination intensity of 1000 lux using a fluorescent light for 24 hours in an atmosphere of 30° C. 70% RH. An increase in density at a Dmin portion as compared with that before such a treatment was evaluated.

The results are shown in Table 3.

As is apparent from the results, it is revealed that the photothermographic material according to the invention exhibits high sensitivity and a low level of Dmin by doping two or more metals therein and further maintains a good level of printout performance after thermal development, which is obtained when using a silver iodide emulsion.

TABLE 3

| Sample No. | Dmin | Sensitivity | Printout performance (ΔD min) | Remarks |
|---|---|---|---|---|
| 1a | 0.17 | 95 | 0.12 | Comparative Example |
| 1b | 0.17 | 98 | 0.11 | Comparative Example |
| 1c | 0.19 | 100 | 0.14 | Comparative Example |
| 1' | 0.17 | 105 | 0.09 | Present Invention |
| 2' | 0.16 | 106 | 0.08 | Present Invention |
| 3' | 0.16 | 108 | 0.07 | Present Invention |
| 4' | 0.17 | 107 | 0.07 | Present Invention |
| 5' | 0.16 | 108 | 0.06 | Present Invention |
| 6' | 0.16 | 108 | 0.07 | Present Invention |
| 7' | 0.17 | 107 | 0.07 | Present Invention |

Example 3

Coated samples 2a, 2b, 21', and 27' were obtained in the same manner as the silver halide emulsion in Example 2, except that a silver iodide emulsion was prepared without adding Sensitizing Dyes A and B. Thereafter, the samples were subjected to the same treatments as in Example 2 except for using 405 nm blue laser light to thereby obtain the results shown in Table 4. Incidentally, sensitivity is shown as a relative value taking the sensitivity of sample No. 21' to be 100.

TABLE 4

| Sample No. | Dmin | Sensitivity | Printout performance (ΔD min) | Remarks |
|---|---|---|---|---|
| 2a | 0.15 | 102 | 0.11 | Comparative Example |
| 2b | 0.15 | 103 | 0.10 | Comparative Example |
| 2c | 0.16 | 100 | 0.13 | Comparative Example |
| 21' | 0.14 | 107 | 0.08 | Present Invention |
| 22' | 0.14 | 108 | 0.07 | Present Invention |
| 23' | 0.13 | 108 | 0.07 | Present Invention |
| 24' | 0.14 | 108 | 0.07 | Present Invention |
| 25' | 0.14 | 109 | 0.06 | Present Invention |
| 26' | 0.14 | 108 | 0.07 | Present Invention |

TABLE 4-continued

| Sample No. | Dmin | Sensitivity | Printout performance (ΔD min) | Remarks |
|---|---|---|---|---|
| 27' | 0.14 | 109 | 0.07 | Present Invention |

As is apparent from the results shown in Table 4, it is revealed that the photothermographic material according to the invention exibits high sensitivity and a low level of Dmin by doping two or more metals therein, and further maintains a good level of printout performance after thermal development, which is obtained when using a silver iodide emulsion.

Example 4

An emulsion was prepared in the same manner as in Example 2, except that types of doped metals in a photosensitive silver halide emulsion were changed to those as shown in Table 5. A first metal and a second metal were added, based on 1 mol of silver, in quantities of $5\times10^{-4}$ mol and $3\times10^{-3}$ mol, respectively.

The results obtained and evaluated in the same manner as in Example 2 are shown in Table 5. Sensitivity is shown as a relative value, taking the first metal used alone to be 100, such that the effect exerted by simultaneous doping of two species of metals may be represented. In the same manner as in Example 2, it is revealed that the photothermographic material according to the invention exhibits high sensitivity and a low level of Dmin by doping two metals therein and further maintains a good level of printout performance after thermal development, which is obtained when using a silver iodide emulsion.

TABLE 5

| Sample No. | First Metal | Second Metal | Dmin | Sensitivity | Printout Performance | Remarks |
|---|---|---|---|---|---|---|
| 3a | Ir | — | 0.17 | 100 | 0.11 | Comparative Example |
| 3b | — | Fe | 0.17 | 103 | 0.10 | Comparative Example |
| 3' | Ir | Fe | 0.16 | 107 | 0.07 | Present Invention |
| 5a | Cu | — | 0.17 | 101 | 0.10 | Comparative Example |
| 5b | — | Fe | 0.17 | 102 | 0.10 | Comparative Example |
| 5' | Cu | Fe | 0.16 | 105 | 0.07 | Present Invention |
| 6a | Fe | — | 0.17 | 101 | 0.10 | Comparative Example |
| 6b | — | Pt | 0.17 | 102 | 0.10 | Comparative Example |
| 6' | Fe | Pt | 0.16 | 106 | 0.08 | Present Invention |
| 7a | Os | — | 0.17 | 100 | 0.10 | Comparative Example |
| 7b | — | Fe | 0.17 | 103 | 0.10 | Comparative Example |
| 7' | Os | Fe | 0.16 | 106 | 0.07 | Present Invention |

As detailed above, the present invention provides a photothermographic material which is excellent in printout performance and lightfastness of images after processing and exhibits high sensitivity and low Dmin.

What is claimed is:

1. A photothermographic material comprising a support including on one surface thereof at least a photosensitive silver halide grain having core portion and shell portion, a non-photosensitive organic silver salt, a reducing agent for reducing silver ions and a binder, wherein the photosensitive silver halide grain 1) has a silver iodide content ranging from 10 mol % to 100 mol % and 2) includes metal pairs of a first and a second metal selected from metal pairs consisting of Ir—Fe, Ir—Cu, Ru—Cu, Ru—Fe, Fe—Os, Fe—Ru, Fe—Cu, Fe—Pt, Os—Cu, Os—Fe, Cu—Fe and Cu—Ru wherein the first metal of the metal pair is distributed in said core portion and the second metal of the metal pair is distributed in said shell portion.

2. The photothermographic material according to claim 1, wherein the silver halide grain is chemically sensitized by at least one sensitization selected from the group consisting of chalcogen sensitization, gold sensitization and reduction sensitization.

3. The photothermographic material according to claim 2, wherein the chalcogen sensitization is at least one of tellurium sensitization, selenium sensitization and sulfur sensitization.

4. The photothermographic material according to claim 2, wherein the chalcogen sensitization is at least one of tellurium sensitization and selenium sensitization.

5. The photothermographic material according to claim 2, wherein the chalcogen sensitization is tellurium sensitization.

6. The photothermographic material according to claim 1, wherein the silver iodide content of the silver halide grain ranges from 40 mol % to 100 mol %.

7. The photothermographic material according to claim 6, wherein the silver iodide content of the silver halide grain ranges from 90 mol % to 100 mol %.

8. The photothermographic material according to claim 1, wherein a grain size of the silver halide grain ranges from 10 nm to 50 nm.

* * * * *